US012127632B2

(12) United States Patent
Soderberg et al.

(10) Patent No.: US 12,127,632 B2
(45) Date of Patent: Oct. 29, 2024

(54) CLOSURE SYSTEM AND/OR SHOE CONFIGURATIONS FOR ENHANCING THE PERFORMANCE OF RUNNING SHOES

(71) Applicant: Boa Technology Inc., Denver, CO (US)

(72) Inventors: Mark Soderberg, Conifer, CO (US); Kristopher Lovett, Denver, CO (US); Clark Morgan, Denver, CO (US)

(73) Assignee: Boa Technology Inc., Denver, CO (US)

( * ) Notice: Subject to any disclaimer, the term of this patent is extended or adjusted under 35 U.S.C. 154(b) by 27 days.

(21) Appl. No.: 16/026,305

(22) Filed: Jul. 3, 2018

(65) Prior Publication Data

US 2018/0310671 A1 Nov. 1, 2018

Related U.S. Application Data

(63) Continuation of application No. 14/826,092, filed on Aug. 13, 2015, now abandoned.

(60) Provisional application No. 62/190,640, filed on Jul. 9, 2015, provisional application No. 62/120,005, filed on Feb. 24, 2015, provisional application No. 62/111,032, filed on Feb. 2, 2015, provisional application No. 62/087,694, filed on Dec. 4, 2014, provisional application No. 62/036,965, filed on Aug. 13, 2014.

(51) Int. Cl.
*A43C 11/16* (2006.01)

(52) U.S. Cl.
CPC ..... *A43C 11/165* (2013.01)

(58) Field of Classification Search
CPC ..... A43C 11/16; A43C 11/165
See application file for complete search history.

(56) References Cited

U.S. PATENT DOCUMENTS

| | | | | |
|---|---|---|---|---|
| 4,616,432 A | | 10/1986 | Bunch et al. | |
| 5,205,055 A | | 4/1993 | Harrell | |
| 5,425,185 A | * | 6/1995 | Gansler | A43C 11/00 36/50.1 |
| 5,463,822 A | | 11/1995 | Miller | |
| 5,511,325 A | * | 4/1996 | Hieblinger | A43C 11/00 36/105 |
| 5,692,319 A | | 12/1997 | Parker et al. | |

(Continued)

FOREIGN PATENT DOCUMENTS

EP 0589232 A1 * 3/1994 ..... A43C 11/00

*Primary Examiner* — Megan E Lynch
(74) *Attorney, Agent, or Firm* — Kilpatrick Townsend & Stockton LLP

(57) ABSTRACT

A shoe may include a sole and an upper. The upper may have a medial side and a lateral side that each have an edge positioned on opposing side of the shoe's tongue. The upper's medial side and/or the upper's lateral side may include stiffened regions and flexible regions with each stiffened region being disposed between two flexible regions so that the stiffened regions are moveable relative to one another upon tensioning of the medial and lateral sides of the upper. The opposing edges of the upper's medial and lateral sides may be substantially linear or straight prior to tensioning of the upper's medial and lateral sides and may be substantially uneven or nonlinear subsequent to tensioning of the upper's medial and lateral sides due to relative movement of the stiffened regions.

22 Claims, 41 Drawing Sheets

(56) References Cited

U.S. PATENT DOCUMENTS 5,791,021 A * 8/1998 James ..... A43C 1/003 24/68 SK
5,839,210 A 11/1998 Bernier et al.
6,029,376 A 2/2000 Cass
6,416,074 B1 * 7/2002 Maravetz ..... A43B 5/0401 280/613
6,757,991 B2 7/2004 Sussmann
D553,346 S 10/2007 Dekovic
D553,842 S 10/2007 Paz
7,591,050 B2 9/2009 Hammerslag
8,001,704 B2 8/2011 Baudouin
8,479,415 B2 7/2013 Berger et al.
8,713,820 B2 5/2014 Kerns et al.
2004/0134099 A1 * 7/2004 Jones ..... A43C 11/008 36/50.1
2005/0022427 A1 * 2/2005 Kerns ..... A43C 11/165 36/50.1
2006/0000116 A1 * 1/2006 Brewer ..... A43B 5/00 36/50.1
2007/0227045 A1 10/2007 Aveni et al.
2009/0199435 A1 * 8/2009 Robinson, Jr. ..... A43C 11/16 36/108
2010/0107442 A1 5/2010 Hope et al.
2011/0258876 A1 * 10/2011 Baker ..... A43C 11/1493 36/50.1
2012/0198727 A1 8/2012 Long
2013/0298426 A1 * 11/2013 Pierce ..... A43B 3/06 36/106
2014/0157627 A1 6/2014 Smaldone et al.
2014/0196312 A1 * 7/2014 Sakaue ..... A45F 3/00 36/50.1
2015/0089839 A1 * 4/2015 James ..... A43B 13/18 36/102
2015/0289594 A1 * 10/2015 Rushbrook ..... A43B 3/0005 36/50.1

* cited by examiner

A

B

CLOSURE SYSTEM AND/OR SHOE CONFIGURATIONS FOR ENHANCING THE PERFORMANCE OF RUNNING SHOES

CROSS-REFERENCE TO RELATED APPLICATIONS

This application is a continuation of U.S. patent application Ser. No. 14/826,092 filed Aug. 13, 2015, entitled "Closure System and/or Shoe Configurations for Enhancing the Performance of Running Shoes," which claims priority to Provisional U.S. Patent Application No. 62/036,965 filed Aug. 13, 2014, entitled "Closure System and/or Shoe Configurations for Enhancing the Performance of Running Shoes;" Provisional U.S. Patent Application No. 62/111,032 filed Feb. 2, 2015, entitled "Footwear Configuration Having Improved Fit;" Provisional U.S. Patent Application No. 62/190,640 filed Jul. 9, 2015, entitled "Methods and Systems for Improving the Fit of Shoes;" Provisional U.S. Patent Application No. 62/120,005 filed Feb. 24, 2015, entitled "High and Low Lacing Configuration;" and Provisional U.S. Patent Application No. 62/087,694 filed Dec. 4, 2014, entitled "Automated and Manual Closure of Footwear." The entire disclosure of all of the aforementioned Provisional U.S. Patent Applications are hereby incorporated by reference, for all purposes, as if fully set forth herein.

BACKGROUND OF THE INVENTION

This invention provides various configurations that may be employed to improve the fit and/or performance of shoes and other footwear. Conventional shoe configuration typically are not conforming to the unique shape of a user's foot. As such, the foot may be forced to some degree to conform with the shape of the shoe. These conventional shoes may not provide sufficient support and/or may be relatively uncomfortable to wear. Further, conventional shoes may allow for the foot to slip or move within the shoe and/or not provide sufficient support for an activity that the user is participating in, such as running. As such, the shoe may negatively impact the user's performance to some degree and/or be uncomfortable to wear while participating in the activity.

BRIEF DESCRIPTION OF THE INVENTION

According to one aspect, a shoe may include a sole and an upper that is attached to the sole and configured to fit around the foot of a user. The upper may have a medial side and a lateral side that fit around the medial and lateral sides of a foot, respectively. The medial and lateral sides of the upper may each have an edge that is positioned along a tongue of the shoe so as to face each other. The shoe may also include a tension member that is guided along the shoe's tongue between the upper's medial side edge and the upper's lateral side edge. The tension member may be operationally coupled with the medial and lateral sides of the upper so that upon tensioning of the tension member, the medial and lateral sides of the upper are tightened about the foot. The medial side of the upper and/or the lateral side of the upper may each include a plurality of tensionable regions that are moveable laterally and/or longitudinally relative to one another when tensioned by the tension member such that prior to tensioning of the tension member, the upper's medial side edge and the upper's lateral side edge are relatively linear or straight and subsequent to tensioning of the tension member, upper's medial side edge and the upper's lateral side edge are substantially nonlinear or uneven due to the relative movement of the tensionable regions.

According to another aspect, a shoe may include a sole and an upper that is attached to the sole and configured to fit around the foot of a user. The upper may have a medial side and a lateral side that fit around the medial and lateral side of the foot, respectively. The medial and lateral sides of the upper may each have an edge that is positioned along a tongue of the shoe so as to face each other. At least one of the upper's medial side or the upper's lateral side may include a plurality of stiffened regions and a plurality of flexible regions with each stiffened region being disposed between two flexible regions such that the plurality of stiffened regions are moveable laterally and/or longitudinally relative to one another upon tensioning of the medial and lateral sides of the upper. Prior to tensioning of the medial and lateral sides of the upper, the upper's medial side edge and the upper's lateral side edge may be substantially linear or straight. Subsequent to tensioning of the medial and lateral sides of the upper, the upper's medial side edge and the upper's lateral side edge may be substantially uneven or nonlinear due to relative movement of the plurality of stiffened regions.

According to another aspect, a shoe may include a sole and an upper that is attached to the sole and configured to fit around the foot of a user. The upper may have a medial side and a lateral side that fit around the medial and lateral side of the foot respectively. The shoe may also have a tension member that is guided or directed about a path along the shoe. The path may be positioned on either the medial or lateral side of the shoe so that the tension member is positioned along the medial or lateral side of the shoe without being positioned on an upper portion of the shoe so as to be atop a user's foot. The tension member may be operationally coupled with the shoe so as to cause the shoe to tighten about the foot when the tension member is tensioned. The shoe may further include a tightening mechanism that is operable with the tension member to effect tensioning of the tension member upon operation of the tightening mechanism. The tightening mechanism may be positioned on the medial or lateral side of the shoe adjacent the path of the tension member.

According to another aspect, a shoe may include a sole and an upper attached to the sole and configured to fit around the foot of a user. The shoe may also include a tension member that is routed or directed about a path along a medial or lateral side of the shoe such that the tension member is positioned along the medial or lateral side of the shoe without being positioned on an upper portion of the shoe. The shoe may further include a tightening mechanism that is operable with the tension member to tension the tension member upon operation of the tightening mechanism. Tensioning of the tension member may cause the shoe to tighten about a user's foot.

BRIEF DESCRIPTION OF THE DRAWINGS

The present invention is described in conjunction with the appended figures.

Figure 1:
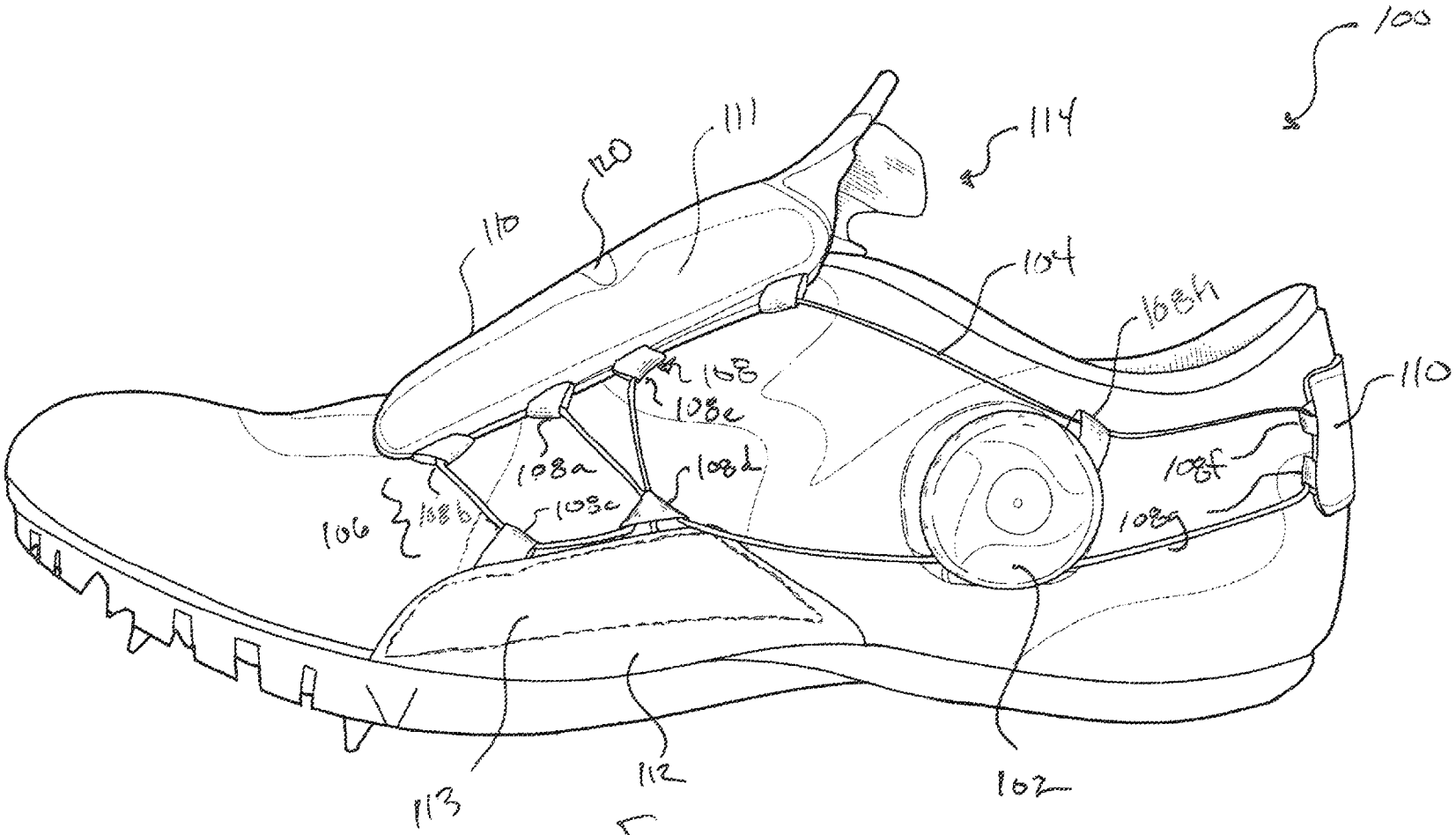
FIGS. 1-3B illustrate an embodiment of a shoe that is configured to enhance the fit and/or performance of the shoe.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

The description and/or claims herein may use relative terms in describing features or aspects of the embodiments. For example, the description and/or claims may use terms such as relatively, about, substantially, between, approximately, and the like. These relative terms are meant to account for deviations that may result in practicing and/or producing the embodiments described herein. A skilled artisan would recognize that minor deviations or variations from the claimed concepts, features, or aspects may occur, but that the such concepts, features, or aspects are still captured by the disclosure herein. These deviations of differences may be up to about 10%, but are typically less than 5%, or even 1%.

Some of the embodiments described herein provide shoe configurations that may enhance the performance of footwear, and especially running shoes. For example, the shoe configuration may include a closure system that is designed to improve the fit of the shoe about the runner's foot, which may aid in the transfer of power from the runner to the shoe and to the ground. The various configurations described herein may also help minimize or eliminate slippage of the foot within the shoe. The increased transfer of power and/or minimized foot slippage may improve the runner's overall ability and thereby increase the runner's speed. The configurations described herein may find particular usefulness in sprinting shoes that include a relatively stiff outsole and track spikes that transfers the runner's motion or power to the ground and/or that provide a spring force as the outsole is loaded or flexed by the running motion. It should be realized, however, that the configuration described herein are not limited to sprinter shoes and may be used for various other shoes or footwear to enhance the fit and/or performance of a particular shoe or footwear.

The fit and/or performance of the shoe may be improved by closing or wrapping the upper of the shoe toward the base of the metatarsal bones. The closure or wrap of the upper should be rearward of the joint between the metatarsals and phalanges and more commonly about midway along the metatarsal bones or rearward of this point. Closing or wrapping the upper of the shoe about this point holds the foot firmly in position within the shoe. Stated differently, closing or wrapping of the shoe about this point minimizes or eliminates slipping of the foot toward the toe box within the shoe. Because the slippage of the foot is minimized, power is transferred from the foot to the shoe rather than being lost or reduced due to slippage. Closing or wrapping the shoe's upper toward the base of the metatarsal bones may also allow the shoe's toe box to be flexible, thereby allowing the phalanges and toes to react more naturally, such as by spreading apart slightly, as the runner contacts the ground. The flexible toe box may also increase the comfort of wearing the shoe.

The fit and/or performance of the shoe may also be improved by increasing the wrap or fit of the shoe about the foot's arch. To increase the wrap or closure of the shoe about the foot's arch, the shoe may be pulled closed toward both the upper and the outsole. Pulling the shoe toward the upper may ensure that the shoe wraps tightly and comfortably around the runner's foot while pulling the shoe toward the outsole may increase the closure or contact of the shoe about the foot's arch. The result of such closure or wrapping of the shoe may be an enhanced sock-like feel of the shoe about the foot. This closure may further reduce slippage of the foot within the shoe and/or enhance the foot's sensitivity within the shoe.

The fit and/or performance of the shoe may also be improved by adjusting the position of the shoe's lace. In one embodiment, the shoe's lace has an asymmetric path or pattern about the foot. The asymmetric path or pattern may be achieved by moving the lace path away from the shoe's tongue and toward the lateral side of the shoe. Repositioning the shoe's lace in this manner moves the lace away from the top of the foot, which is typically more sensitive than the lateral side of the foot due to the position of foot's nerves. Because the lace is positioned away from the top of the foot, the lace is not pressed downward atop the nerves, which may reduce nerve pressure and/or pain. The asymmetric lace positioning or path may also aid in pulling or wrapping the shoe about the foot's arch and/or in closing the shoe about the base of the metatarsal bones.

The fit and/or performance of the shoe may also be improved by increasing the closure of the shoe's collar about the runner's foot. In some embodiments, the collar may be pulled or squeezed about the runner's ankle and/or the shoe's heel may be pulled forward and against the runner's heel. Increasing the closure of the shoe's collar about the runner's ankle and/or pulling the shoe's heel against the runner's heel may aid in reducing or eliminating slippage of the foot within the shoe, which may increase the transfer of power from the runner's foot to the ground.

In some embodiments, the shoe may include one or more straps that close and/or wrap the shoe in one or more of the ways described above. For example, a strap or straps may extend across the shoe's upper from the medial side toward the lateral side. A distal end of the strap may be coupled with the shoe's upper near the base of the metatarsal so that tensioning of the strap's distal end closes and/or tighten the shoe near the base of the metatarsal. A proximal end of the strap may wrap around the shoe's heel, or a portion thereof, so that tensioning of the strap's proximal end closes and/or tightens the shoe's collar about the runner's ankle and/or pulls the shoe's heel against the runner's heel. The distal or mid-portion of the strap may be coupled with the shoe near both the eyestay and the outsole so that tensioning the distal and/or mid-portion of the strap pulls both the upper and lower portions of the shoe (e.g., the eyestay and outsole) against the foot, thereby increasing the contact of the shoe against the foot's arch. The use of the strap may also distribute tightening forces over the top of the foot, thereby reducing or eliminating pressure and/or pain normally caused from lace pressure on the top of the foot. Pressure against the top of the foot may also be reduced by using an asymmetric lace path or pattern about the shoe. For example, the lace may be moved from near the shoe's tongue and toward the lateral side of the shoe.

The strap may include one or more stiffened areas as well as one or more flexible or relaxed areas to allow the strap to flex and conform to the runner's foot as the strap is closed about the foot. The strap may likewise include one or more transition areas that minimize or reduce pressure points against the runner's foot.

In some embodiments, the shoe may be closed and/or tightened about the runner's foot using a reel based closure system. Reel based closure systems commonly include a tightening device that is operated to tension a tension member, such as a lace or cord that is positioned about the shoe and guided by one or more guides or eyelets. A specific example of a tightening device is a knob that may be grasped and rotated by a user to tension the lace. Exemplary embodiments of reel based closure devices are further described in U.S. patent application Ser. No. 13/098,276, filed Apr. 29, 2011, titled "Reel Based Lacing System", U.S. patent application Ser. No. 14/328,521, filed Jul. 10, 2014, titled "Closure Devices Including Incremental Release Mechanisms and Methods Therefor," and U.S. patent application Ser. No. 12/623,362, filed Nov. 20, 2009, titled "Reel Based Lacing System", the entire disclosures of which are incorporated by reference herein.

In another embodiment, the shoe may be closed and/or tightened about the runner's foot using a motorized device or mechanism that tensions the shoe's lace. An exemplary embodiment of a motorized mechanism that may be used to tension the lace is further described in U.S. patent application Ser. No. 14/015,807, filed Aug. 30, 2013, titled "Motorized Tensioning System for Medical Braces and Devices", the entire disclosure of which is incorporated by reference herein.

In other embodiments, the shoe may be closed and tightened about the user's foot using a pull-cord system. The pull-cord system commonly includes a lace or cord that is positioned and guided about the shoe and that is pulled or tensioned by a user to close and/or tighten the shoe. The pull-cord system may include one or more locks that function to lock the lace in a tensioned position and thereby hold the shoe tightly about the user's foot. Exemplary embodiments of pull-cord systems are further described in U.S. patent application Ser. No. 14/166,799, filed Jan. 28, 2014, titled "Lace Fixation Assembly and System", and U.S. Patent Application No. 61/985,332, filed Apr. 28, 2014, titled "Lace Fixation Assembly and System," the entire disclosures of which are incorporated by reference herein.

Although the shoe has been described as being closed and/or tightened using reel based closure systems, motorized systems, and/or pull-cord systems, it should be realized that other methods of closing and/or tightening the shoe are possible. For example, conventional shoelace may be used to close and/or tighten the shoe about the foot. A conventional knot may be tied in the shoelace to hold or maintain the tension in the shoelace.

According to one embodiment, a shoe that is configured as described above may include a sole, an upper that is attached to the sole and configured to fit around the foot of a user, a tension member, and a tightening mechanism that is operable with the tension member to effect tensioning of the tension member. The upper may have a medial side and a lateral side that fit around the medial and lateral side of the foot respectively. The tension member may be guided or directed about a path along the shoe. The path may be positioned on either the medial or lateral side of the shoe so that the tension member is positioned along the medial or lateral side of the shoe without being positioned on an upper portion of the shoe and atop a user's foot, such as above the lateral cuneiform bone or intermediate cuneiform bone. The tension member may be operationally coupled with the shoe so as to cause the shoe to tighten about the foot when the tension member is tensioned. The tightening mechanism may be positioned on the medial or lateral side of the shoe adjacent the path of the tension member.

In a specific embodiment, the tightening mechanism may be positioned below a collar portion of the shoe so as to be positioned immediately below or adjacent the user's ankle. A portion of the tension member may extend toward a heel of the shoe and couples with a strap that is positioned around at least a portion of the heel of the shoe. The tension member may be guided along the path via a plurality of guides, in which a first set of guides is positioned adjacent the sole and a second set of guides is coupled with a distal end of a strap that extends laterally across the upper portion of the shoe. A proximal end of the strap may include two separate section and a flexible portion that is disposed at least partially there between to separate at least a portion of the two separate sections such that the two separate sections are moveable relative to one another and thereby conformable to the shoe and shape of the foot. A proximal end of the strap may be attached to the shoe adjacent the sole with the proximal end being positioned on an opposite side of the shoe from the path of the tension member. In some embodiments, a second strap may extend at least partially around a heel of the shoe. The tension member may be operationally coupled with a distal end of the second strap such that tensioning of the tension member tightens the second strap about the shoe's heel.

In another embodiment, a shoe may include a sole, an upper that is attached to the sole and configured to fit around the foot of a user, a tension member or lace, and a tightening mechanism that is operable with the tension member to tension the tension member upon operation of the tightening mechanism. The tension member or lace may be routed or directed about a path along a medial or lateral side of the shoe such that the tension member is positioned along the medial or lateral side of the shoe without being positioned on an upper portion of the shoe. Tensioning of the tension member may cause the shoe to tighten about a user's foot.

In a specific embodiment, the tightening mechanism may be positioned below a collar portion of the shoe so as to be positioned below the user's ankle. A portion of the tension member may extend toward a heel of the shoe and couple with a strap that is positioned around at least a portion of the heel of the shoe. The tension member may be guided along the path via a plurality of guides, in which a first set of guides is positioned adjacent the sole and a second set of guides is coupled with a distal end of a strap that extends laterally across the upper portion of the shoe. The strap may include a relatively stiff portion and a flexible portion that separates a proximal portion of the strap so that the strap is moveable and conformable to the shape of the foot. A proximal end of the strap may be attached to the shoe adjacent the sole with the proximal end being positioned on an opposite side of the shoe from the path of the tension member. In some embodiments, a second strap may extend at least partially around a heel of the shoe. The tension member may be operationally coupled with a distal end of the second strap such that tensioning of the tension member tightens the second strap about the shoe's heel. In some embodiments, the path of the tension member may be positioned on the medial side of the shoe while the tightening mechanism is positioned on the lateral side of the shoe. In such instances, a pair of tension members may be routed from the tightening mechanism and over the shoe's upper surface to the medial side of the shoe, or a first tension member may be routed from the tightening mechanism and over the shoe's upper surface to the medial side of the shoe while a second tension member is routed around a heel of the shoe to the medial side of the shoe. Specific embodiments of shoes having the above configuration are illustrated in FIGS. 1-5B, which are described herein below.

FIG. 1 illustrates an embodiment of a running shoe 100 that is configured to enhance the fit and performance of the shoe. Shoe 100 includes a tightening mechanism 102, which in the illustrated embodiment is a reel based system having a knob that may be grasped and rotated by a user to tension a lace 104 that is positioned and routed or guided about a lace path 106 via one or more guides 108. The lace path 106 is asymmetrically located about the shoe 100 by being positioned toward the lateral side of the shoe 100. Stated differently, the lace path 106 is positioned away from the tongue portion of the shoe as in conventional shoe systems. Positioning the lace path 106 away from the tongue portion of the shoe 100 and toward the shoe's lateral side reduces pressure that may otherwise be induced of the top of the foot from the tensioned lace. Since various nerves are positioned on the top of the foot, positioning the lace path 106 on the lateral side reduces any unnecessary foot pain or discomfort that occur from the tensioned lace 104, thus providing increased comfort to the user.

As shown in FIG. 1, the lace 104 exits from the tightening mechanism 102 and passes upward at an angle through a first lace guide 108*a* toward the shoe's toe. The first lace guide 108*a* is coupled with a mid-portion of an upper strap 110 that traverses laterally across the upper portion or surface of the shoe 100 and/or across the shoe's tongue (not shown). The lace 104 then traverses through two additional guides, 108*b* and 108*c*, positioned at a distal end of the upper strap 110 and a lower strap 112 and downward toward the outsole and near the toe or front portion of the shoe. The lace 104 traverse near the shoe's outsole, passes through a guide 180*d* positioned at a proximal end of the lower strap 112, and then angles upward and through a lace guide 108*e*. The lace 104 then traverse longitudinally along the shoe toward the heel and through two lace guides, 108*f* and 108*g*, coupled with a proximal portion of the upper strap 110. The lace 104 may traverse through a guide 108*h* attached to the tightening mechanism as it traverses longitudinally along the shoe. The lace then returns to an opposite side of the tightening mechanism 102 and may attach to the tightening mechanism 102 or operationally couple with a spool of the tightening mechanism 102. The lace path 106 configuration shown in FIG. 1 allows a single tightening mechanism 102 to be used to close and tighten the shoe 100. Further, because the lace 104 immediately traverses through the first guide 108*s* and to the front of the shoe 100, tensioning the lace 104 via the tightening mechanism 102 functions to initially pull the mid and distal portions of the upper strap 110 downward as well as tighten the distal portion of the upper strap 110 against the user's foot. Some slight frictional loss in the lace tension may be experienced as the lace 104 traverses through the lace guides 108. Because the lace traverses immediately toward the distal end of the upper strap 110 and the front of the shoe, the tension in the lace will be greatest at that point and the tightness of the shoe may be slightly greater toward the front of the shoe, thereby helping to secure the foot in position within the shoe.

The distal portion or ends of the upper and lower straps, 110 and 112, are positioned about the shoe 100 so as to be rearward of the joint between the foot's metatarsals and phalanges. In some embodiments, the distal end of the upper and/or lower straps, 110 and 112, are positioned about midway along metatarsals or toward the base of the metatarsals. Positioning the distal end of the upper and lower straps, 110 and 112, about the shoe 100 in this manner allows the shoe's material to be pulled against the foot without constricting or overly restricting the metatarsals and phalanges. This configuration minimizes foot discomfort while securing or holding the foot tightly within the shoe. It also allows the shoe's toe box to be relatively flexible or large as desired, which allows the toes to function in a more natural manner (e.g., splay) as the user runs.

As the upper strap 110 is tensioned, the upper strap is pressed downward against the user's foot, which presses the foot rearward and against the shoe's heel, thereby securing the foot within the shoe 100 and minimizing slippage of the foot within the shoe. The tensioned upper strap 110 also presses the foot firmly against the shoe's footpad, which aids in transferring of power from the foot to the outsole as the user runs. Running shoes often have relatively stiff outsoles that are designed to bend or flex slightly as the user runs and to spring back or resiliently return to position to transfer the stored energy to the running motion. The transfer of energy may be enhanced by the increased ability to secure the foot to the footpad.

The upper strap 110 may include a stiffener or stiffened section 111 that resists or prevents longitudinal buckling of the upper strap 110 as the lace 104 is tensioned. The stiffener 111 may be made of a relatively stiff material, such as ultra-high molecular weight polyethylene (UHMW); non-woven polyester reinforcement (e.g., ToughStay); one or more layers of polyurethane coated synthetics; SuperFabric®; thermoplastic or thermoset sheet materials or resins; woven or non-woven sheet materials; multi-layered thermoplastic resins bonded to woven or non-woven materials such as the counter, toe puff, strobe, insole board; and the like. The upper strap 110 is made of a relatively flexible or soft material, such as a single layer of synthetic material; single layer of textile (animal, plant, mineral, or synthetic); multi-layered textiles bonded, stitched, or molded to (or by way of) thermoplastics, such a thermoplastic elastomers (TPE); multi-layered textiles bonded, stitched or molded to thermosets, such a silicone; and the like. The proximal end of the upper strap 110 and/or the lower strap 112 may likewise include a stiffener 113 that resists or prevents buckling of the respective strap. The upper strap's material may distribute the tensioning forces over the top of the foot, which may provide increased user comfort by reducing pressure points that may otherwise be created.

The upper strap 110 may include a transition material 114 adjacent the tongue opening. The transition material may be constructed of a material that is softer than the upper strap 110 to provide a smooth transition from the upper strap 110 to the user's foot and thereby prevent pressure points that may be present at an edge of the upper strap 110. In some embodiments, the transition material 114 may gradually transition, taper, or vary in stiffness the farther the upper strap 110 extends from the upper strap 110. For example, the stiffness of the transition material 114 adjacent the upper strap 110 may be essentially the same as the upper strap 110 while the stiffness of the transition material 114 adjacent the user's foot is significantly less stiff. The stiffness may be varied, tapered, or transitioned by reducing the thickness of the material 114 and/or by using one or more material layers. In some embodiments, the transition material may be constructed of Microfiber, polyurethane coated synthetic material, various textiles bonded to TPE's, and the like.

Figure 2:
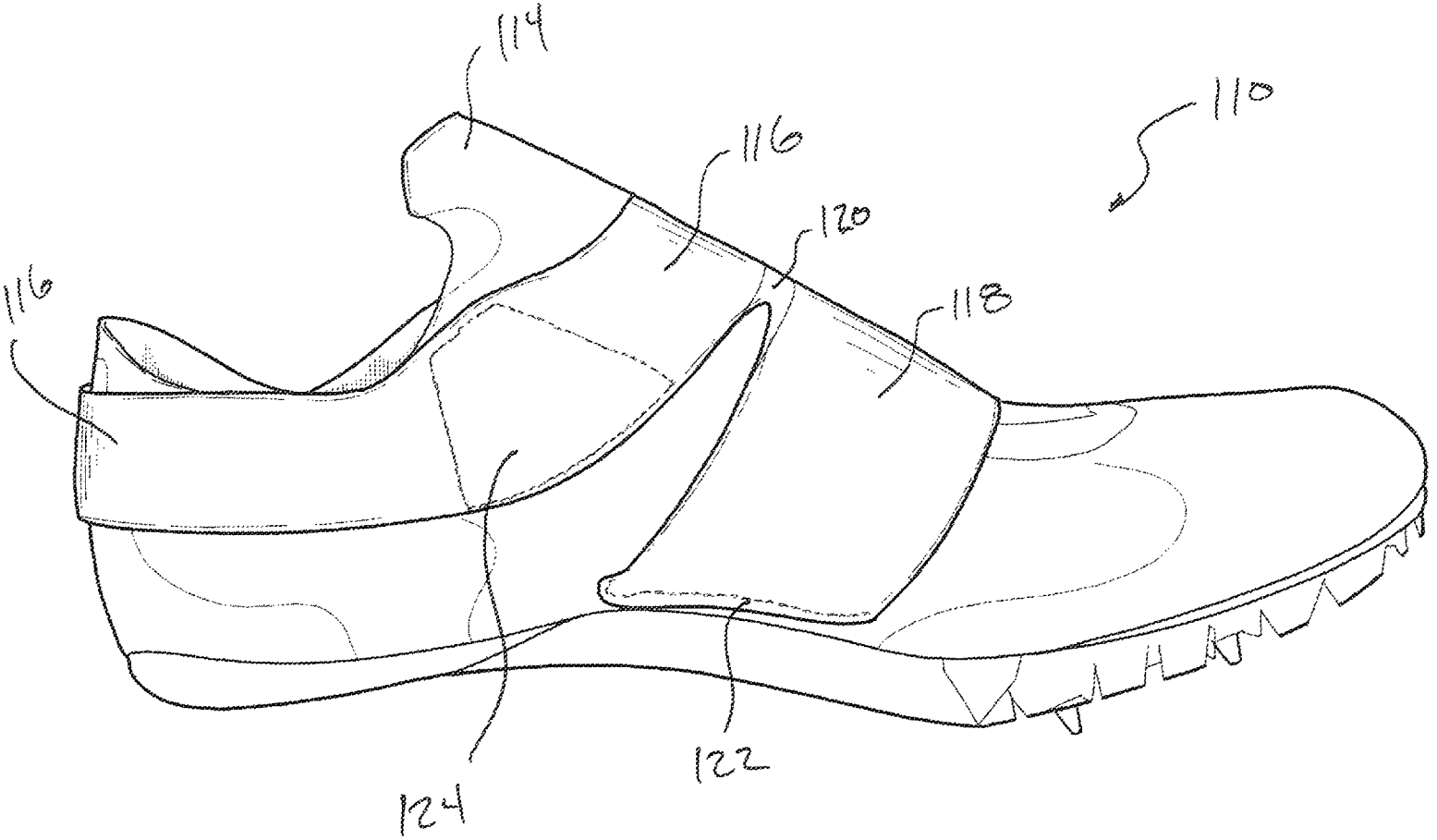
Figure 3A:
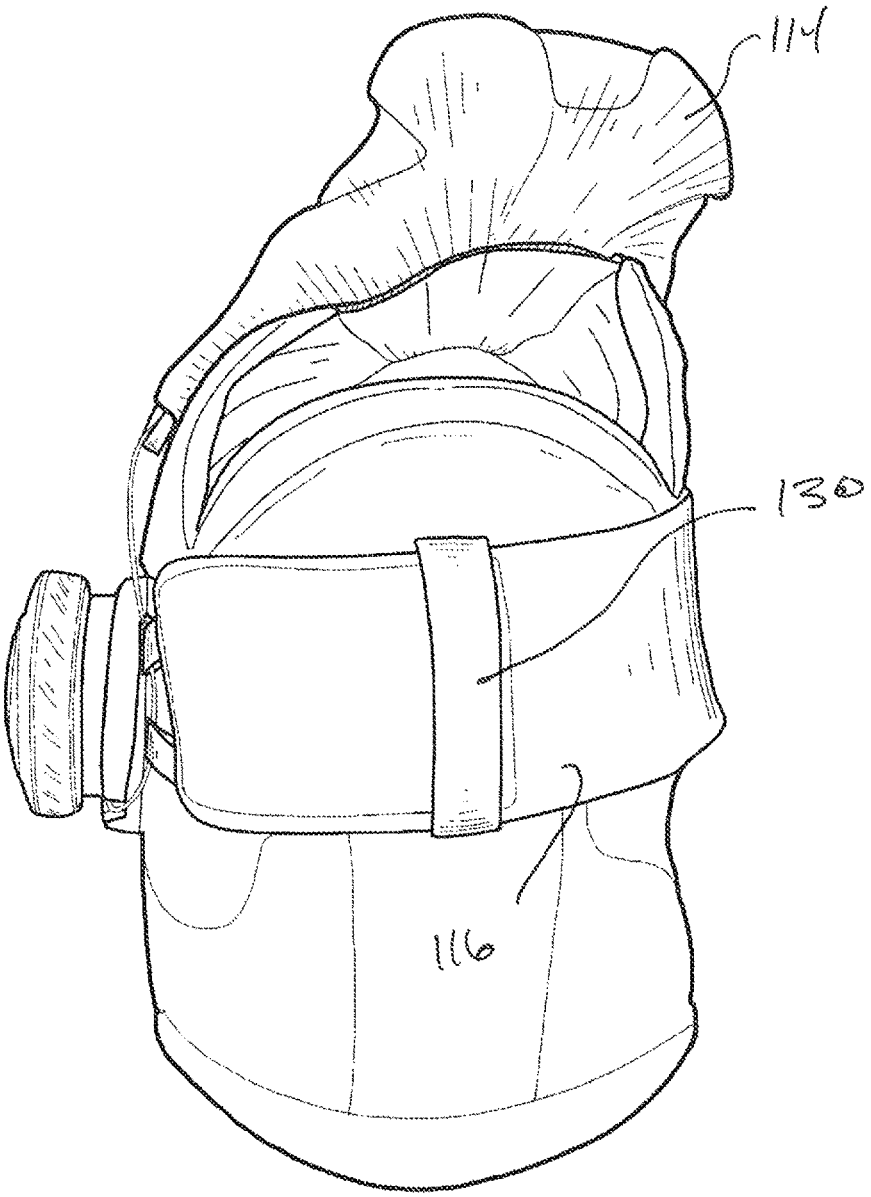
Figure 3B:
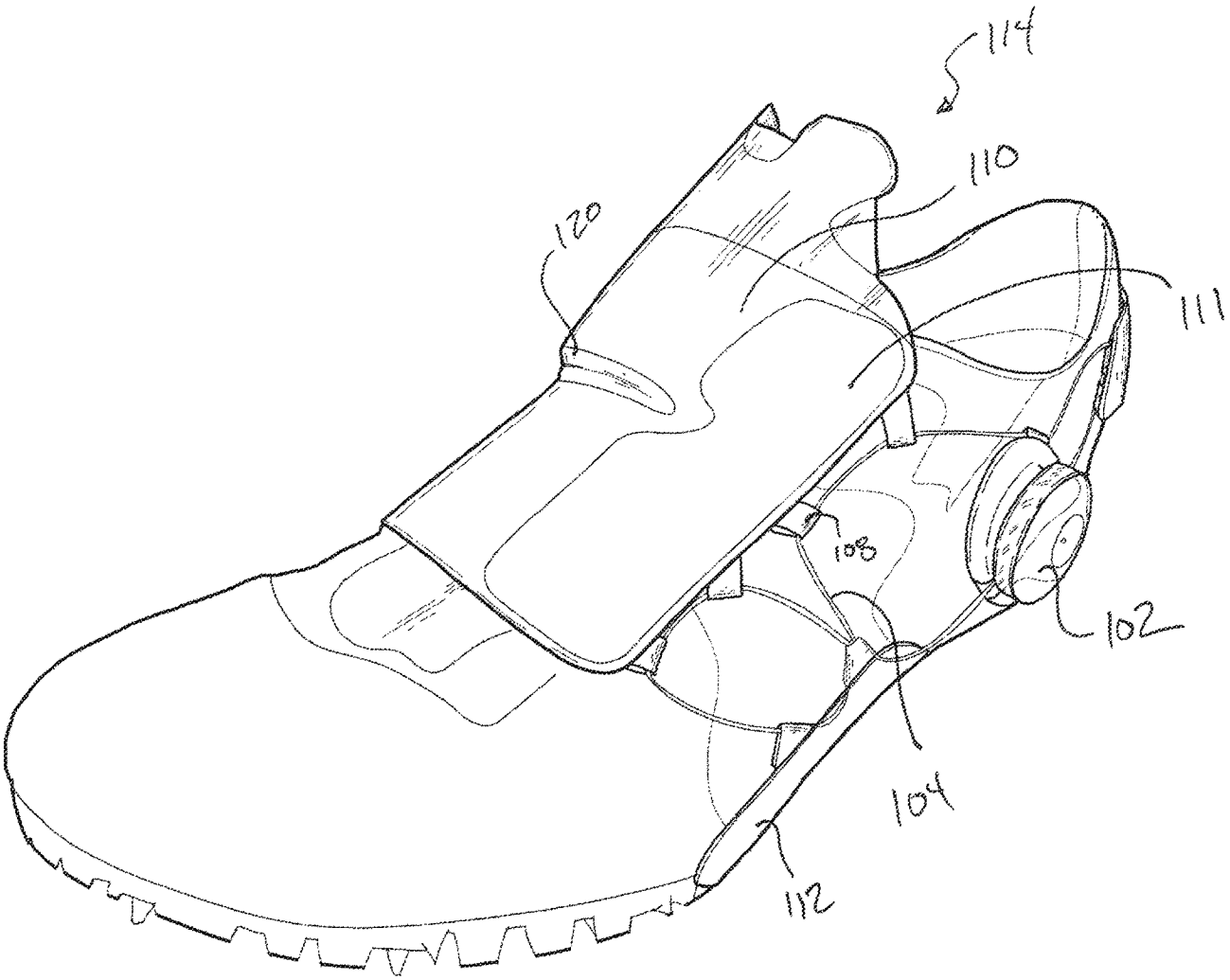

As shown in greater detail in FIGS. 2, 3A, and 3B, the upper strap 110 is configured to wrap around the top of the foot in a canopy like fashion, which aids in holding the foot to the shoe's footpad and further aids in distributing the tension force over the top of the foot. The strap 110 separates into two sections on the medial side of the shoe 100. A first section 118 wraps around the shoe 100 and terminates near the outsole and adjacent the arch. The first section 118 is coupled 122 near the outsole via stitching, adhesive bonding, heat welding, or via any other method known or used in the art. The first section 118 is generally uncoupled, unattached, or otherwise free from the upper other than where the first section 118 is coupled with the shoe or lace 104 (i.e., at coupling 122 and guides 108). FIG. 2 illustrates the coupling 122 as stitch lines. As the first section 118 is tensioned via tightening mechanism 102, the lower portion of the shoe—e.g., near the outsole and arch—is pulled or pressed against the user's foot via the lower coupling 122 of the first section 118 of strap 110. As such, contact between the medial side of the shoe 100 and the foot's arch is increased, which increases the comfort of the shoe and/or the foot's sensitivity within the shoe.

A second section 116 of the upper strap 110 wraps around the shoe's heel and terminates at the strap's proximal end and lace guides (i.e., 108*f* and 108*g*) as previously described. The second section 116 is coupled 124 with the shoe near the shoe's eyestay near the foot's ankle via stitching, adhesive bonding, heat welding, or via any other method known or used in the art. The second section 116 is unattached, uncoupled, or otherwise free from the shoe between the coupling 124 and the lace guides 108. FIG. 2 illustrates the coupling 124 as stitch lines. As the second section 116 is tensioned via tightening mechanism 102, the upper portion of the shoe—e.g., near the eyestay and/or tongue—is pulled or pressed against the upper portion of the user's foot via the upper coupling 124 of the section 116. As such, contact between the medial side of the shoe 100 and the uppers surface of the foot is increased.

The upper and lower couplings, 124 and 122, provide a high and low tightening configuration, which increases the overall contact between the medial side of the shoe and the user's foot. Stated differently, the upper and lower coupling, 124 and 122, pull the shoe closed about the upper portion of the foot near the shoe's eyestay and simultaneously pull the shoe closed about the lower portion of the foot near the shoe's sole. This configuration results in a more sock-like feel that provides additional comfort and/or performance. For example, the upper and lower tensioning configuration may secure or hold the foot to the foot pad, which allows increased power to be transferred from the foot to the shoe. The effects of the upper and lower tensioning configuration may be enhanced via the canopy configuration of the upper strap 110. The overall result may be a feeling of the foot being "sucked" to the foot pad.

The upper strap 110 may include a transition material 120 positioned between the first and second sections, 118 and 116. The transition material 120 may be constructed of a softer and/or more flexible material than the first and second section, 118 and 116, which may allow said sections to shift or move to some degree (e.g., laterally and/or longitudinally) relative to one another. The shifting or moving of the first and second sections, 118 and 116, may allow the upper strap 110 to conform more closely to the user's foot as the upper strap 110 and first and second sections, 118 and 116, are tensioned via the tightening mechanism 102 and lace 104. The transition material 120 may also reduce or eliminate buckling of the upper strap 110 and/or first and second sections, 118 and 116, by increasing the ability of said section to move or shift relative to one another. The transition material 120 may extend near a lateral edge of the upper strap 110 on the lateral side of the shoe 100 and may allow the first and second sections, 118 and 116, to move both longitudinally and laterally relative to one another. The transition material may further reduce or eliminate any pressure points that may otherwise be created due to the edge of the first and second sections, 118 and 116. In some embodiments, the transition material may be constructed of an elastic material, a mesh material, polyurethane coated synthetic material, various textiles bonded to TPE's, and the like.

In some embodiments, to prevent bucking of the shoe's tongue (not shown) an elastic band (not shown) may be positioned across the tongue's gap to initially pull the tongue closed. The elastic band may prevent the tongue from catching to the upper strap 110 or the user's foot and buckling or bending as the upper strap 110 is tensioned. In some embodiments, the upper strap 110 does not include an upper and lower tensioning configuration. Rather, the first and second sections, 118 and 116, may both be coupled near the outsole or near the eyestay as desired to provide a desired fit and feel. Further, even though the upper strap 110 is shown extending from the medial side toward the lateral side of the shoe, in some embodiments this configuration may be reversed so that the upper strap 110 extends from the lateral side of the shoe toward the medial side.

As shown in FIG. 2, the second section 116 proximal to the coupling 124 wraps around the collar or heel of the shoe. The proximal end of the upper strap 110, and more appropriately the second section 116, then couples with the lace 104 via the two guides, **108*f* and 108*g*, positioned at the proximal end of the strap. As the lace 104 is tensioned, the portion of the second section 116 that wraps around the shoe is tightened, which presses the shoe's collar and/or heel inward and against the user's foot. As such, the collar and/or heel hold of the shoe 100 is increased. This configuration provides longitudinal stabilization of the foot by reducing or preventing longitudinal sliding of the foot within the shoe 100. Longitudinal stabilization of the foot aids in loading of the relatively stiff outsole or plate because energy or power is not lost due to sliding of the foot. The increased closure of the collar and/or heel may also enhance the fit, feel, and/or comfort of the shoe 100. In some embodiments, the portion of the second section 116 that wraps around the shoe's heel may be held in position via one or more straps 130** or other component.

As shown in FIG. 1, the tightening mechanism 104 is positioned on the lateral side of the shoe 100 so as to be adjacent the ankle joint and under the fibula. This position of the tightening mechanism reduces pressure and/or discomfort that may occur due to tightening of the shoe and downward pressure exerted on the foot by the tightening mechanism 102. In this position, the tightening mechanism 102 is pulled longitudinally about, or otherwise along or aligned with, the shoe, and is thus not pulled downward relative to and against the shoe. This reduces any discomfort that may be present from wearing and tightening the shoe. This position also places the tightening mechanism in a convenient location for tightening. In some embodiments, the lace path 106 may be positioned on the medial side of the shoe, while the tightening mechanism 102 is positioned on the lateral side of the shoe.

Referring now to FIGS. 4A-5B, illustrated is an alternative embodiment of a shoe 200 having enhanced performance and/or comfort. Similar to the previous embodiment, shoe 200 includes a tightening mechanism 202 that tensions lace 204 to close and tighten the shoe 200 about the user's foot. The lace traverses a lace path 206 on the lateral side of the shoe and is coupled with an upper strap 210 and lower strap 212. The upper and/or lower straps, 210 and 212, may include stiffened sections, 211 and 213, as previously described. The upper strap 210 is positioned so as to extend over the top of the shoe in a canopy like fashion as previously described.

Figure 4A:
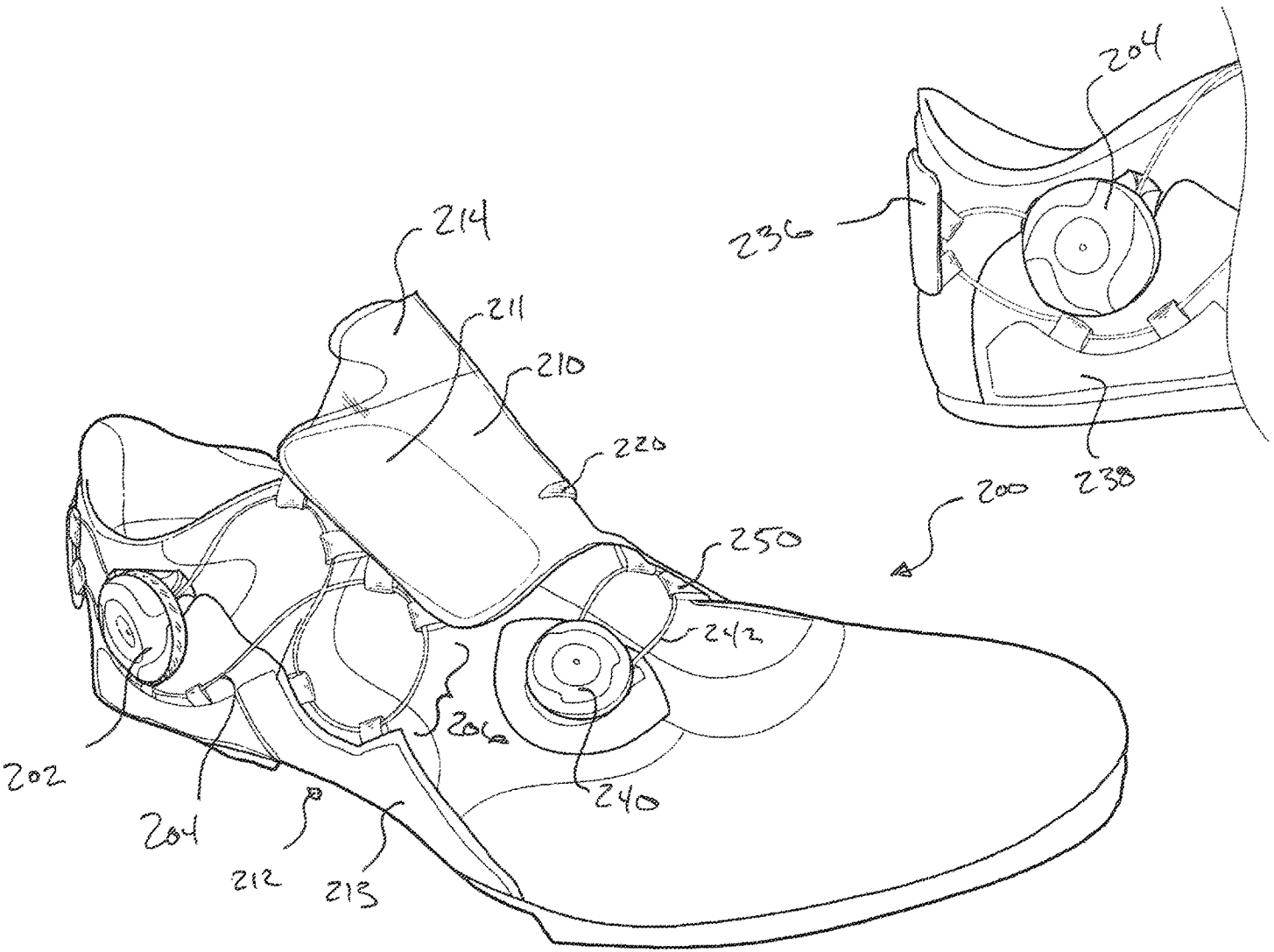
FIGS. 4A-5B illustrate another embodiment of a shoe that is configured to enhance the fit and/or performance of the shoe.
Figure 4B:
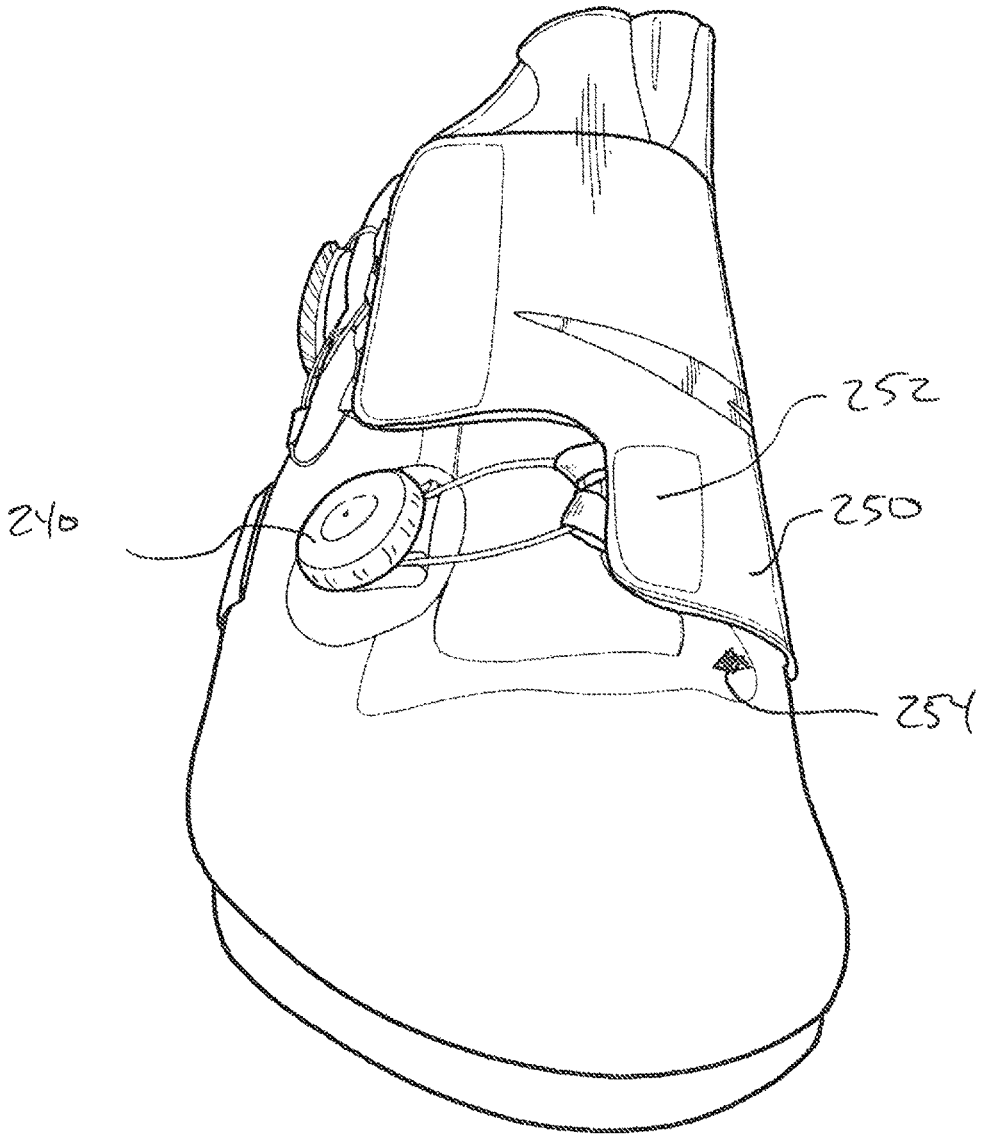

A difference between the two embodiments is that, as shown in FIGS. 4A and 4B, the lace 204 traverses underneath the tightening mechanism 202 and through two lace guides that are positioned on a second lower strap 238 or coupled with the shoe near the outsole. The position of the lace 204 about lower strap 238 may function to pull a distal end 236 of the upper strap 210 at an angle downward, which may increase the pull of the shoe's heel against the user's foot thereby increasing the ankle or heel hold capabilities of the shoe 200.

Figure 5A:
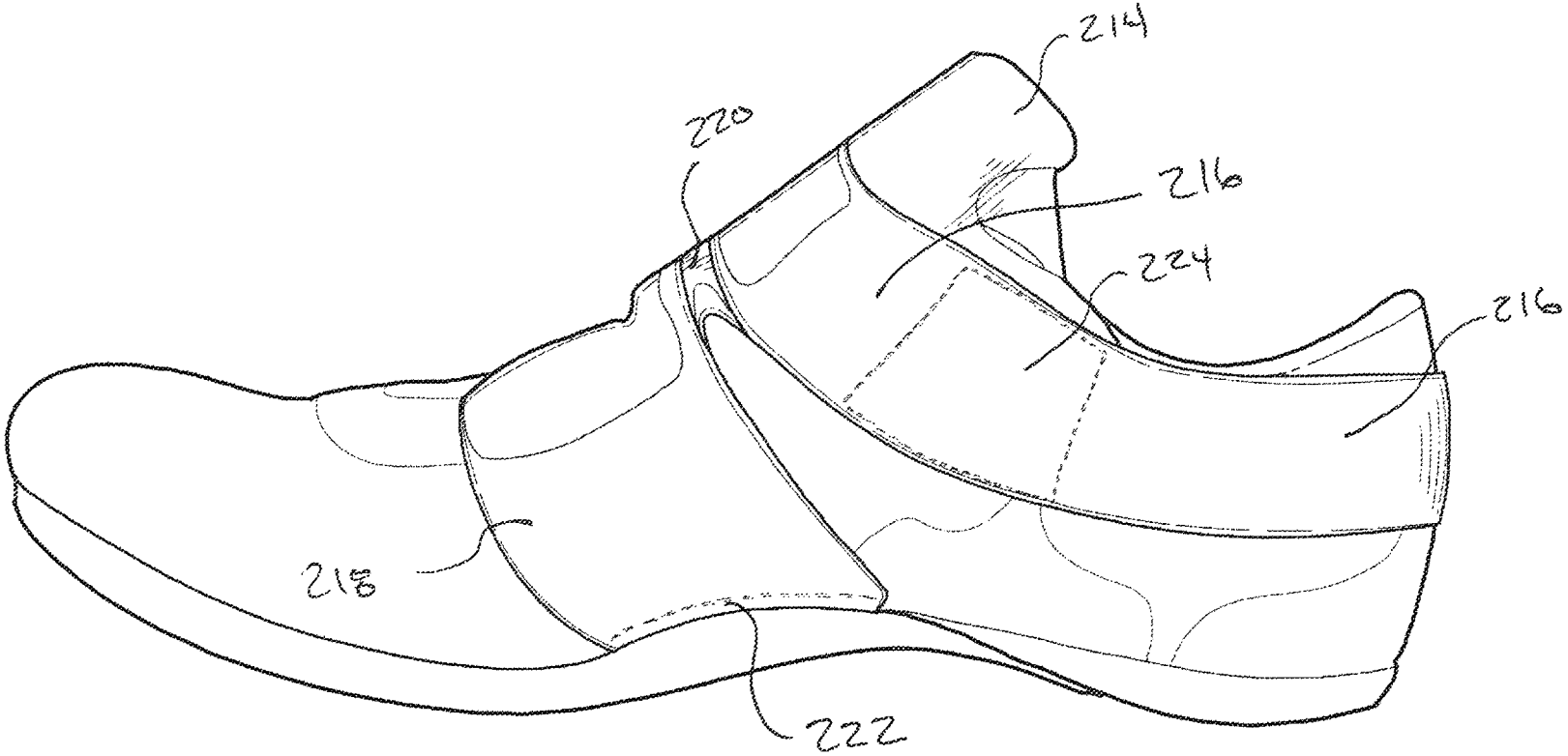
Figure 5B:
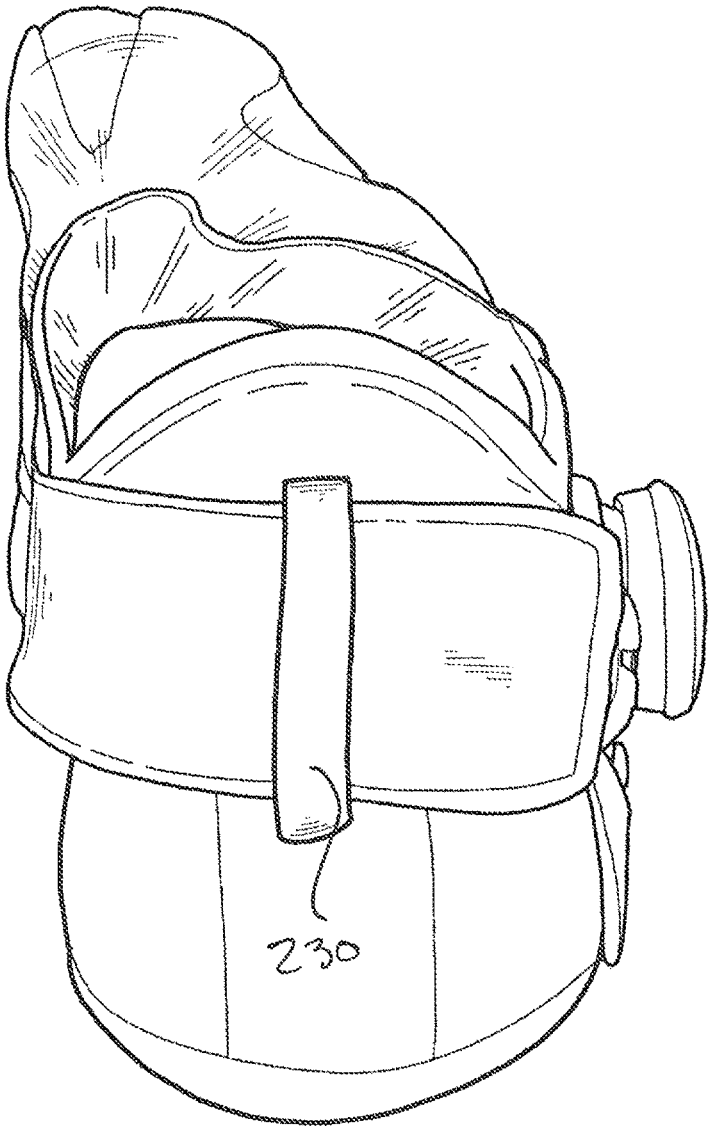

As shown in FIGS. 5A and 5B, the upper strap 220 includes a first section 218 that is coupled 222 near the shoe's outsole and includes a second section 216 that is coupled 224 near the shoe's eyestay. The couplings, 222 and 224, provide a high and low tensioning configuration as previously described, although the coupling, 222 and 224, may be modified to both include high or low couplings or to switch the high and low couplings as desired. A transition material 220 is positioned between the first and second sections, 218 and 216, as previously described. An additional transition material 214 may likewise extend from the tongue portion of the upper strap 210 as desired. The second portion 216 may be secured in place about the shoe's heel via one or more straps 230 or other components.

Shoe 200 includes a second tightening mechanism 240, which may be a reel based system, pull cord system, conventional lace, and the like. Second tightening mechanism 240 tension lace 242 that is coupled with a distal end 254 of the upper strap 210. The distal end 254 of the upper strap 210 is recessed to accommodate the tightening mechanism 240 and provide sufficient space for stroke or movement of lace 242. The distal end 254 of upper strap 210 and second tightening mechanism 240 are positioned about shoe 200 to be rearward of the joint between the metatarsals and phalanges. More preferably, the distal end 254 of upper strap 210 are positioned about shoe 200 so as to be mid-way along the metatarsal or rearward thereof, such as adjacent the base of the metatarsals.

The use of the second tightening mechanism 240 allows the front portion of the shoe 200 to be tightened independently of the rear portion of the shoe 200. This configuration provides a more customizable fit and feel of the shoe 200 about the user's foot, which allows a runner to customize the fit as desired. For example, some runners may prefer a tight toe box while other runners prefer this area to be more loose. The runner may customize the fit to increase performance and/or comfort as desired.

It should be realized that various aspects of the shoe may be altered, modified, or otherwise changed without departing from the spirit of the embodiments described herein. For example, although the upper straps are generally described as being a single strap and having first and second strap sections, in some embodiments the upper strap may include two or more separate and relatively independent straps. The independent straps may move and/or tension independent of one another or may be connected via one or more transition materials. Likewise, although the straps are shown and described as being positioned on the exterior surface of the shoe, in some embodiments the straps, or one or more sections thereof, may be positioned within the shoe or between layers of the shoe. This may provide a more clean and aesthetically pleasing shoe appearance. The lace may likewise be positioned within the shoe or between layers of the shoe, such as by routing the lace through tubing. Various other modifications and/or alterations are likewise possible.

In some embodiments, the footwear may include materials or layers having relief or kerf cuts (hereinafter relief cuts)

of various shapes that allow one or more portions of the footwear to flex and conform to the user's foot. For example, the relief cuts can be placed in or around force vectors on a given material which is tensioned from the tightening mechanism (e.g., reel based closure system). These cuts can be used for various reasons such as: programmed material conformability, improved fit, and even tension activated ventilation systems. In some instances a combination of material attributes are needed in the footwear, such as stiffened areas in combination with flexible, stretchy, or otherwise forgiving areas. The relief cuts allow a single material or lamination of materials to become more forgiving, stretchable, and/or flexible in designated or desired areas of the footwear. The forgiving, stretchable, and/or flexible attribute is driven from the tension of the tightening mechanism or system, and particularly a reel based closure system, without the use of additional patterned materials. If desired, the relief cuts also allow for ventilation to occur once tension is applied to the material, transforming a solid material into a breathable material.

Figure 6A:
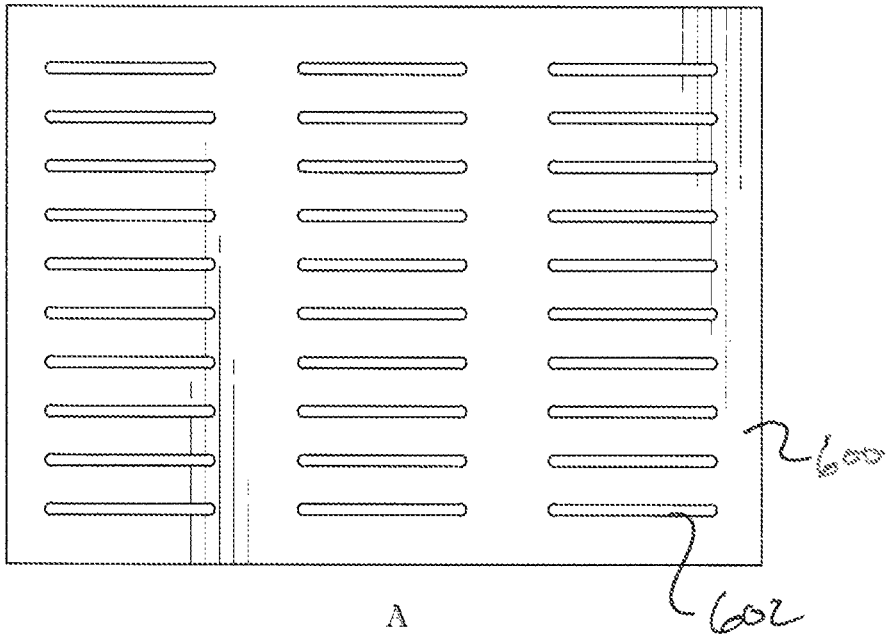
FIGS. 6A-C illustrate relief cuts that allow a material of a shoe to stretch or flex when tension is placed on opposing ends of the material.
Figure 6A:
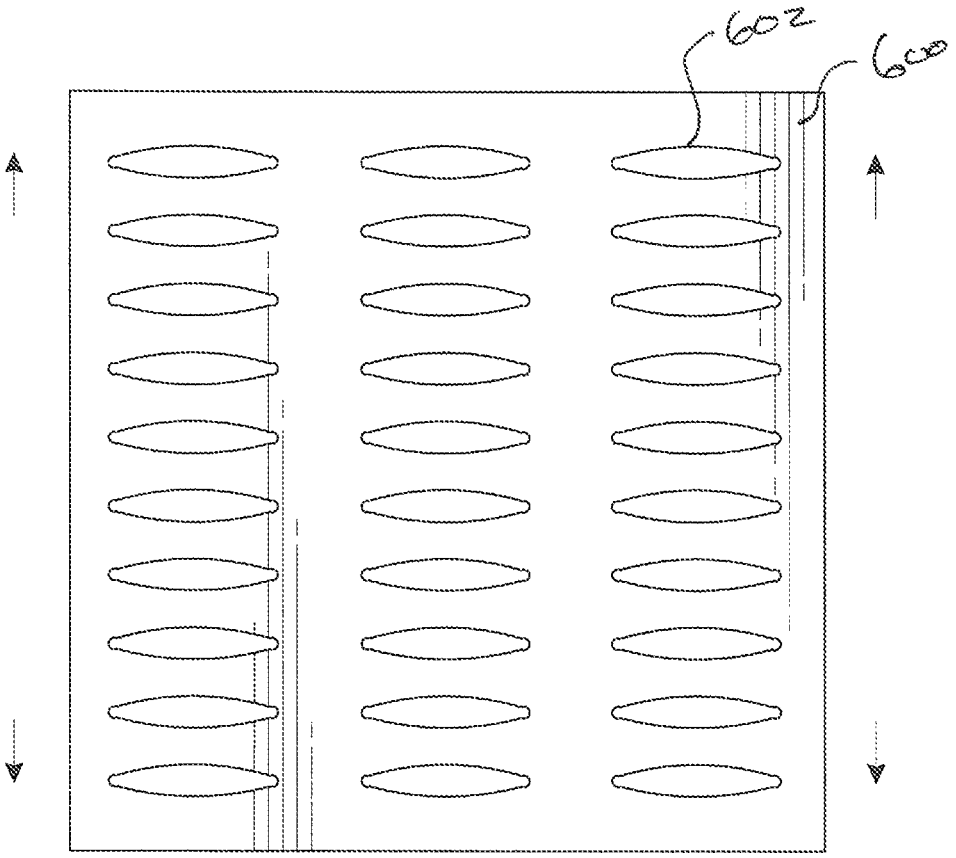
Figure 6B:
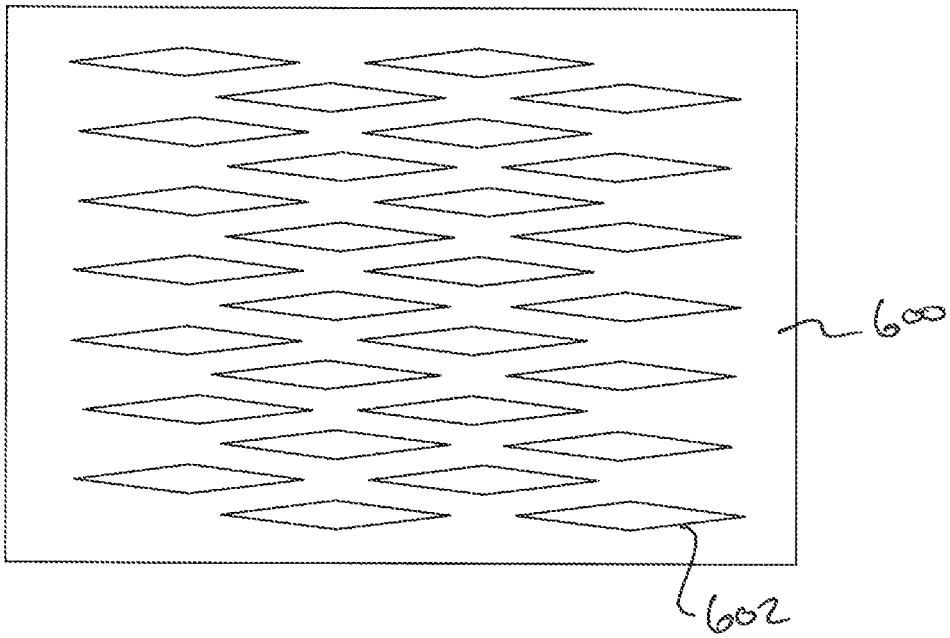
Figure 6B:
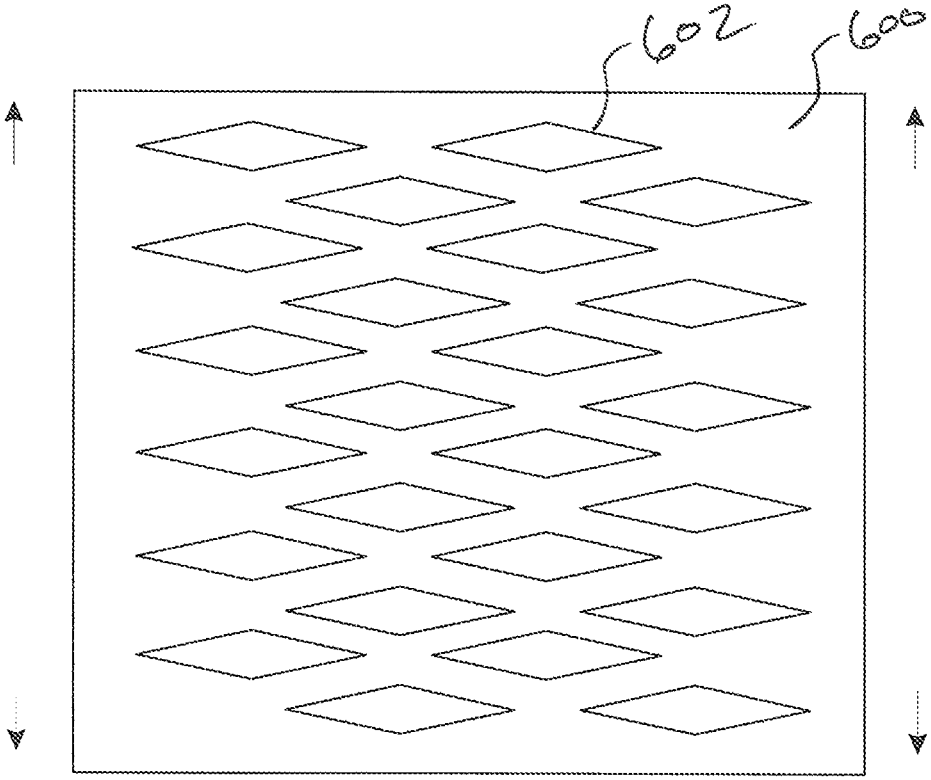
Figure 6C:
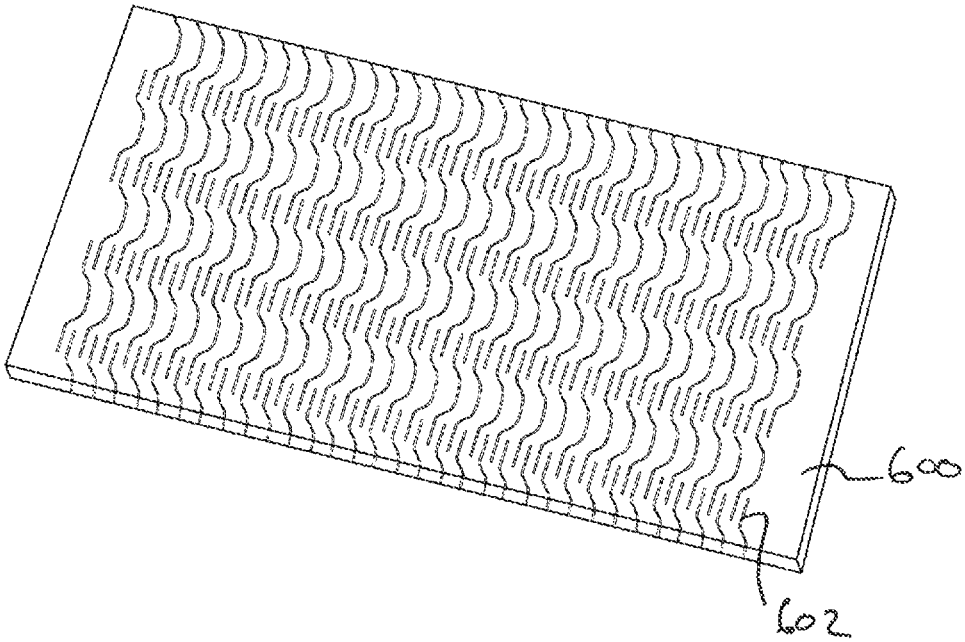
Figure 6C:
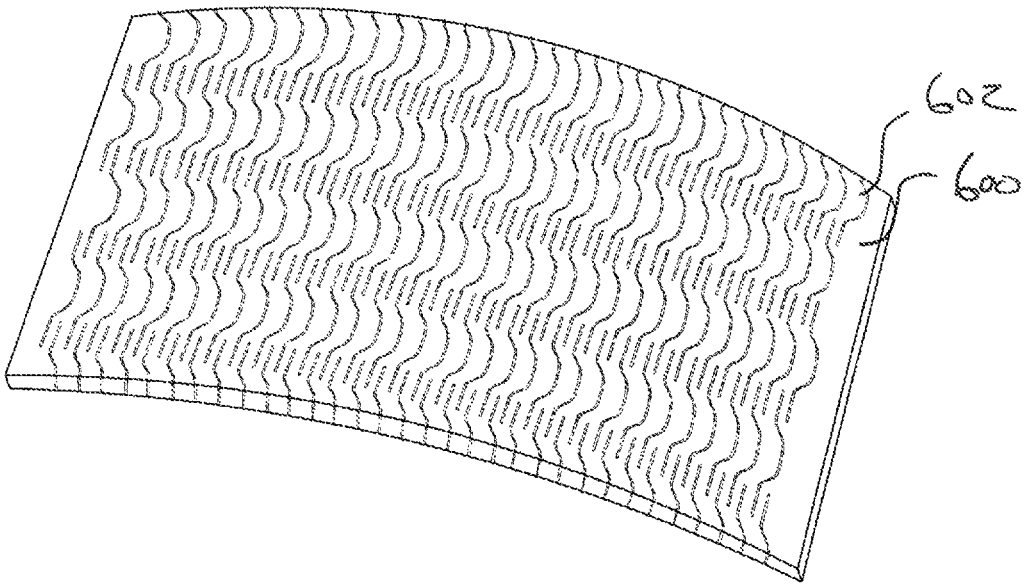

Referring now to FIGS. 6A-C, illustrated are relief cuts 602 positioned on a material 600 or layer. The relief cuts 602 allow the material 600 to stretch or flex when tension is placed on opposing ends of the material 600 as shown. When tensioned, the relief cuts 602 may slightly change shape due to flexing or stretching of the material 600. FIGS. 6A-C illustrate that the relief cuts 602 may include various shapes and/or sizes, such as a diamond shape, an elongated slot shape, a series of rows and columns of cuts, and the like.

Figure 7A:
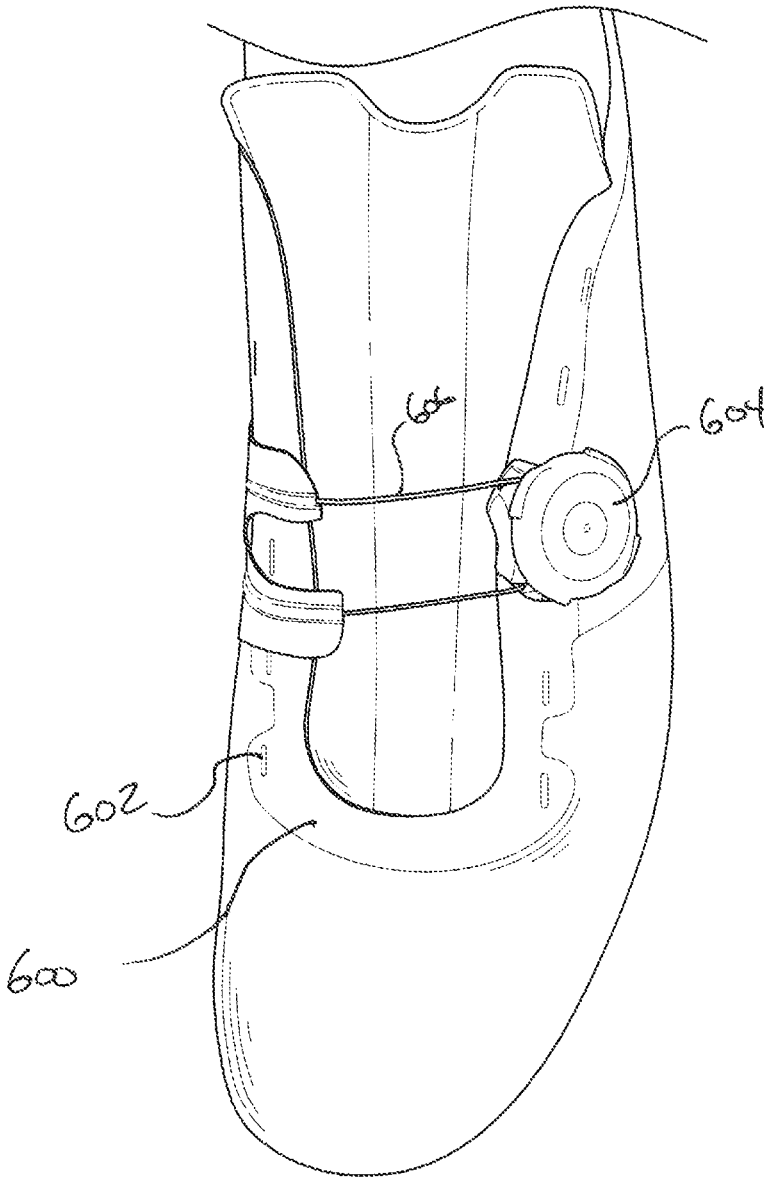
FIGS. 7A & 7B illustrate a shoe that includes a material or component having relief cuts similar to those illustrated in FIGS. 6A-C.
Figure 7B:
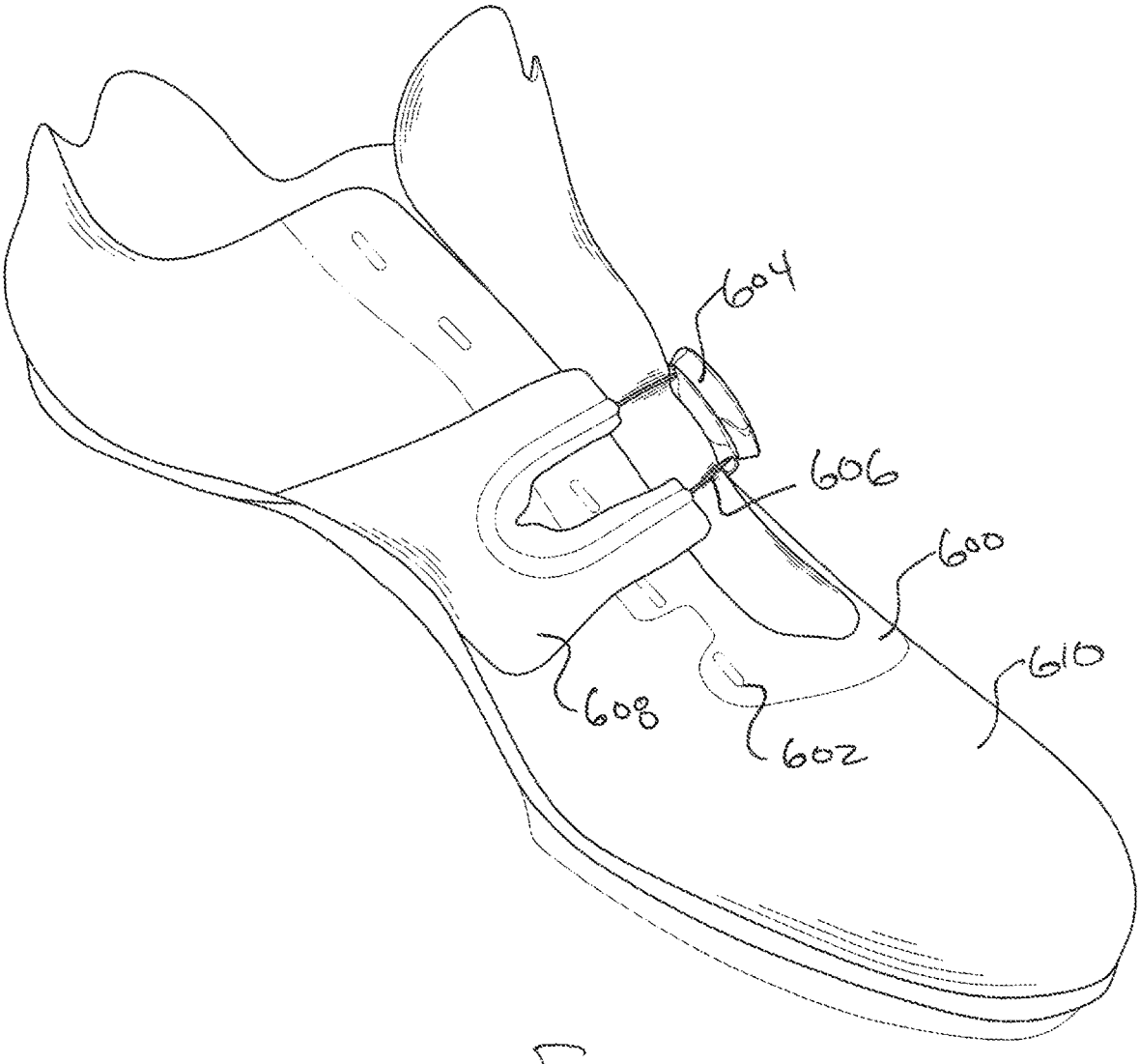

Referring now to FIGS. 7A and 7B, illustrated is a shoe 610 that includes a material 600 having relief cuts 602 similar to those illustrated in FIGS. 6A-C. The material 600 of the shoe 610 is positioned along or near the shoe's tongue. The material 600 may be positioned on one or both sides of the shoe's tongue as illustrated. The shoe 610 also includes a reel based closure system 604 that includes a rotatable knob and other internal components (e.g., a spool, pawl teeth, housing teeth, etc.) that interact to enable tensioning of a lace 606. For example, the lace 606 may be wound around a spool in response to rotation of the knob in a tightening direction. The lace 606 is operable with a guide 608 that is positioned on an opposite side of the shoe 610. The guide 608 may be formed in a material sleeve as illustrated in FIGS. 7A and 7B, or may be formed of a more rigid materials or components, such as a plastic or metal material. In other embodiments, the guide 608 may be formed from or within the material 600 that is positioned on or adjacent the shoe's tongue.

Tensioning of the lace 606 via the reel based closure system 604 causes opposing sides of the shoe's tongue to move toward one another, which causes the shoe to close and tighten about the user's foot. The relief cuts 602 of the material 600 are positioned so that the tensioning of the material 600 via the lace 606 and reel based closure system 604 is roughly normal, perpendicular, or orthogonal relative to the relief cuts 602. The positioning of the relief cuts 602 in this manner allows the relief cuts to stretch and/or deform as described above, which allows the material 600 to flex, bend, or stretch. In this manner, the opposing sides of the shoe 610 adjacent the tongue may flex, bend, or stretch to a greater degree than conventional shoes around the top of the user's foot in response to tightening of the shoe 610.

The material 600 and relief cuts 602 may be positioned elsewhere on the shoe 610 as desired to allow various portions of the shoe 610 to flex, bend, or stretch as desired. In most embodiments, however, the relief cuts 602 are positioned so as to be roughly normal, perpendicular, or orthogonal to a direction of tensioning of the shoe 610. Positioning the relief cuts roughly normal, perpendicular, or orthogonal to a direction of tensioning of the shoe means that a vector of tensioning force is roughly normal, perpendicular, or orthogonal to a longitudinal axis of the relief cuts. In some embodiments, roughly normal or orthogonal means that the relief cuts are positioned so as to be within an angle of 45 degrees of normal, and more commonly within 10, 15, or 25 degrees of normal.

FIGS. 8A-E illustrate another embodiment of a shoe 620 that includes a material 600 having relief cuts 602. The shoe 620 includes a reel based closure system 604 and lace 606 that function to close and tighten the shoe 620 as previously described. In FIGS. 8A-E, the guides 608 that route the lace 606 along a path of the shoe's tongue are made of a fabric material that is folded back on itself to form loops within which the lace 606 is positioned. The material 600 is positioned between the shoe's tongue or throat and the toe box. The material 600 may also be positioned along the shoe's tongue as illustrated or elsewhere as desired. The other portions, 622 and 624, of the shoe 620 are made of a more rigid material or are reinforced with a stiffer material. In such embodiments, the portions 622 and/or 624 may flex, stretch, or bend to a much lesser degree than the material 600.

Figure 8A:
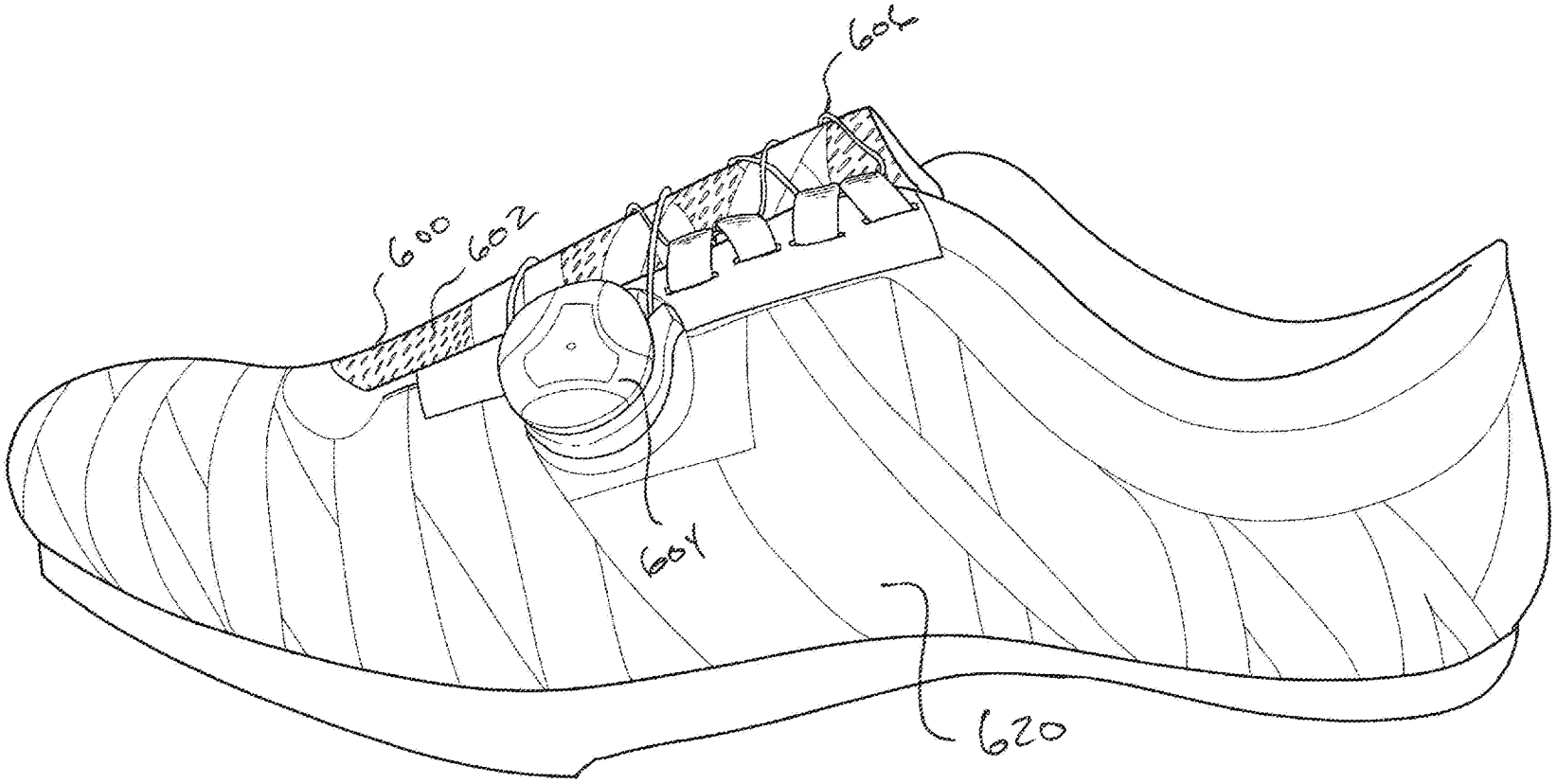
FIGS. 8A-E illustrate another embodiment of a shoe that includes a material having relief cuts similar to those illustrated in FIGS. 6A-C.
Figure 8B:
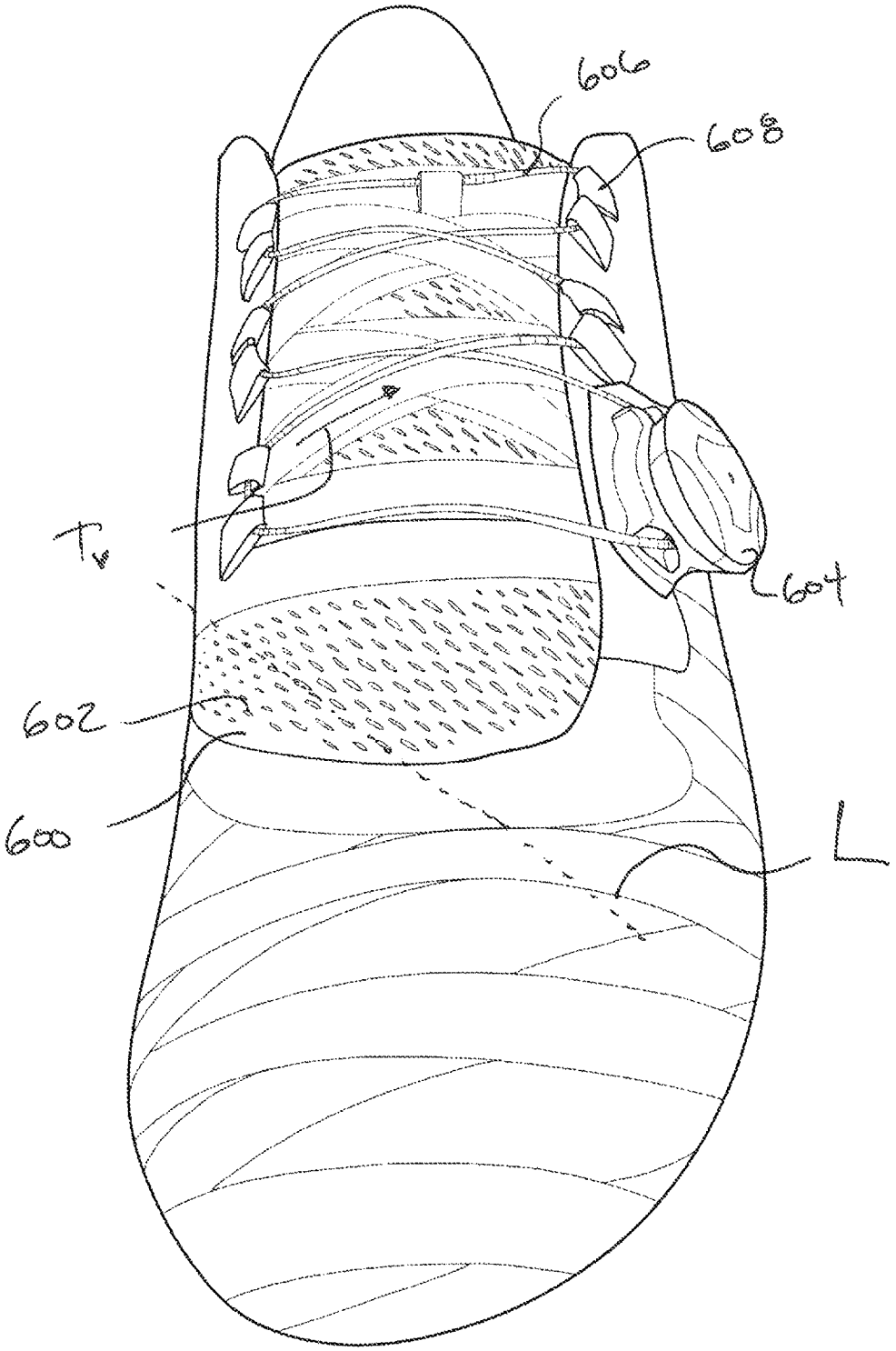
Figure 8C:
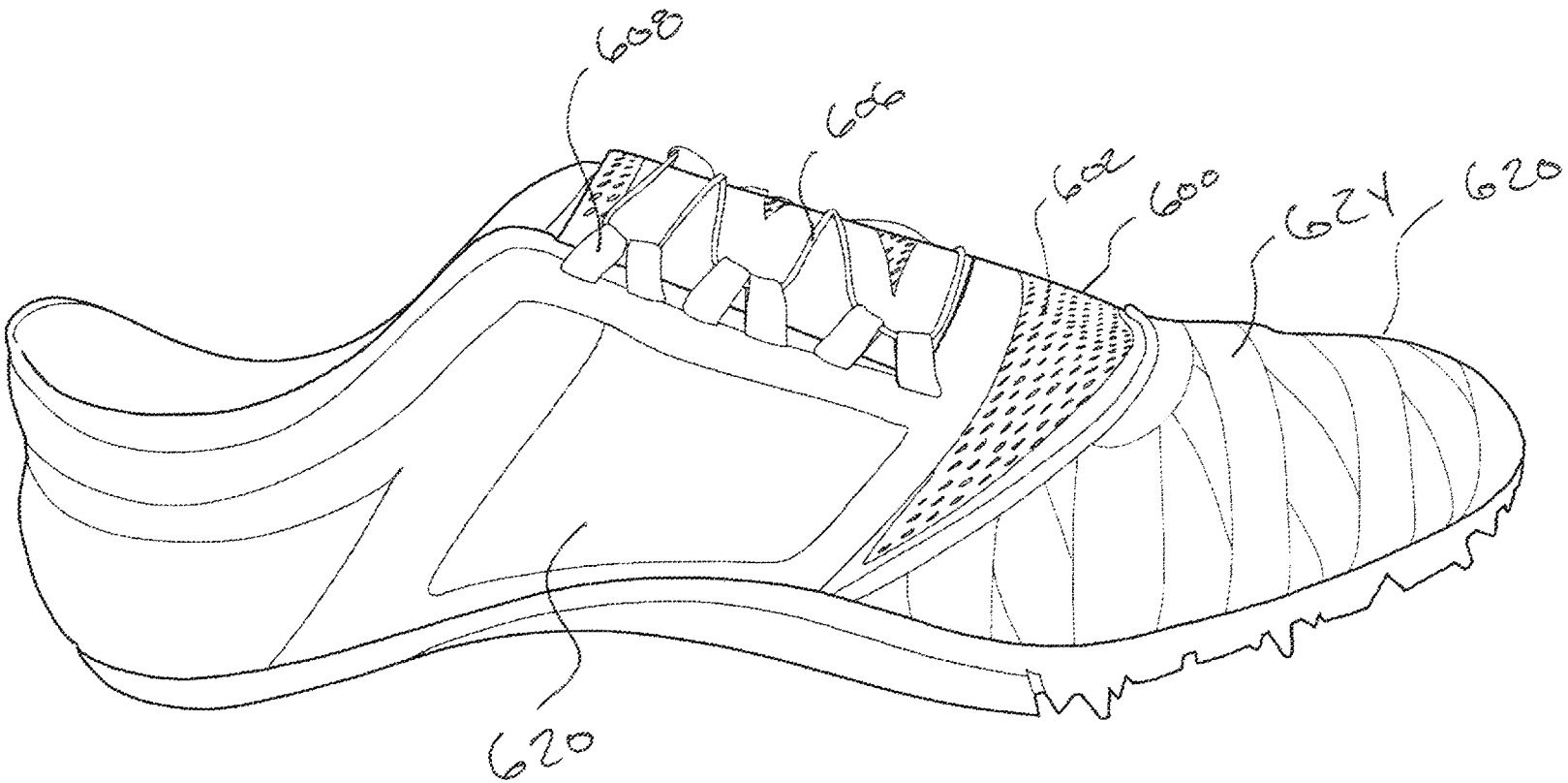
Figure 8D:
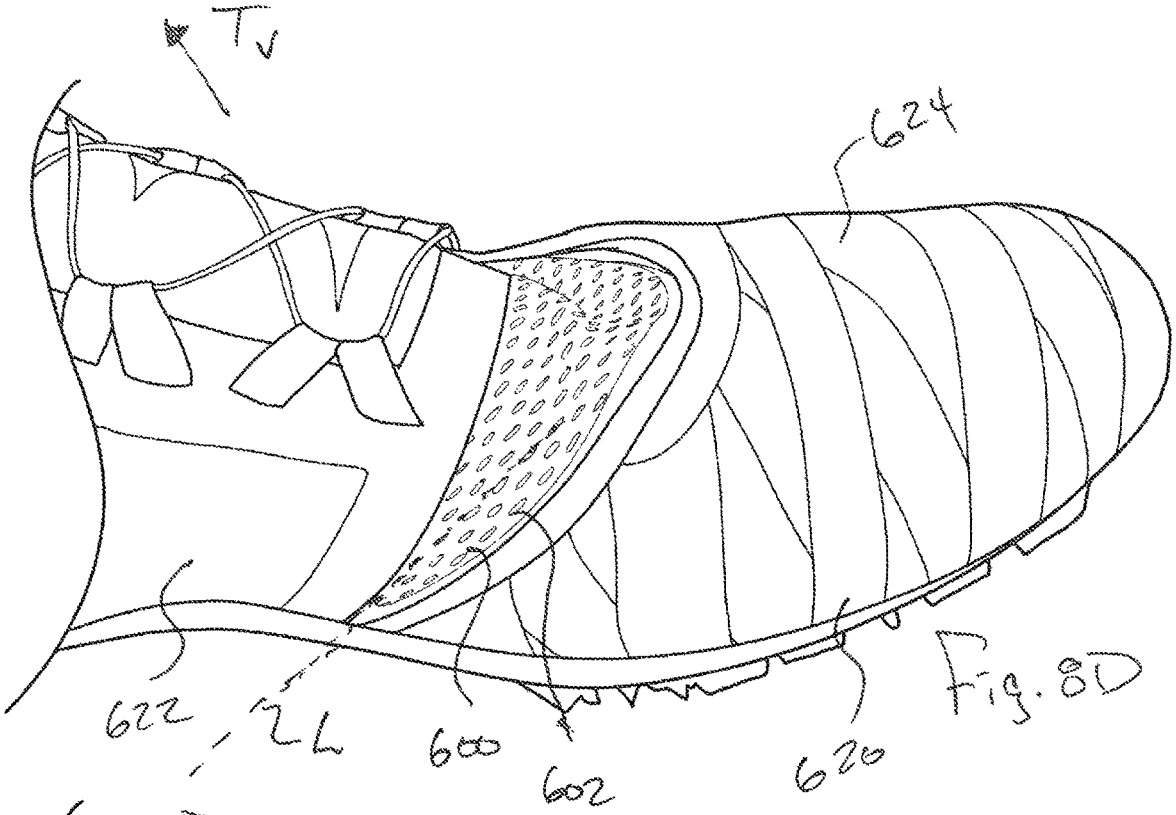
Figure 8E:
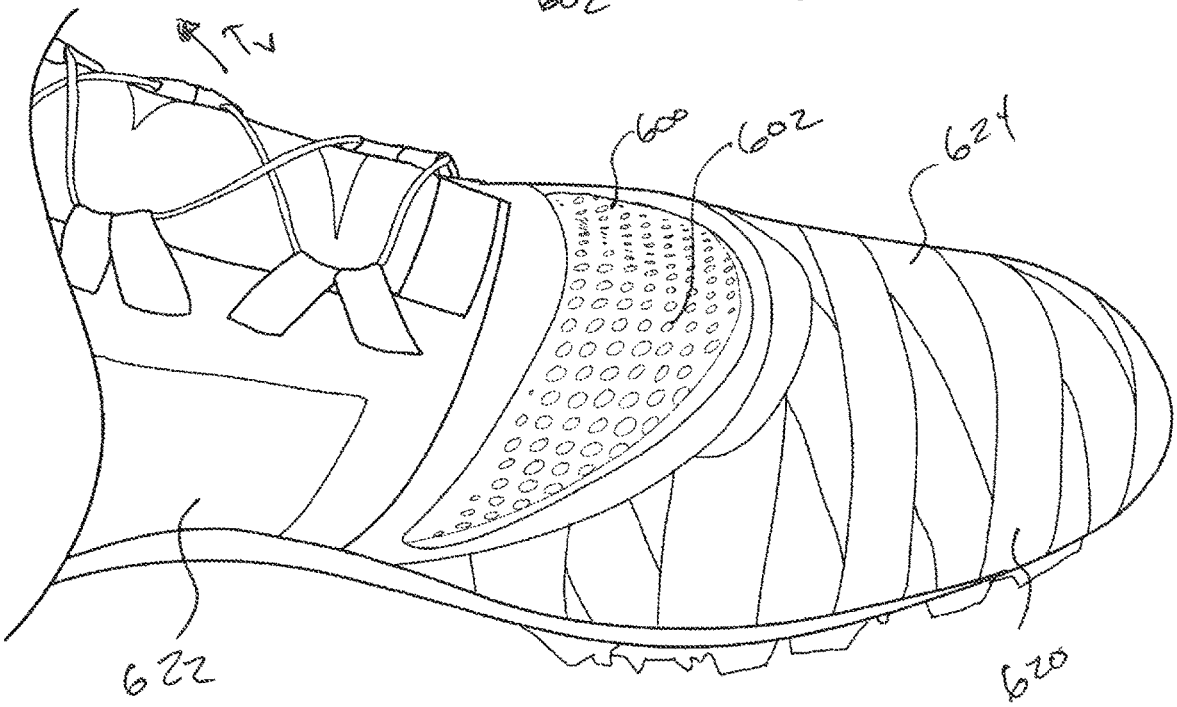

As illustrated, the material 600 is positioned so that the relief cuts 602 are positioned roughly normal, perpendicular, or orthogonal to a tension force that is provided by the lace 606. Specifically, a force or tension vector $T_v$ is imparted on the shoe 620 via the lace 606. A longitudinal axis L of the relief cuts 602 is positioned so as to be roughly perpendicular to the force vector $T_v$. Accordingly, as shown in FIGS. 8D and 8E, tensioning of the lace 606 causes the relief cuts 602 to expand or flex, which allows the portion 622 of the shoe 620 to move in relation to the portion 624 positioned near the toe box. In other instances, the relief cuts 602 may expand or flex as a result of bending of the shoe 620, such as when a user walks or runs.

Positioning the material 600 and relief cuts 602 as illustrated in FIGS. 8A-E essentially allows the tongue or throat of the shoe 620 to move more independently of the toe box. As such, the tongue or throat portion of the shoe functions similar to a strap while maintaining an integral connection to the toe box.

The positioning of the material 600 and relief cuts 602 may serve various purposes including: 1) ensuring that the tension on the shoe 620 and/or wrap of the shoe 620 about the user's foot begins essentially behind the foot's 1$^{st}$ metatarsal head; 2) allow for the toes to splay; and/or 3) create an active ventilation system for foot to breath. Any or all of these advantages enhance the fit and/or comfort of wearing the shoe 620.

In some embodiments, the medial and/or lateral sides of a shoe may be configured to greatly flex and conform to the shape of a user's foot. For example, the medial and/or lateral sides of the shoe's upper may be specifically configured to flex, move, or bend relatively independently to allow the upper to conform to the unique shape of the user's foot to a greater degree. Conventional shoe uppers have historically consisted of patterns built by taping a last and then stripping the tape and creating flat pattern. The formed uppers often take on a specific shape—i.e., a thermoformed, steamed, or otherwise formed foot shape.

The resulting shoe may have an upper that is a perfect fit for some person having a foot shape that is equivalent to the last that is used, however, the shape is often not a perfect fit for most of the that will wear the shoe. Furthermore, the eyestays or eyestay edges are locked or structurally coupled with a row of fabric that essentially makes it impossible for the sides of the upper to alter shape. Stated differently, the shoe's upper shape is essentially locked or static so that when the upper or eyestay is pulled or tensioned by a lacing system, the shape of the upper will not change or conform to the foot. Currently, the only conforming to a different shaped foot is controlled by where materials are positioned within or adjacent the upper and/or by materials that are capable of stretching into different shapes to conform to different foot shapes. For example, in conventional shoes, the throat opening of the shoe is the main element for conforming since it essentially pivots open and allows for differing foot volumes and instep heights. The throat opening, however, does not account for conforming to different side profiles of feet.

To achieve a greater degree of conformance to the foot, especially in the sides of the foot, it may be preferable to build into the upper the ability for essentially vertical (or angled or arced) lanes, fingers, or projections that can adapt from the shape of the last to variations in individual foot shapes. For example, the upper may include a series of panels or fingers that can alter in radius and conform to unique foot shapes to a much greater degree than conventional shoes. The fingers or lanes may be freely movable relative to one another to achieve the greater degree of conformance. When the fingers or lanes are tensioned by a lacing system, the fingers or lanes may adapt to the underlying foot shape and make contact in most places and thereby allow more of the foot to become involved in supporting the body. When the fingers or lanes are tensioned, the eyestay edge will flex and conform and change shape, or stated differently, will not have a pre-tensioned shape. For example, the eyestay edge may have a relatively straight line pre-tensioned shape and may substantially deviate or change shape from the straight line subsequent to tensioning.

A shoe having such fingers or lanes may include the following: lanes, members, projections, or fingers of essentially vertical structural elements. The lanes or members may be overlays of a higher modulus material than the surrounding material or may be reinforced as composites of membrane, textiles, and/or include oriented high strength fibers like Spectra, Kevlar, Carbon, and the like. These formed lanes or members may be on the inside or the outside of the softer surrounding membrane or stretchable vamp, or both inside and outside as desired. The lanes or members of higher strength material may be bonded, stitched, or otherwise attached to a vamp shape of a lower modulus material. In the extreme case this could be a polymeric membrane or four-way stretch fabric. It can also be various knitted patterns or meshes that allow stretching inward and outward from the foot as well as along the foot contour, in essence racking or skewing between the reinforced lanes. FIGS. 9A-20C illustrate various embodiments wherein a greater degree of conformance of the shoe as described above may be achieved.

Referring to FIGS. 9A-D, illustrated is an embodiment of a shoe 900 that includes a sole 902 and an upper that is attached to the sole 902 and that is configured to fit around the foot of a user. The upper 904 has a medial side 906 and a lateral side 908 that fit around the medial and lateral sides of a foot, respectively. The medial and lateral sides, 906 and 908, of the upper 904 each have an edge, 907 and 909 respectively, that is positioned along a tongue 910 of the shoe 900 so as to face each other. The edges, 907 and 909, are also commonly referred to as eyestays or eyestay edges.

A tension member or lace 912 (see FIG. 9D) is guided along the shoe's tongue 910 between the upper's medial side edge 907 and the upper's lateral side edge 909. The tension member 912 is operationally coupled with the medial and lateral sides, 906 and 908, of the upper 904 so that upon tensioning of the tension member, the medial and lateral sides, 906 and 908, of the upper 904 are tightened about the foot. The tension member 912 is typically operationally coupled with the medial and lateral sides, 906 and 908, of the upper 904 by routing or positioning the tension member 912 through eyelet holes 914 or guides that are positioned along the upper's medial side edge 907 and the upper's lateral side edge 909 (see FIG. 9D).

Figure 9A:
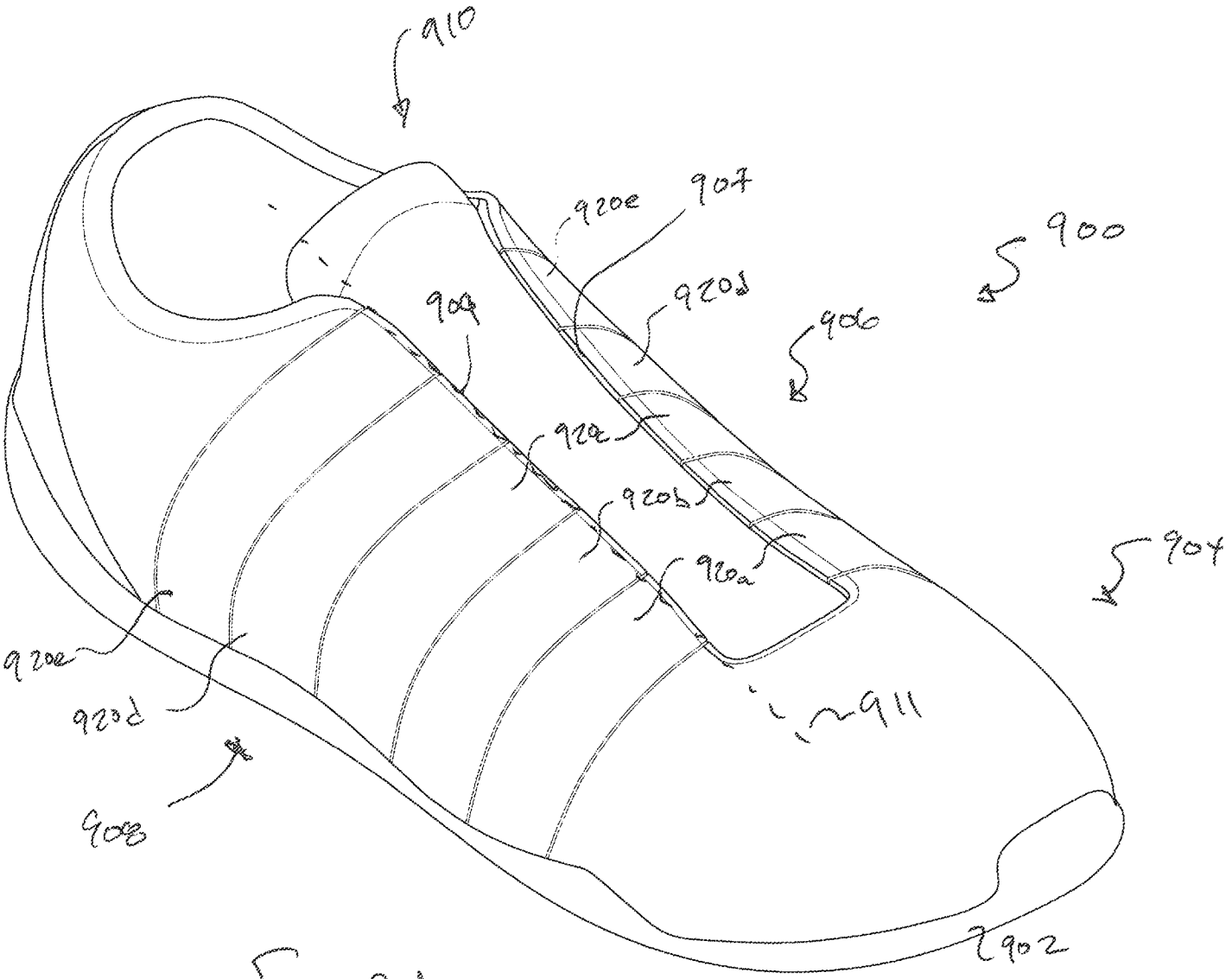
FIGS. 9A-D illustrate an embodiment of a shoe that includes a plurality of members, fingers, or components that are moveable relative to one another.

In some embodiments, the medial side 906 of the upper 904 and/or the lateral side 908 of the upper 904 include a plurality of tensionable regions 920*a-d* that are moveable laterally relative to one another (see FIG. 9C) when tensioned by the tension member 912. Prior to tensioning of the tension member 912, the upper's medial side edge 907 and/or the upper's lateral side edge 909 are relatively linear or straight as shown in FIG. 9A (see upper's lateral side edge 909 in comparison with axis 911). Subsequent to tensioning of the tension member 912, the upper's medial side edge 909 and/or the upper's lateral side edge 907 are substantially nonlinear or uneven (see FIGS. 9C and 9D and comparison of upper's lateral side edge 909 with axis 911) due to the relative movement of the tensionable regions 920*a-d*. The relative movement of the tensionable regions 920*a-d* allows the medial side 906 and/or lateral side 908 of the upper 904 to conform to the shape of a user's foot to a much greater degree than conventional shoes. For example, the movement of the tensionable regions 920*a-d* allows the medial side 906 of the upper 904 to be pulled tightly against the arch of the foot with minimal interference from the material and/or configuration of the upper's medial side as commonly occurs in conventional shoes.

In some embodiments, the shoe 900 includes a reel based tightening mechanism 930 (FIG. 9D) that is configured to tension the tension member 912 upon rotation of a knob 932 of the reel based tightening mechanism 930. In other embodiments, a motorized device, a pull cord, or conventional lacing may be used to tighten the shoe as described in the applications incorporated by reference herein.

Figure 9B:
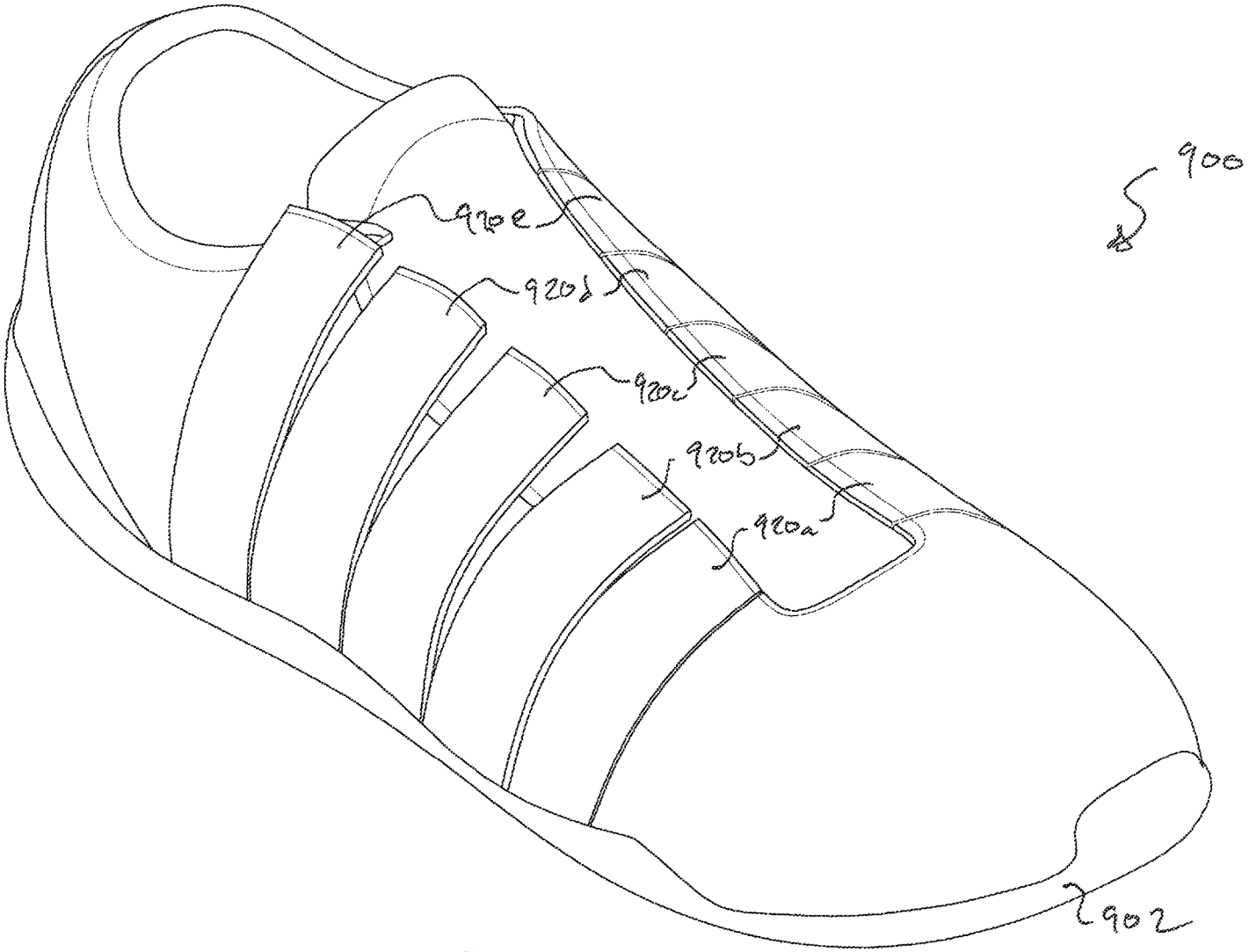

As shown in FIG. 9B, in some embodiments the tensionable regions 920*a-d* may be completely separate and independent from one another. In such embodiments, the tensionable regions 920*a-d* may form individual fingers or projections that extend from adjacent or at the sole 902 to adjacent or at the shoe's tongue 910 as illustrated in FIG. 9B. In other embodiments, only a portion of the tensionable regions 920*a-d* may be separate, independent of distinct. For example, a bottom half of the tensionable regions 920*a-d* adjacent the sole 902 may be coupled together and a top half of the tensionable regions 920*a-d* near the tongue 910 may be separate and distinct. Further, FIGS. 9A-D illustrate the shoe 900 including five tensionable regions 920*a-d*, although more or fewer tensionable regions 920*a-d* may be included, such as between 2 and 20 tensionable regions 920*a-d*.

In other embodiments, one or more, or each of the tensionable regions 920*a-d* may be coupled together. Specific configurations of the tensionable regions 920*a-d* being coupled together are provided in FIG. 9E and FIGS. 10A-15. In such embodiments and as illustrated in FIG. 9E and FIGS. 10A-15, the tensionable regions 920*a-d* may be coupled together via a woven material that spans a gap between some or each of the tensionable regions 920*a-d*. The material may be woven so as to stretch or flex in at least the lateral direction and thereby avoid restricting movement of the tensionable regions 920*a-d*. In other embodiments, the tensionable regions 920*a-d* may be defined by, or include, a relatively stiff material that is positioned between a flexible or stretchable material so as to create a plurality of stiffened material zones and stretchable or flexible material zones. In such embodiments, the stiffened material zones and stretchable or flexible material zones may be integrated into a single layer of the upper. In yet other embodiments, the tensionable regions 920*a-d* may be created by coupling a stiffening member atop the upper via heat welding, lamination, adhesive bonding, and the like. In some embodiments, a stretchable material may be disposed between some or each tensionable regions 920*a-d* to allow the tensionable regions 920*a-d* to be moveable relative to one another. The stretchable material may extend from the upper's medial side edge 907 and/or the upper's lateral side edge 909 to the sole 902 so that one or more tensionable regions 920*a-d* are entirely separate from an adjacent tensionable region between the respective side edge, 907 and/or 909, and the sole 902. As illustrated in FIG. 15, the shoe 900 may further include an additional tensionable region 1502 positioned adjacent a heel of the shoe. The additional tensionable region 1502 may be tensionable to tighten the shoe's heel about the foot.

Figure 9C:
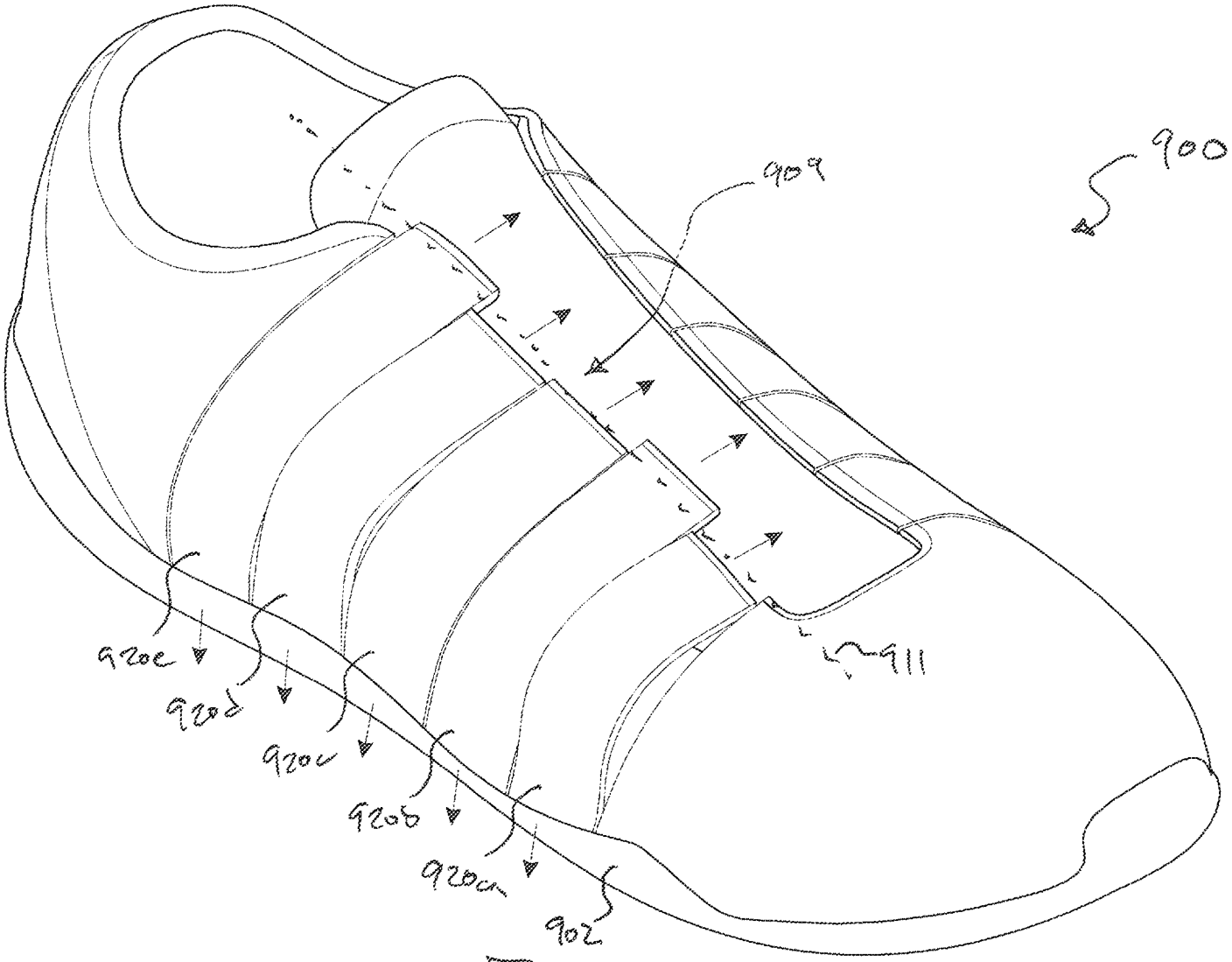
Figure 9D:
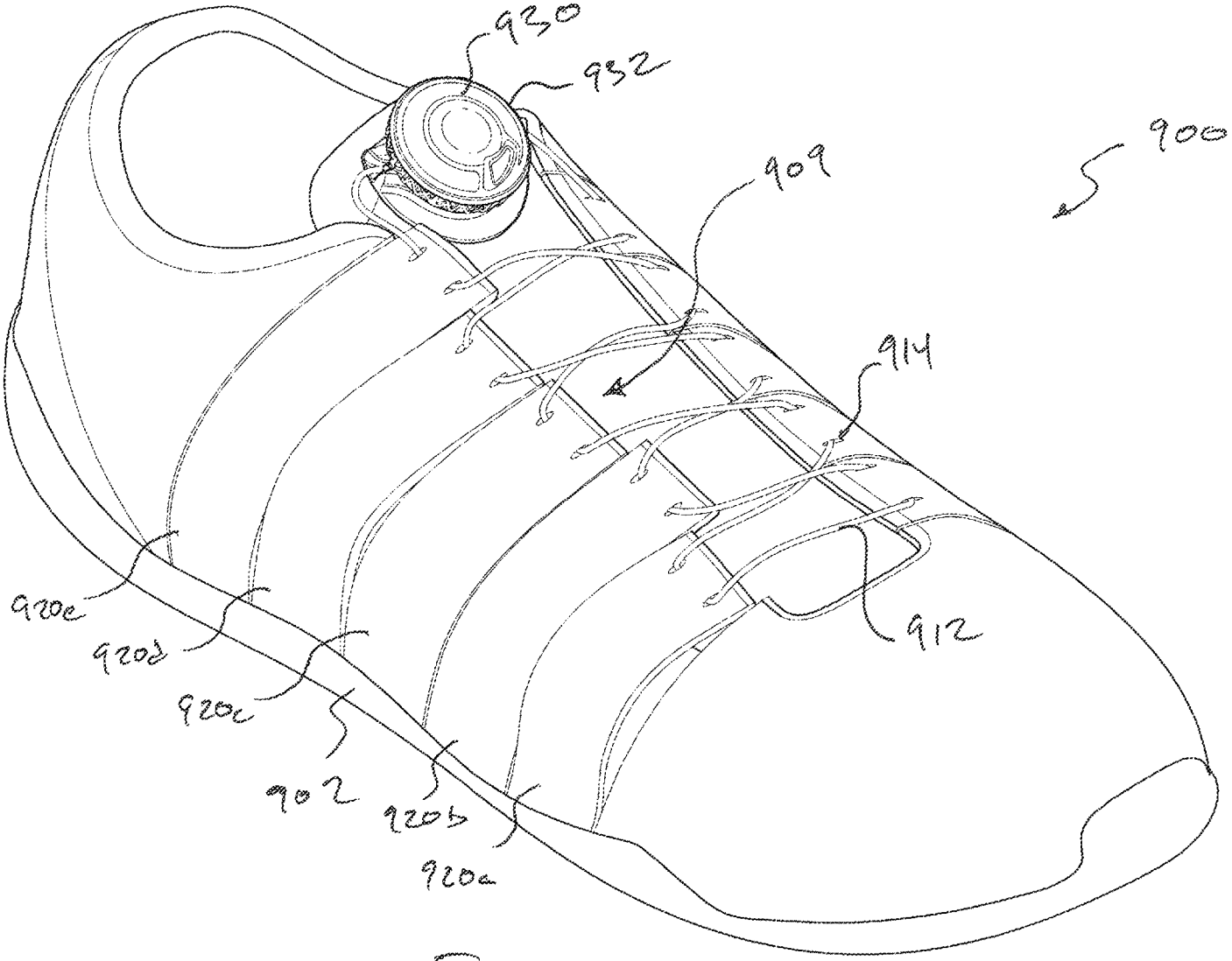
Figure 9E:
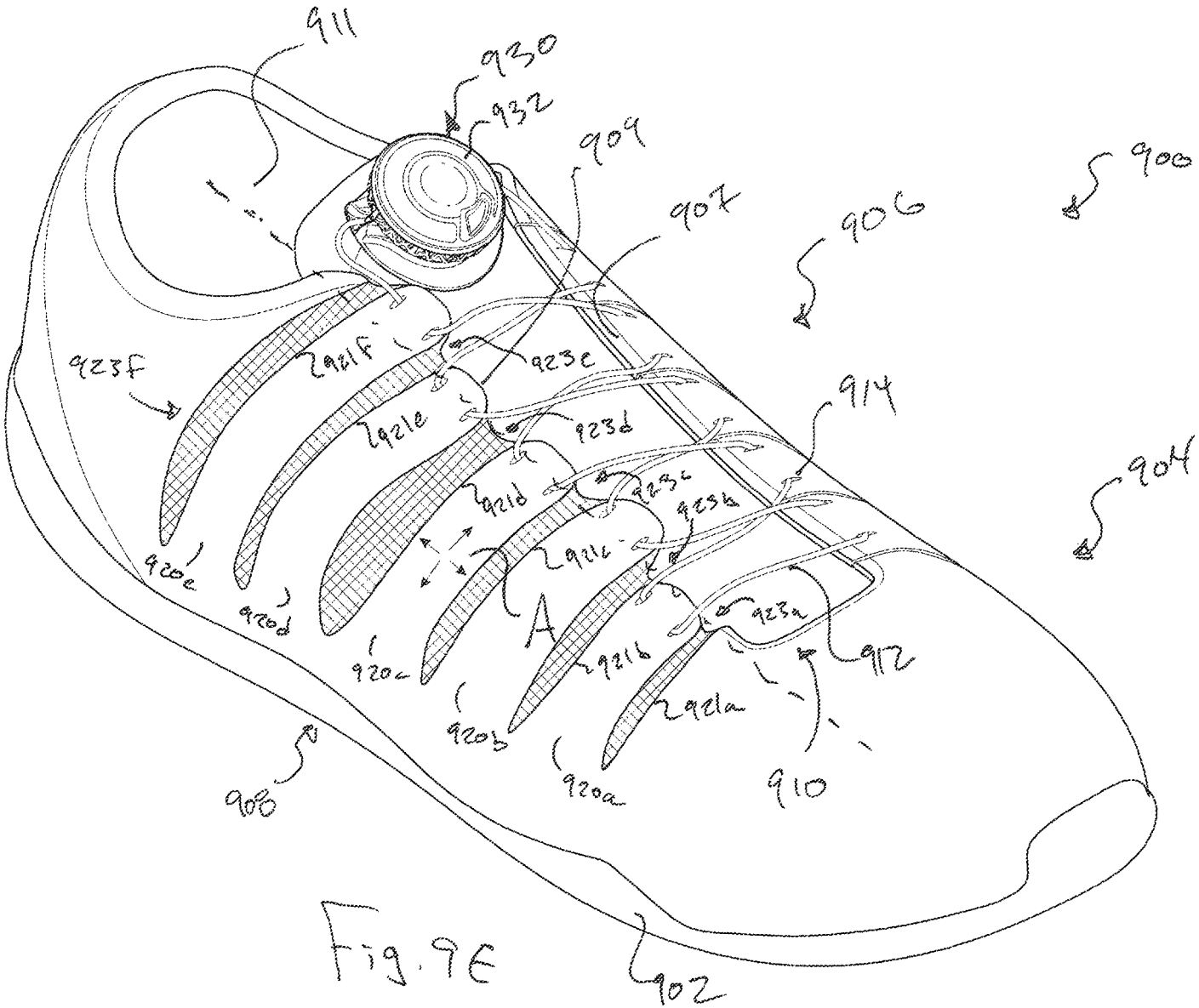
FIG. 9E illustrates another embodiment of a shoe that includes a plurality of members, fingers, or components that are moveable relative to one another.

FIG. 9E illustrates the shoe 900 with material positioned between each of tensionable regions. Specifically, the shoe 900 includes a sole 902 and an upper 904 that is attached to the sole 902 and configured to fit around the foot of a user. The upper 904 has a medial side 906 and a lateral side 908 that fit around the medial and lateral side of the foot, respectively. The medial and lateral sides, 906 and 908, of the upper 904 each have an edge, 907 and 909 respectively, that is positioned along a tongue 910 of the shoe 900 so as to face each other (also known as an eyestay or eyestay edge).

Either or both the upper's medial side 907 or the upper's lateral side 909 includes a plurality of stiffened regions 920*a-e* and a plurality of flexible regions 921*a-f* with each stiffened region 920*a-e* being disposed between two flexible regions 921*a-f* as illustrated. This configuration allows the stiffened regions 920*a-e* to be moveable laterally and/or longitudinally relative to one another (see arrows A) upon tensioning of the medial and lateral sides, 906 and 908, of the upper 904 such that prior to tensioning of the medial and lateral sides, 906 and 908, of the upper 904, the upper's medial side edge 907 and/or the upper's lateral side edge 909 are substantially linear or straight in comparison with axis 911, and subsequent to tensioning of the medial and lateral sides, 906 and 908, of the upper 904, the upper's medial side edge 907 and/or the upper's lateral side edge 909 are substantially uneven or nonlinear in comparison with axis 911 due to relative movement of the plurality of stiffened regions 920*a-e*.

The shoe 900 also includes a tension member 912 that is guided between the upper's medial side edge 907 and the upper's lateral side edge 909. The tension member 912 is operationally coupled with the medial side 906 and the lateral side 908 of the upper 904 so that upon tensioning of the tension member 912, the medial side 906 and the lateral side 908 of the upper 904 are tightened about the foot. The shoe 900 also includes a reel based tightening mechanism 930 that is configured to tension the tension member 912 upon rotation of a knob 932 of the reel based tightening mechanism 930.

In some embodiments, the flexible regions 921*a-f* are or include a woven material that spans a gap 923*a-f* between adjacent stiffened regions 920*a-e*. The woven material is configured to stretch or flex in at least the lateral direction (i.e., in the direction of the stiffened regions 920*a-e*) to thereby avoid restricting movement of the stiffened regions 920*a-e*. In some embodiments, the stiffened regions 920*a-e* may include a woven material that is configured so as not to substantially stretch or flex in the lateral direction. The woven material of the stiffened regions 920*a-e* and the flexible regions 921*a-f* may be integrated into a single layer. For example, the weave or pattern of the material in the stiffened regions 920*a-e* may be arranged, such as in one or more directions, so that the material resists stretching in response to a tension force while the weave or pattern of the flexible regions 921*a-f* is arranged, such as in one or more directions, that allow the flexible regions 921*a-f* to flex, conform, stretch, bend, or otherwise move in response to a tension force. The material of the stiffened regions 920*a-e* and the flexible regions may be woven together to form a single woven layer of material.

Alternatively or additionally, the stiffened regions 920*a-e* may be formed by coupling a stiffening member or material atop the respective sides of the upper 904 via heat welding, lamination, adhesive bonding, and the like. For example, a thermoplastic polyurethane or other material having projections or fingers that correspond to the stiffened regions 920*a-e* may be positioned and coupled atop a mesh material that forms the flexible regions 921*a-f*.

One or more of the flexible regions 921*a-f* may extend entirely from the upper's medial side edge 907 and/or the upper's lateral side edge 909 to the sole 902 of the shoe 900 so that one or more of the stiffened regions 920*a-e* are entirely separated from adjacent stiffened regions 920*a-e* between the respective side edge, 907 and/or 909, and the sole 902. Entirely separated as used herein refers to the respective stiffened region 920*a-e* being entirely surrounded by a flexible region 921*a-f* between or from the sole 902 to the respective edge, 907 and 909. In other embodiments, such as FIG. 9*e*, only a portion of the stiffened region 920*a-e* (i.e., upper portion adjacent the edge 907 and/or 909) may be separate from an adjacent stiffened region 920*a-e*. In such embodiments, the lower portion of the stiffened regions 920*a-e* may be connected or attached near or adjacent the sole 902.

In some embodiments, such as FIG. 15, the shoe 900 may further include a stiffened region 1502 and a flexible region 1504 positioned adjacent a heel of the shoe 900. The stiffened region 1502 may be tensionable to tighten the shoe's heel about the foot. In such embodiments, the stiffened region 1502 of the heel may be entirely surround by the flexible region 1504 of the heel as illustrated in FIG. 15.

FIGS. 10A-20C illustrate other embodiments wherein a greater degree of conformance of the shoe may be achieved. Referring now to FIGS. 10A-G, illustrated are various views of a shoe 1000 that includes a lacing system. Specifically, the shoe 1000 includes a reel assembly 1002 that is operable to tension a lace, cord, or tension member 1004 (hereinafter lace 1004) that is guided or routed along a path about the shoe 1000 via a plurality of guide members 1005. In the illustrated embodiment, the guide members 1005 are formed within the shoe's upper, such as by forming a channel or pathway between two sections of the upper or by inserting sections of tubing within the upper. In other embodiments, the guide members may be formed of plastic or relative rigid components or may be formed of fabrics material strips or webbing sleeves.

Embodiments of forming guide members in the upper of a shoe are further described in U.S. patent application Ser. No. 14/479,173, filed Sep. 5, 2014, and titled "Guides and Components for Closure Systems and Methods Therefor," the entire disclosure of which is incorporated by reference herein.

Tensioning of the lace 1004 via operation of the reel assembly 1002 causes opposing sides or eyestays of the shoe to close about the shoe's tongue 1020. Tensioning of the lace 1004 also causes the shoe 1000 to tighten around and about the user's foot. The shoe's upper is formed of a single layer or a few layers of materials. The shoe's upper transitions between various zones of elasticity, breathability, stretch or conformity, no stretch or conformity, various rigidities, and the like. As such, the shoe's upper is able to easily conform to the user's foot without overly limiting or constricting a natural movement of the foot. For example, the shoe's upper is made of a relatively lightweight, stretchable, and breathable material 1016 that is shown by grayish cross-hatching. In a specific embodiment, the material 1016 is a breathable mesh material that promotes air flow to and from the foot to keep the foot cool, dry, and comfortable. The material 1016 is able to easily stretch and conform to the user's foot as the foot bends, flexes, expands, and/or contracts during movement.

The shoe's upper also includes regions or zones that do not stretch or conform as easily to the user's foot. These regions or zones function to fit and secure the foot within the shoe. Specifically, the foot includes a first zone or member 1006, a second zone or member 1007, a third zone or member 1009, a fourth zone or member 1008, and a fifth zone or member 1010 of non-stretch material. These zones are shaped as fingers, panels, or material members or strips that wrap laterally about the upper or heel portion of the shoe 100. Due to the construction of the shoe 100, the zones function similar to independent straps, members, or fingers previously described that wrap about the user's foot to hold and secure the foot within the shoe 100.

Figure 10A:
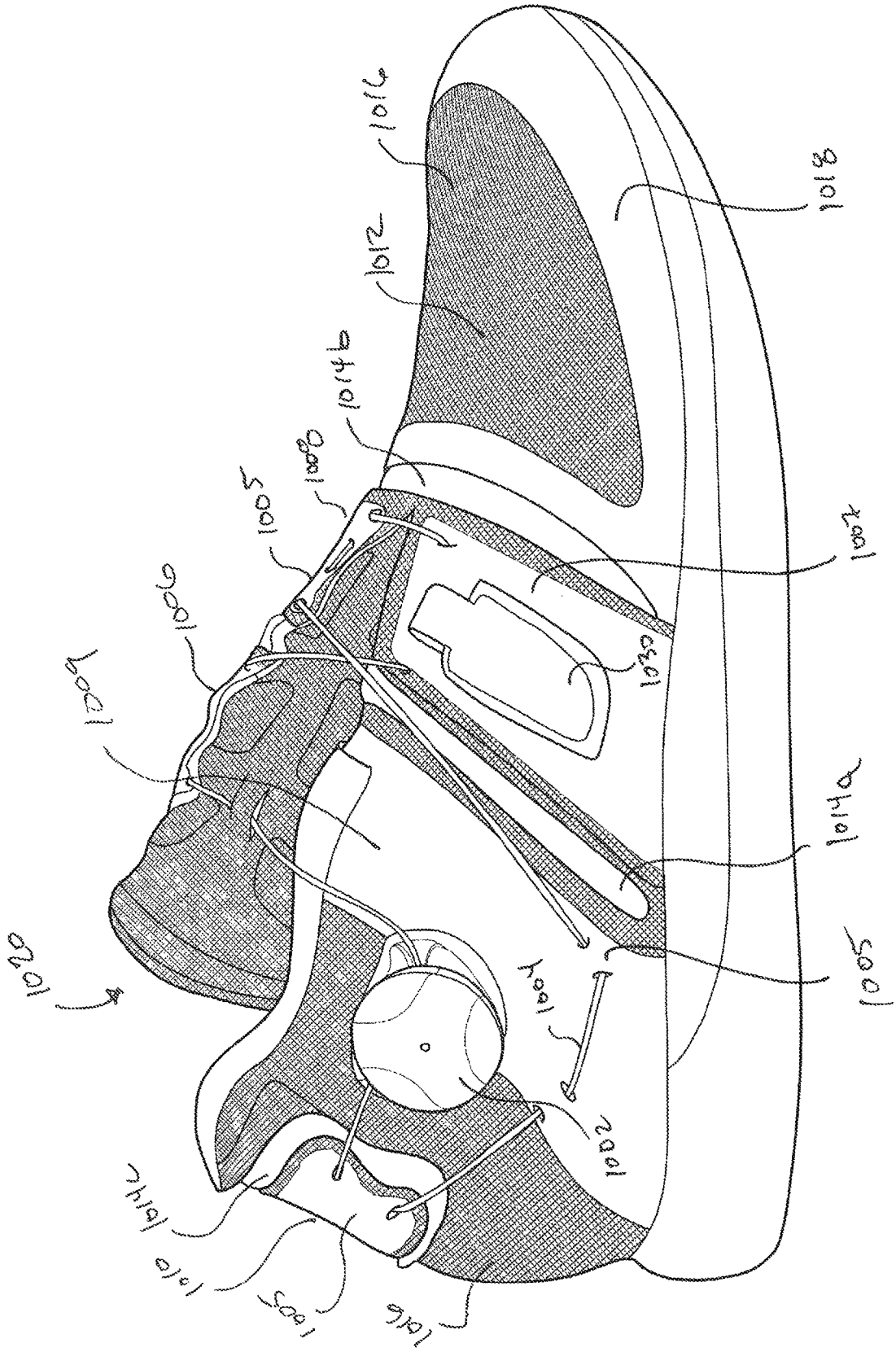
FIGS. 10A-G illustrate an embodiment of a shoe that is configured to enhance the fit and/or performance of the shoe and that employs members, fingers, or components that are moveable relative to one another.
Figure 10B:
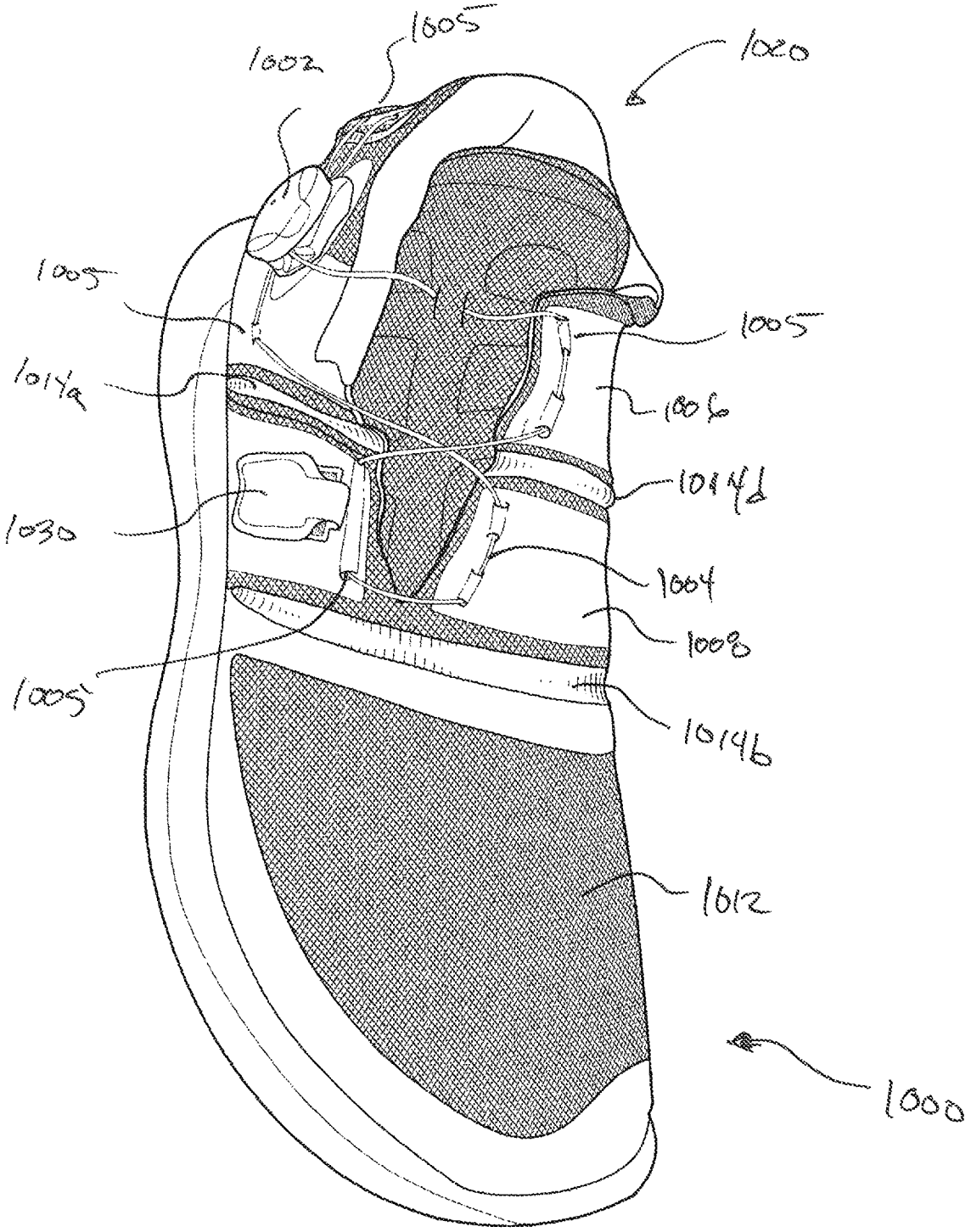
Figure 10C:
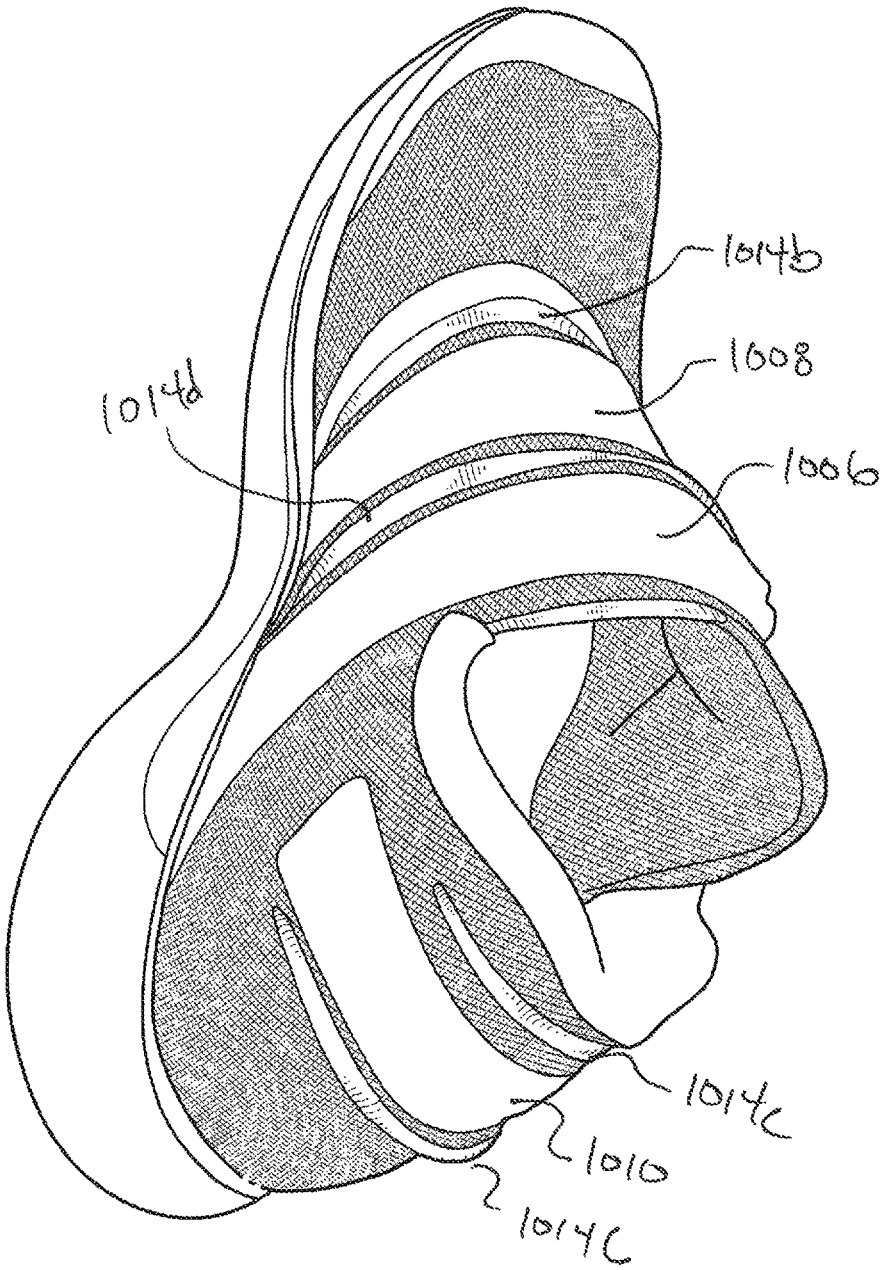

In many embodiments, the non-stretch material members, fingers, or zones (hereinafter non-stretch members 1006-1010) are separated from the other materials of the shoe 1000 via a divider material 1014. For example, the second non-stretch member 1007 is illustrated as divided from the third non-stretch member 1009 via a divider material 1014*c*. The second non-stretch member 1007 is likewise divided from the toe box 1012 via a divider material 1014*b*. As shown in FIGS. 10B and 10C, the fourth non-stretch member 1008 is similarly divided from the first non-stretch member 1006 and from the toe box 1012 via divider material 1014*d* and 1014*b*, respectively. The fifth non-stretch member 1010 is positioned around the shoe's heel and is also divided from the stretch material 1016 of the heel via a divider material 1014*c*, which in the illustrated embodiment extends around three of the four sides of the fifth non-stretch member 1010.

The divider material 1014 is an elastic or flexible material that allows the material to flex, bend, or elastically deform as the material is tensioned or stressed. The elastic material dividers allows the non-stretch members (i.e., 1006-1010) to move about the shoe relatively independently and thereby conform to the user's foot. This allows the non-stretch members to function similar to fingers or straps as previously described (see FIGS. 9A-E) and independently tighten desired portions of the shoe about the foot, or wrap the shoe laterally about the foot. Stated differently, the use of the divider material 1014 minimizes the forces that are imparted or transferred between the non-stretch members (1006-1010) that would minimize or negate wrapping of the shoe about the user's foot. The divider material 1014 also minimizes the forces that are transferred or imparted between the non-stretch members and the surrounding material (e.g., flexible material 1016). Because minimal forces are transferred between the non-stretch members (1006-1010) and/or to the surrounding material, the tension that is imposed on the non-stretch members (1006-1010) via the tensioned lace 1004 causes the non-stretch members to function similar to an independent finger or strap that tightens the portion of the shoe directly adjacent to the respective non-stretch member about the user's foot.

Because minimal forces are transferred between the non-stretch members (1006-1010), the force or tension imposed on one of the non-stretch members does not significantly affect the fit of the shoe in other areas. For example, when the lace 1004 is tensioned, the lace tension is imposed or transferred to the second non-stretch member 1007 and the fourth non-stretch member 1008, which causes these members to wrap and tighten the shoe 1000 about the forefront of the user's foot. The elastic divider 1014*b* that separates these members (1007 and 1008) minimizes the tension force that is transferred to the toe box, which minimizes constriction of the toes by the shoe 1000 and allows the toes to move naturally within the toe box. Minimal tension or closure force between the second and fourth non-stretch members (1007 and 1008) is also transferred to the first and third non-stretch members (1006 and 1009) via the elastic dividers (1014*c* and 1014*d*) that separate these members. As such, the separate members may be relatively independently tensioned.

The fifth non-stretch member 1010 that is positioned around the heel is able to wrap and close about the heel to a greater degree due to the elastic divider 1014*c* that separates this member from the other heel material. Because a minimal tension or force is transferred between the fifth non-stretch member 1010 and the other heel material, the tension imposed or transferred to the fifth non-stretch member 1010 via the tensioned lace 1004 is focused in the zone 1010 rather than being distributed to the entire heel portion of the shoe 1000. This results in a greater movement and closure of the fifth non-stretch member 1010 about the user's heel.

As can be realized from the above disclosure, the configuration or construction of the shoe 1000 allows the non-stretch members (1006-1010) to function relatively independently and conform to the unique shape of the user's foot. For example, the non-stretch members function similar to independent fingers or straps described herein (see description of FIGS. 9A-E) in that the tension or closure force is imposed on the user's foot in a specific and desired location. The result is that the shoe 1000 is pulled or pressed into contact with the user's foot to a greater degree than that achieved by conventional shoes. For example, on the medial side of the shoe 1000, tensioning of the first and third non-stretch members (1006 and 1009) may cause the first non-stretch member 1006 to move and wrap laterally about the user's foot to a greater degree that the third non-stretch member 1009 due to the first non-stretch member 1006 being positioned adjacent the foot's arch. The increased movement of the first non-stretch member 1006 causes the shoe 1000 to be pulled or pressed more tightly against the foot's arch, which results in a more sock-like feel of the shoe 1000 about the user's foot. The same effect may be achieved on the lateral side of the shoe.

Due to the different movements of the various non-stretch members, the eyestay of the shoe is typically not linear, but more uneven as described herein (see FIGS. 9C and 9D and comparison of upper's lateral side edge 909 with axis 911). In effect, by employing alternating regions of stretch and non-stretch materials, the shoe's vamp becomes more dynamic and capable of flexing and conforming to the unique shape of the user's foot, which results in an increased wrap of the shoe 1000 about the user's foot.

Unlike the configuration of FIGS. 9A-D, the improved fit of the shoe 1000 about the user's foot is not achieved via material cuts that are made in the shoe. Rather, the fit is achieved even though the shoe's upper is formed of a single layer of material or several integrated layers of material. Specifically, the various materials described above—i.e., the lightweight/breathable material 1016, the non-stretch material (1006-1010), and the elastic divider material 1014—are integrated or formed together so that the combination of materials form an integrated or unified upper. The various materials may be integrated via heat welding, adhesive bonding, insert molding, or using any other construction technique known in the art. For example, the non-stretch material (1006-1010) may be a polyurethane that is laminated or heat pressed onto the breathable mesh 1016. The elastic divider material 1014 may similarly be integrated with the breathable mesh 1016 and/or non-stretch material (1006-1010). This configuration is different than conventional shoes that employ straps, fabric or plastic exoskeletons, separate cords or lace, and the like. Such conventional shoes typically include an upper layer and a separate strap, exoskeleton, or lace/cord layer that is positioned over the upper layer, or disposed within and typically coupled with the upper. The use of the single integrated upper layer provides a clean aesthetic appearance while delivering an enhanced performance similar or better than that achieved with independent straps, exoskeletons, lace/cord, and the like.

In some embodiments, the non-stretch members (1006-1010) are attached or anchored to the sole of the shoe 1000. This coupling may increase the contact between the user's foot and the shoe's material positioned adjacent the sole. Stated differently, the shoe's material positioned adjacent the sole may be pulled or pressed tightly against the user's foot. In other embodiments, the mesh material 1016 of an elastic material (e.g., material 1014) may be positioned between the shoe's sole and a bottom or distal portion of the non-stretch members (1006-1010). The configuration may enable the non-stretch members (1006-1010) to move relative to the shoe and one another to a greater degree and thereby increase the conformance of the shoe 1000 about the user's foot.

Although the embodiments illustrate the shoe employing essentially five non-stretch members or zones (i.e., 1006-1010) that are tensioned via the lace, it should be realized that in other embodiments more or fewer non-stretch member or zones may be utilized to achieve a desired wrap of the vamp or shoe 1000 about the user's foot. For example, more non-stretch members or zones may create a greater wrap given the increase number of independent fingers or members.

As illustrated, in some embodiments the reel assembly 1002 may be coupled with the fourth non-stretch member 1009. The non-stretch material may provide a relatively rigid platform or base for attaching and supporting the reel assembly 1002. The elastic material 1014*b* may arcuately extend across the shoe 1000 so as to be positioned adjacent the lisfranc joint (i.e., the intersection between the foot's tarsus and metatarsal bones). In some instances, the elastic divider 1014*b* may be positioned behind the lisfranc joint, although in other instances the elastic divider 1014*b* may be positioned in front of but close in proximity to the lisfranc joint. Positioning the elastic divider 1014*b* in this manner prevents or minimizes the divider 1014*b*, and any tension imposed on the second and fourth non-stretch members (1007 and 1008), from interfering with the natural movement of the toes in response to walking or running. For example, the toe box 1012 is able to remain open and un-constricted about the foot, which allows the toes to open or splay as the user walks or runs. The openness of the toe box 1012 provides a more natural foot movement, which results in greater comfort and support to the foot. In some embodiments, the breathable material 1016 of the toe box 1012 may stretch to allow an even greater amount of toe splay.

The elastic divider 1014*b* minimizes the tension force that is imposed on or transferred to the forefront of the shoe 100. As such, the tension or closure force remains mainly in the tarsus region of the foot, which presses and holds the foot backward into the heel of the shoe 1000. The fifth non-stretch member 1010 holds the rear portion of the shoe 1000 firmly against the user's heel, which minimizes slippage of the foot within the shoe 1000. In some embodiments, the sixth non-stretch member 1018 may be positioned around the circumference of the toe box 1012. The sixth non-stretch member 1018 may not be tensioned as are the other member. Rather, this member 1018 may provide a more rigid shell or structure for the toe box 1012.

In some embodiments, the shoe 1000 may include a zonal tension component 1030. The zonal tension component 1030 may be employed to increase the tension or tightness that is imparted to the foot in a specific area. In a specific embodiment, the zonal tension component 1030 is a foldable component, preferably a fabric material or flap, that may be folded opened and closed. In other embodiments, the zonal tension component 1030 may be a relatively rigid component (e.g., plastic), such as a boss, capstan, post, and the like.

Figure 10D:
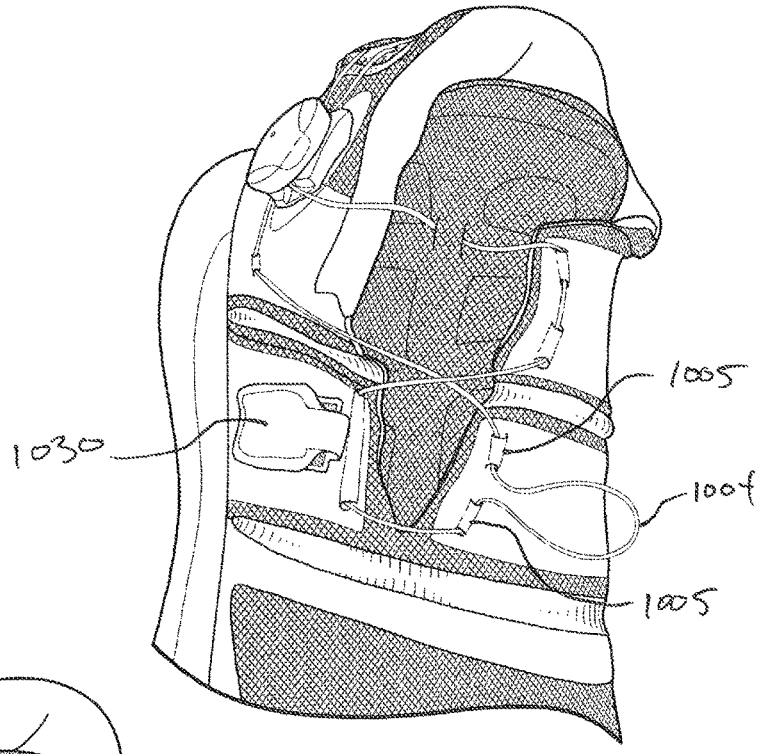
Figure 10E:
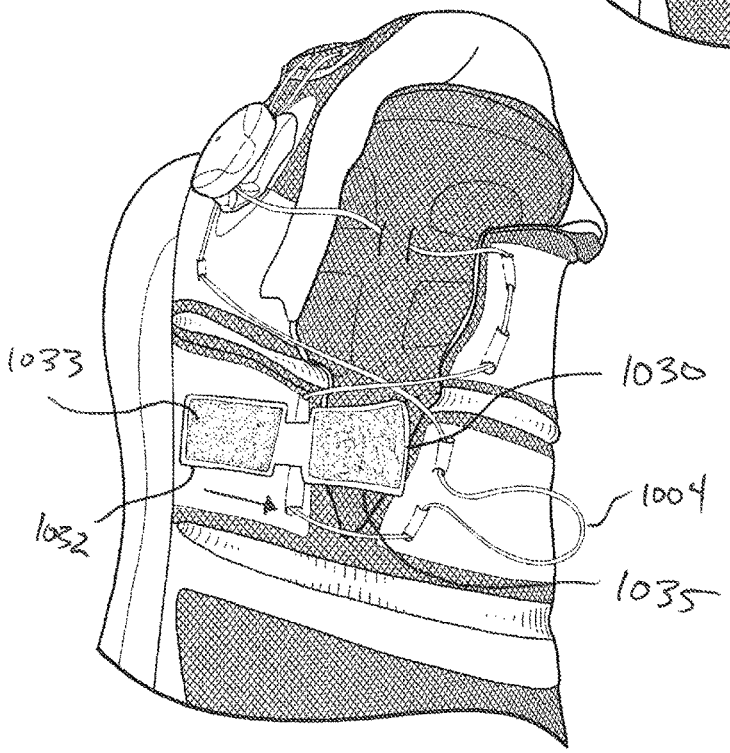
Figure 10F:
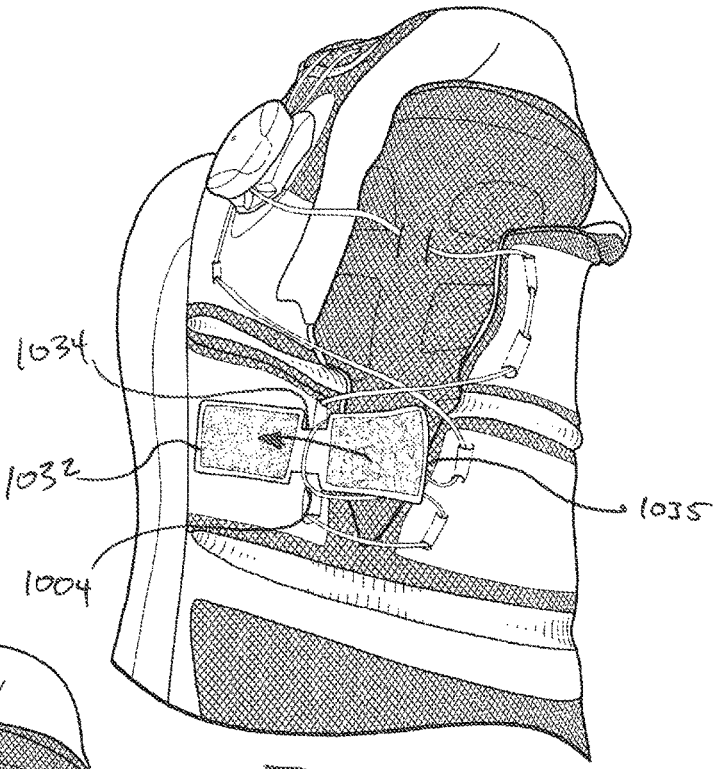

FIGS. 10D-G illustrate the use of the foldable fabric zonal tension component 1030. As shown in FIG. 10D, to increase the tension in a zone or area of the shoe 1000 and foot, the lace 1004 is pulled or elongated within an opening between opposing guide members 1005. As shown in FIG. 10E, an upper fabric member or flap 1035 is folded upward relative to a lower fabric member or base 1032. The upper member 1035 may be releasably coupled with the lower member 1032 via a hook and loop fastener 1033, magnetic bond, mechanical fastening, and the like. As shown in FIG. 10F, with the upper member 1035 folded upward relative to the lower member 1032, the lace 1004 is positioned between the upper and lower members, 1035 and 1032. The lace 1004 may be positioned around a midsection or joint 1034 between the upper and lower members, 1035 and 1032. The joint 1034 may have a smaller width then either or both the upper member 1035 and the lower member 1032, which aids in retaining the lace 1004 around the two members.

Figure 10G:
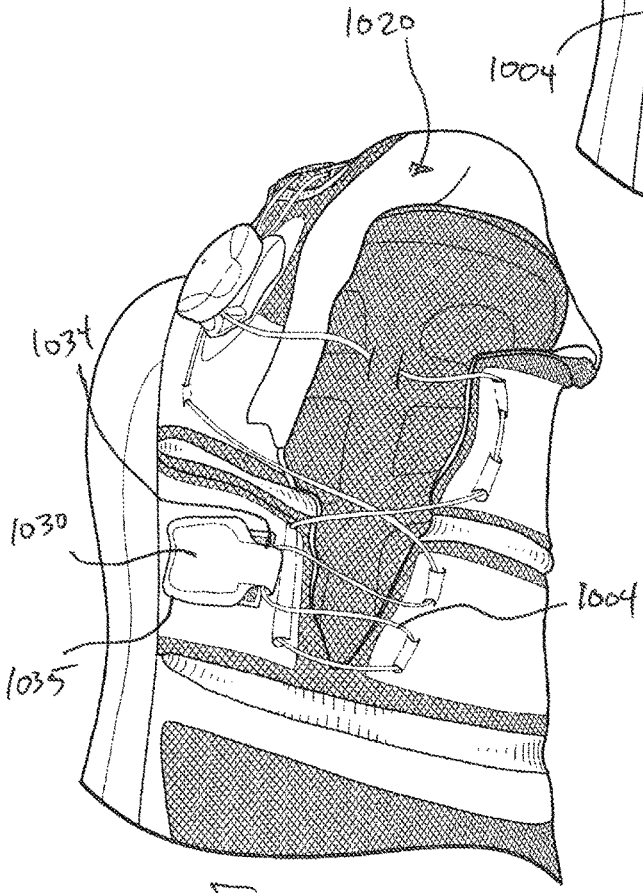

As shown in FIG. 10G, the upper member 1035 may then be folded downward and secured about the lower member 1032 to lock the lace 1004 about the joint or midsection 1034. With the upper member 1035 secured about the lower member 1032, the midsection or joint 1034 functions as an additional guide member for the lace 1004. The use of the zonal tension component 1030 results in an additional crossing of the lace 1004 about the shoe's tongue 1020, which increases the tension or tightness that is imposed on the shoe 1000 and foot adjacent the additional lace crossing. The zonal tension component 1030 may also function as a friction element, which restricts dynamic movement or shifting of the lace. In some embodiments, a pair of zonal tension components 1030 could add an isolated tension zone.

The zonal tension component 1030 is illustrated as being positioned on or about the second non-stretch member 1007, although it should be realized that additional zonal tension components 1030 may be used elsewhere on the shoe 1000 as desired and/or the zonal tension component 1030 may be repositioned about the shoe 1000 as desired. The use of the zonal tension component 1030 between the second and fourth non-stretch members, 1007 and 1008, results in an increased amount of tension or tightness being exerted on the foot adjacent or behind a base of the metatarsal bones, which helps secure the foot in place within the shoe 1000.

As described above, the non-stretch members (1006-1010) function relatively independent of the other portions of the shoe. The term "relatively independent" functioning of the non-stretch zones means that these members or zones are not significantly influenced or restricted by the other portions of the shoe. For example, the other portions of the shoe do not greatly impede the movement and flexing of the non-stretch members. It should be realized that the non-stretch members will likely be influenced by other portions of the shoe due to the direct coupling of the non-stretch members with the shoe. As such, the use of the term "relatively independent" does not imply that the non-stretch members or zones are entirely unaffected by the other materials of the shoe. Rather, the influences of the other materials are meant to be minimized or lessened to the greatest extent possible while still allowing the upper to be a uniform and integrated layer of materials.

Figure 12:
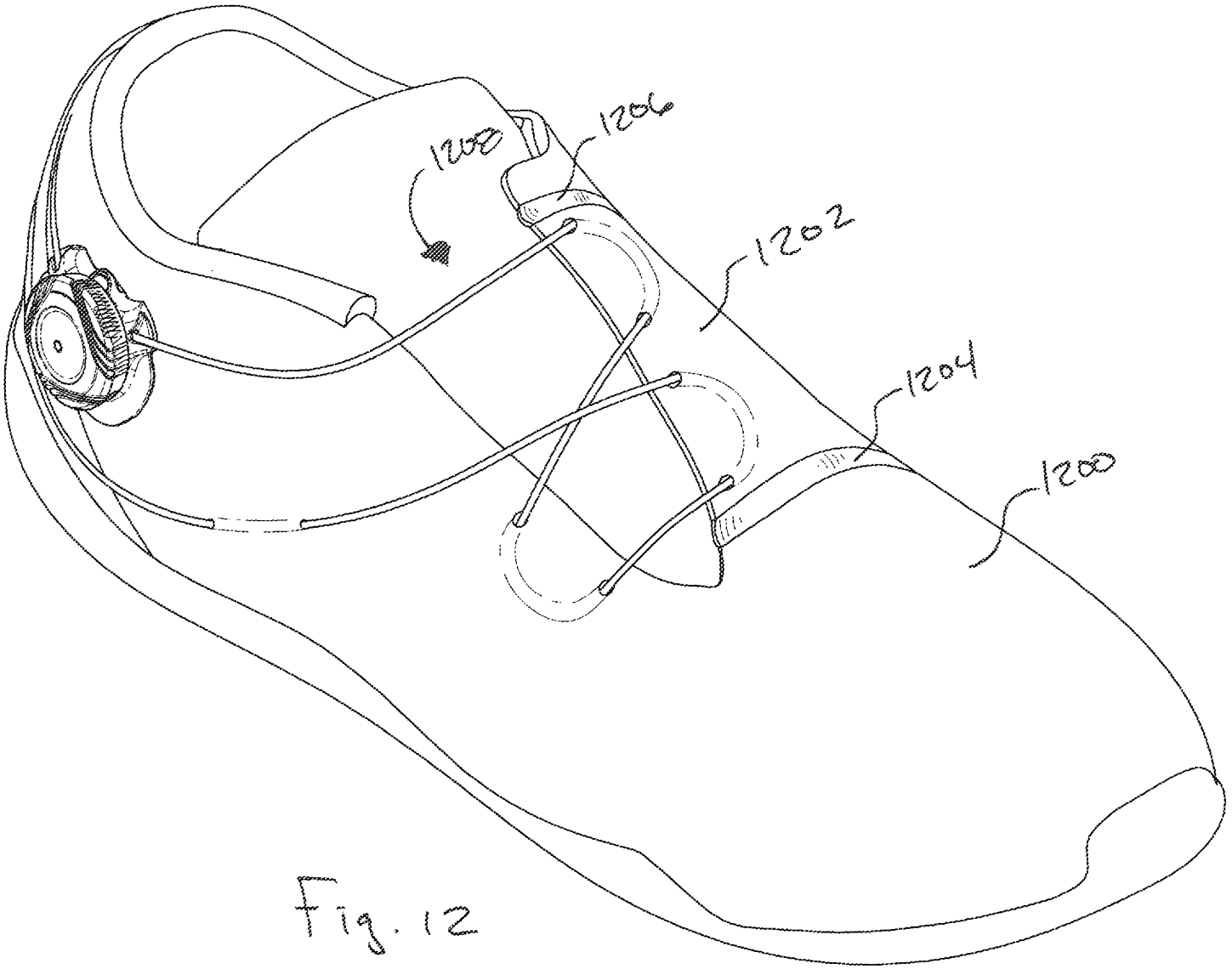
FIG. 12 illustrates an embodiment of a tensionable member that may be employed to tighten a shoe about a user's foot.

Referring now to FIG. 12, illustrated is another embodiment of a tensionable member 1202 that is employed on a shoe 1200 to tighten the shoe 1200 about a user's foot. The tensionable member 1202 is similar to those described in FIGS. 10A-C except that the tensionable member 1202 is a single and larger member rather than multiple discreet members. The tensionable member 1202 is able to function relatively independent of the other portions of the shoe due to the use of elastic dividers, 1204 and 1206, that separate the tensionable member 1202 from the remainder of the shoe's material. As the tensionable member 1202 is tensioned via the lace and reel assembly, the tensionable member 1202 is pulled closed over the shoe's tongue without transferring or imparting a significant force to the toe box or heel of the shoe. The tightening force, therefor, remains over the tarsus of the foot, which secures the foot within the shoe 1200. The tensionable member 1202 functions in a panel-like fashion to secure the foot within the shoe 1200.

Figure 13A:
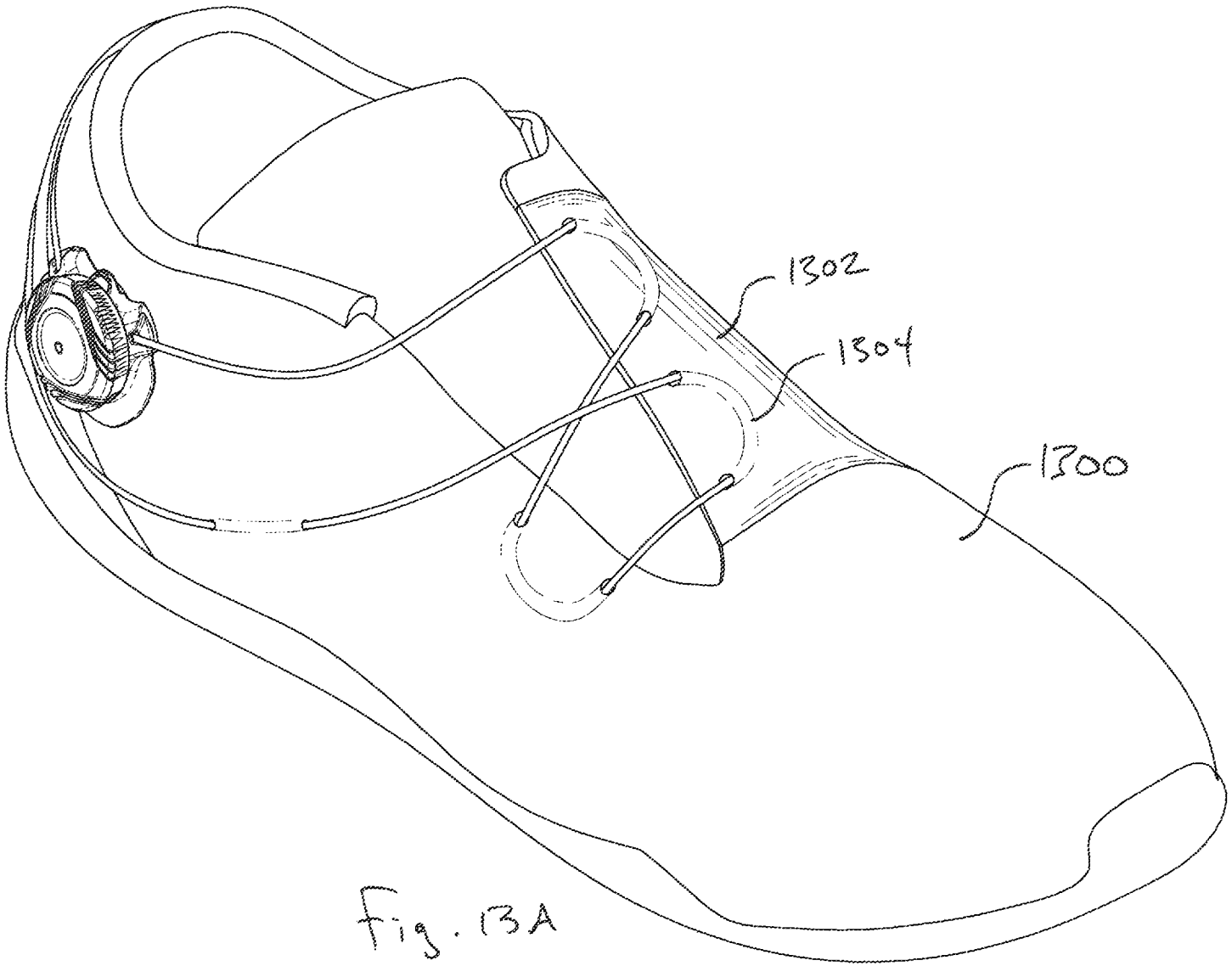
FIGS. 13A-C illustrate an embodiment wherein an elastic member is coupled with a tension member of the shoe.
Figure 13B:
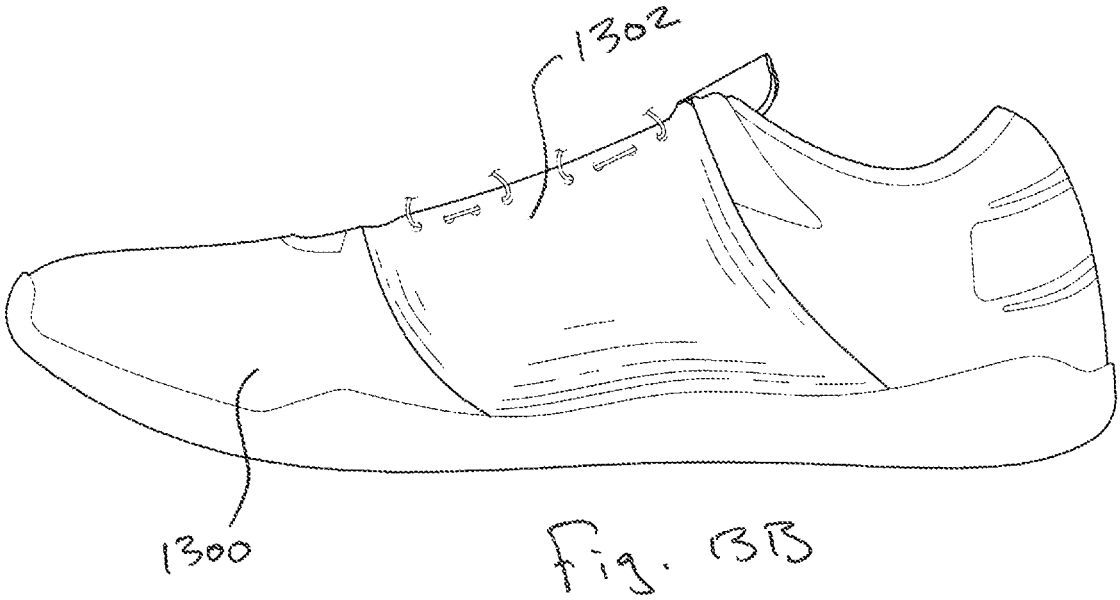
Figure 13C:
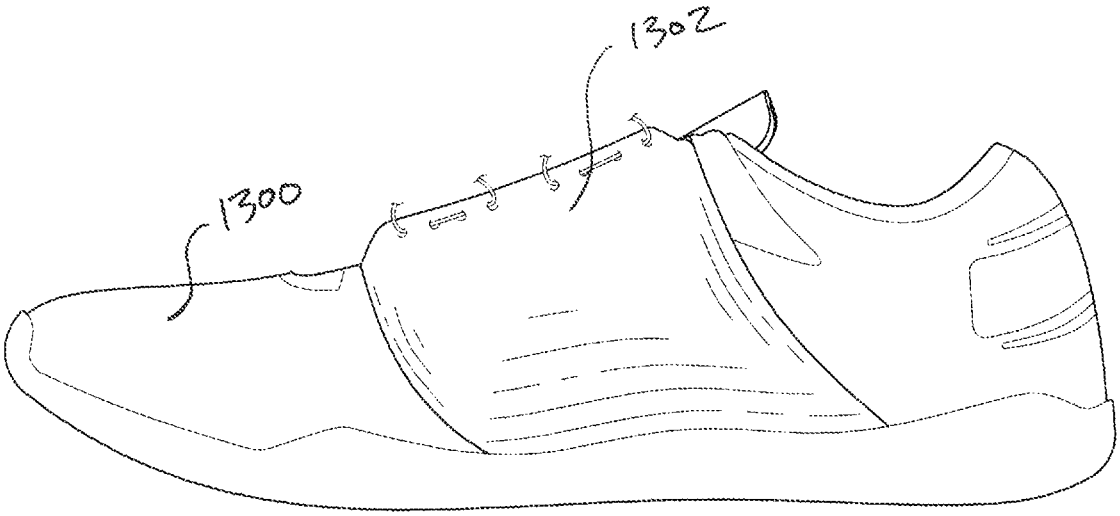

FIGS. 13A-C illustrate an embodiment that is similar to FIG. 12, except that the tensionable member 1202 is replaced with an elastic member 1302 that is coupled with the lace. The use of the elastic member 1302 typically eliminates the need for elastic dividers around one or more borders of the member 1302. Rather, a tension force that is imposed on the elastic member 1302 may be distributed through the elastic member 1302 without transferring a significant portion of the force to the other materials of the shoe. When an elastic member 1302 is used, the lace guides 1304 that are formed in the elastic member 1302 should be reinforced to prevent or minimize load concentrations at or adjacent to the guide members 1304. FIG. 13B illustrates the elastic member 1302 in a relaxed or un-tensioned state. FIG. 13C illustrates the elastic member 1302 member in a tensioned stated where the elastic member 1302 is pulled upward and over the top of the shoe 1300. In some embodiments, the elastic member 1302 may be positioned elsewhere on the shoe 1300, such as in an area where a secure and conforming fit is desired. The elastic member 1302 may have a pre-designed level of play or flexibility as desired to achieved a desired secure and/or conforming fit. For example, the elastic member 1302 may be positioned adjacent or over the metatarsal or above the lisfranc area (e.g., closer to the throat of the shoe) to achieve a desired fit.

Figure 11A:
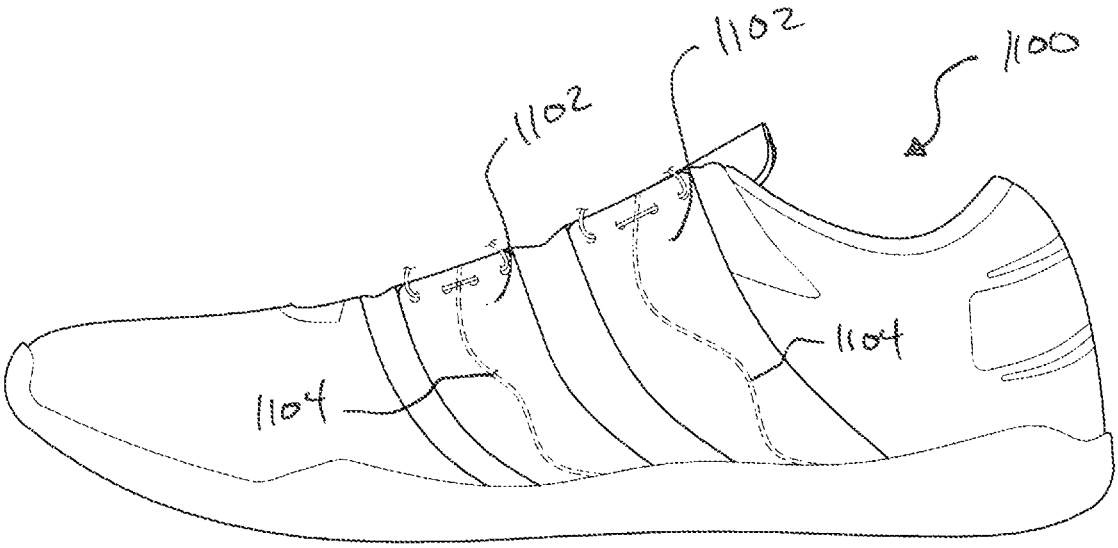
FIGS. 11A-C illustrate a stop component that may be used with straps of a shoe, or with members, fingers, or components that are moveable relative to one another, to limit movement of the respective component.
Figure 11B:
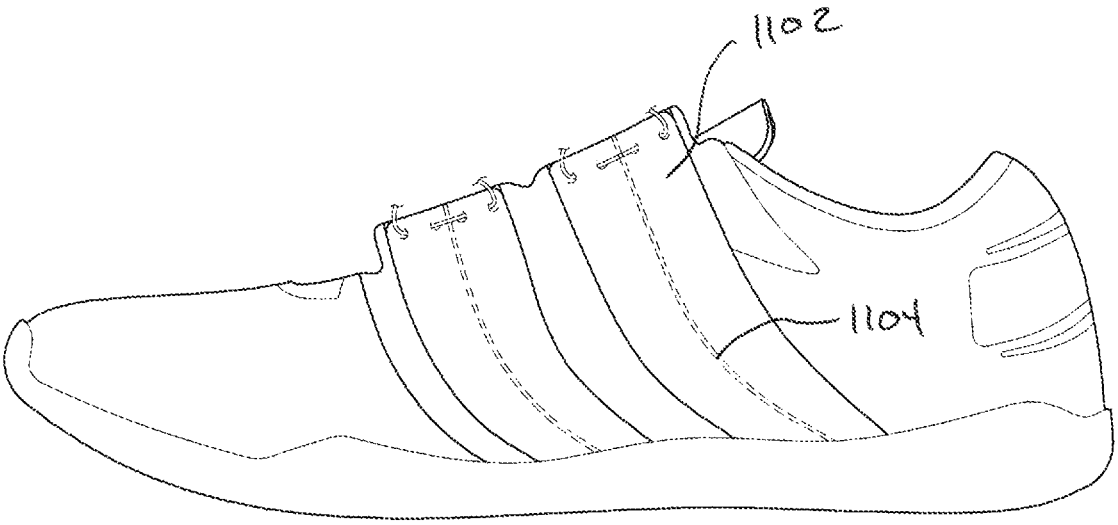
Figure 11C:
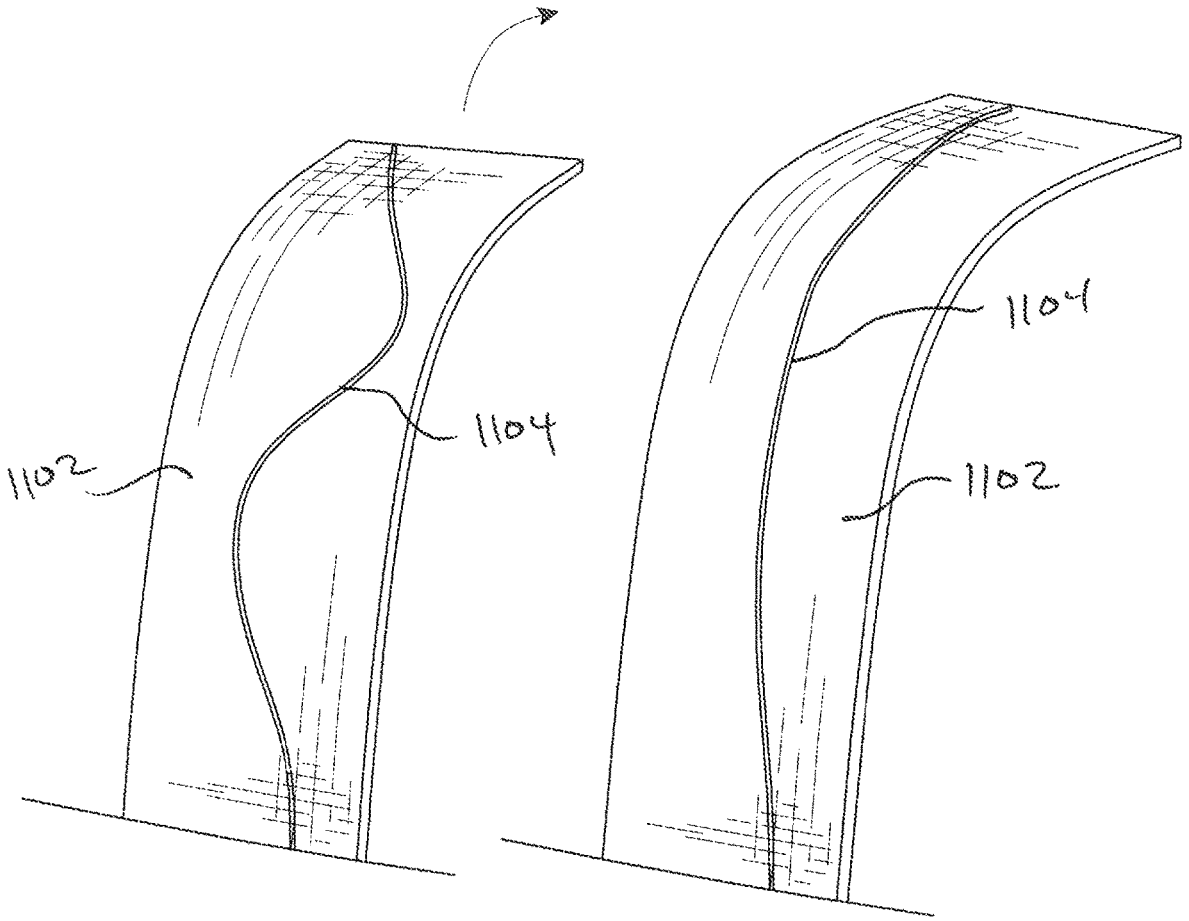

Referring now to FIGS. 11A-C, illustrated is a stop component that may be used with straps of a shoe or with a material that is configured to function in a finger-like or strap-like manner such as the non-stretch members (1006-1010) of FIG. 10A-G. The stop component is configured to limit an amount of movement of the straps or strap-like materials. In the illustrated embodiment, the stop component is formed by integrating a non-stretch material 1104 within a strap 1102 or strap-like material (hereinafter strap 1102). As shown in FIG. 11A, the non-stretch material 1104 is integrated within the strap 1102 so that in a relaxed state, the non-stretch material 1104 is relatively loose and un-strained. As shown in FIG. 11B, as the strap 1102 is moved and strained, the non-stretch material 1104 is also strained and/or pulled relatively straight. As the strap 1102 is strained and moved, the load is shared between the strap 1102 and the non-stretchable material 1104. At some point, the non-stretchable material 1104 reaches a maximum strain point and/or is fully elongated, which causes the non-stretchable material 1104 to bear most of the load or force. Given the non-stretchable properties of the non-stretchable material 1104, the non-stretchable material 1104 prevents further movement of the strap 1102. In this manner, the non-stretchable material 1104 functions as a stop to limit the amount of movement or elongation of the strap 1104.

FIG. 11C illustrates another view of the strap 620 and non-stretchable material 1104. The stop component may be employed in independent straps as shown in FIG. 11C, or may be employed in a material that functions in a strap-like fashion, such as the non-stretch members or zones (1006-1010) previously described.

Figure 14:
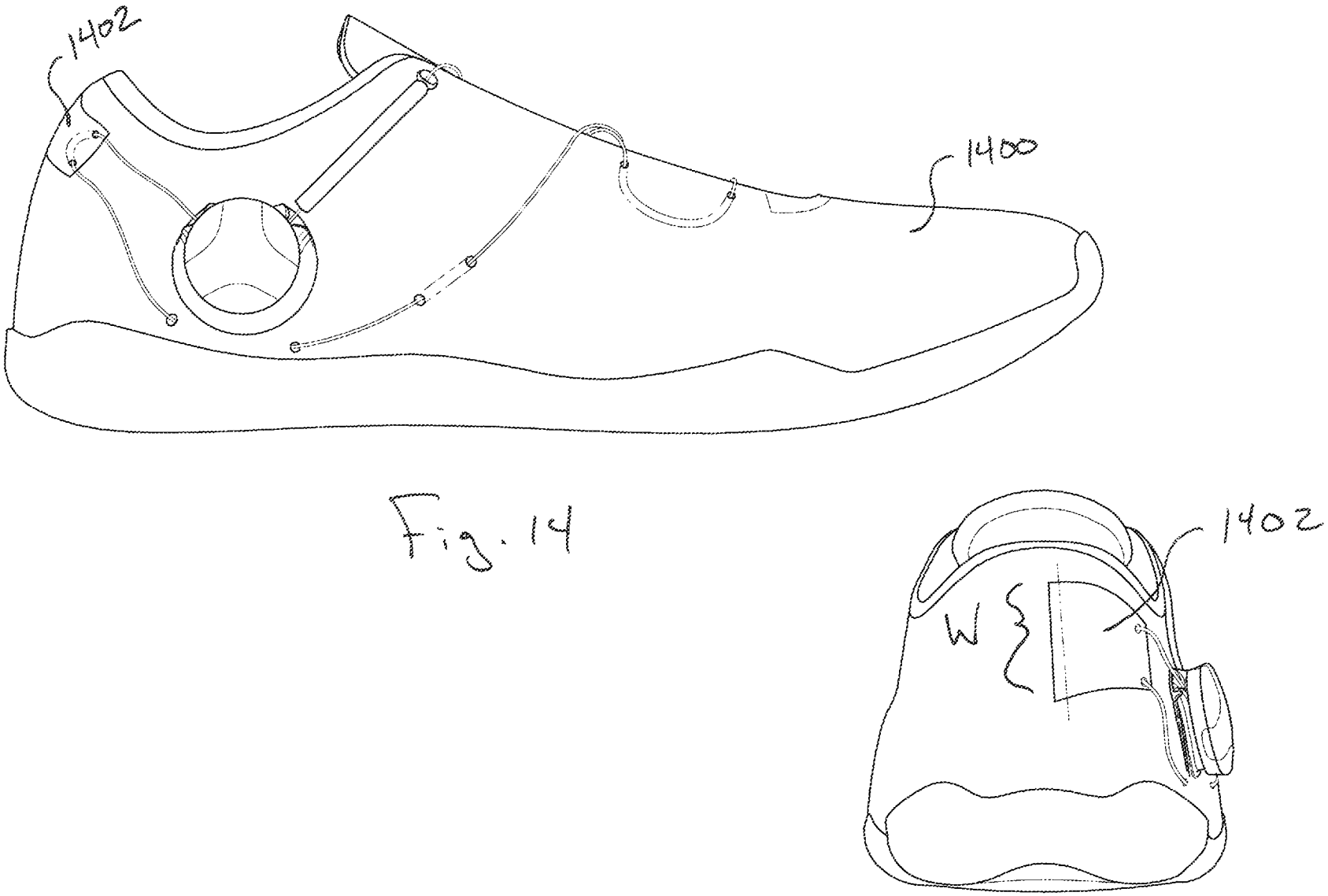
FIG. 14 illustrates an embodiment of a heel strap that may be used to close and tighten the rear portion of a shoe about a user's foot.
Figure 15:
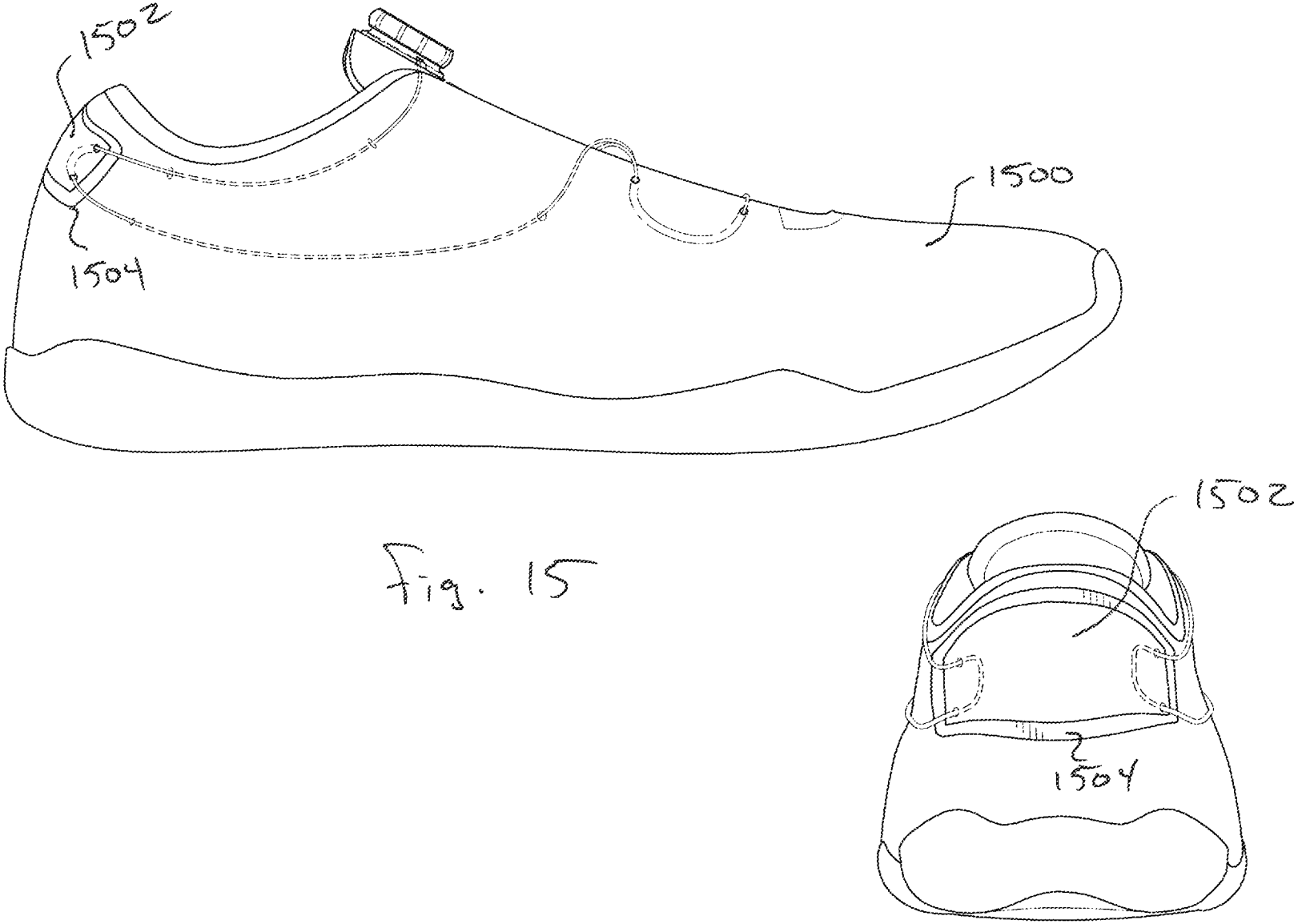
FIG. 15 illustrates another embodiment of a heel strap that is positioned on a rear surface of a shoe and operable to press the shoe's rear surface against a user's heel.

Referring now to FIG. 14, illustrated is another embodiment of a heel strap 1402 that may be used to close and tighten the rear portion of the shoe 1400 about the user's foot. In some embodiments, the heel strap 1402 may be an independent flap of fabric material that is secured to the rear portion of the shoe. In other embodiments, the heel strap 1402 may be a member that is formed in the shoe and surrounded by an elastic divider material as previously described.

The heel strap 1402 has a wider distal end than the proximal end as indicated by the callout W. The wider distal end W is stitched or otherwise coupled with the rear portion of the shoe 1400 and functions to distribute a load or tension force that is imposed on the strap 1402 across a greater portion of the shoe's rear surface. This may eliminate point loads and help pull the rear portion of the shoe 1400 forward and into contact with the user's foot. Specifically, the wider heel strap 1402 may eliminate or reduce a point load on the user's heel that may result if the lace is positioned around the heel and tensioned.

FIG. 15 illustrates another embodiment of a heel strap 1502 that is positioned on a rear surface of the shoe 1500 and operable to press the shoe's rear surface against a user's heel. The heel strap 1502 is formed or integrated into the upper and is completely or mostly surrounded by an elastic divider material 1504. The elastic divider material 1504 allows the heel strap 1502 to move and function relatively independently of the remainder of the shoe 1500 in a strap or panel-like fashion. The result is that the heel strap 1502 provides a fit and feel that is similar to that experienced with the use of an independent strap positioned about the user's heel. By positioning the elastic divider material 1504 around all or a majority of the heel strap 1502, a material window is created that allows the heel strap 1502 to move independently into contact with the user's heel in response to a pressure or tension exerted on the heel strap 1502 from the lace.

As illustrated, opposing ends of the heel strap 1502 are operationally coupled with the lace. As the opposing ends of the heel strap 1502 are tensioned, the heel strap moves longitudinally forward (i.e., toward the toe box) and into contact with the user's heel. The heel strap 1502 may likewise move vertically about the heel to some degree to conform to the shape of the user's heel. The heel straps 1502 may provide a more even closure of the rear portion of the shoe 1500 about the user's heel due to both opposing ends being operationally coupled with the lace.

Figure 16:
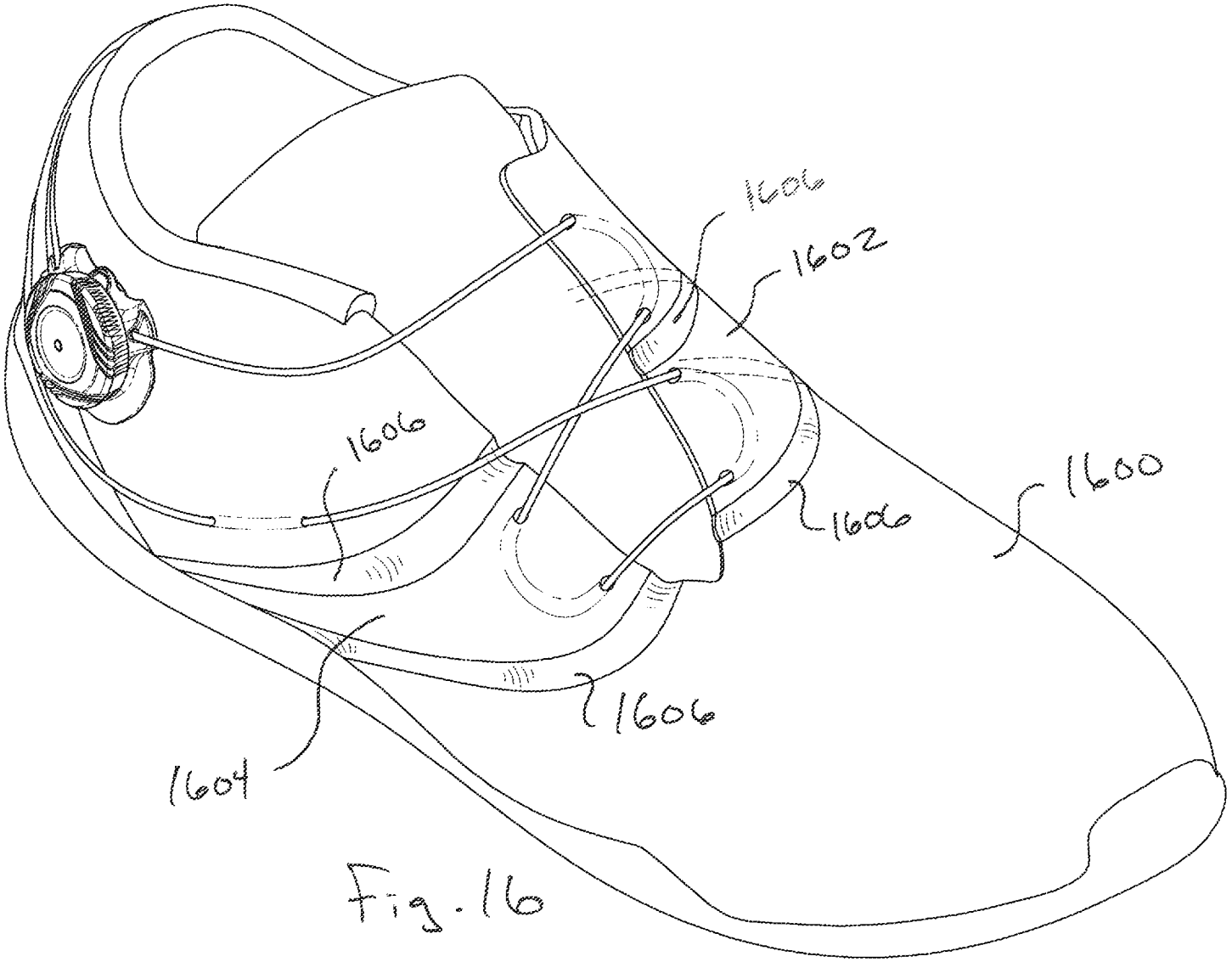
FIG. 16 illustrates an embodiment of a shoe having a pair of independently moveable and tensionable members.

Referring now to FIG. 16, illustrated is another embodiment of a shoe 1600 having a pair of independently moveable and tensionable members, 1602 and 1604. The tensionable members, 1602 and 1604, are positioned on opposing sides of the shoe 1600 and extend from near the forefront of the shoe 1600 at a distal end to near the heel at a proximal end. For example, the distal end of the tensionable members, 1602 and 1604, may be positioned near the toe-box and the proximal end of the tensionable members, 1602 and 1604, may be positioned at or near the arch on the medial side and at or behind the metatarsal bone on the lateral side. The tensionable members, 1602 and 1604, extend in an arcuate manner between the proximal and distal ends.

The tensionable members, 1602 and 1604, are isolated from the remainder of the shoe via elastic dividers 1606 that are positioned on either side of the respective tensionable members. As described herein, the elastic dividers 1606 minimize the tension forces that are transferred or imposed to the other portions of the shoe 1600. The configuration of the tensionable members, 1602 and 1604, provides a fit and feel that is similar to a sandal by essentially creating or forming "independent" straps on opposing sides of the foot, which may increase the comfort in wearing the shoe 1600.

Figure 17:
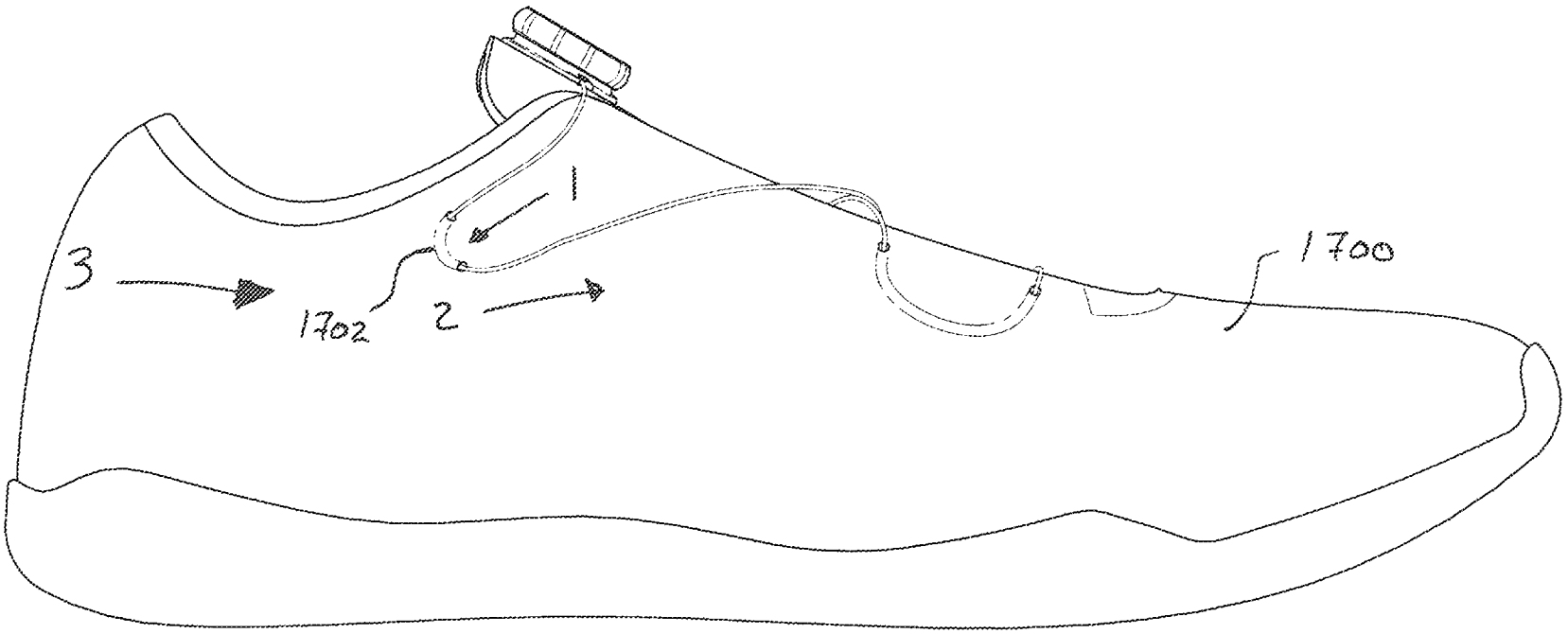
FIG. 17 illustrates an embodiment of a shoe having a rearward positioned guide member that functions to pull the rear portion of the shoe forward and into increased contact with a user's heel.

Referring now to FIG. 17, illustrated is an embodiment of a shoe 1700 having a rearward positioned guide member 1702 that functions to pull the rear portion of the shoe forward and into increased contact with a user's heel. The rearward guide member 1702 may be formed between material layers of the upper via tubing that is inserted within the upper and/or via channels that are formed in the upper. In other embodiments, the guide member 1702 may be formed on the exterior of the shoe's upper, such as by attaching fabric or webbing materials, or more rigid guide pieces, to the outer layer of the upper.

The rearward guide member 1702 routes the lace from a first direction 1 toward the shoe's heel to a second direction 2 that is toward the shoe's toe box. When the lace is tensioned, this portion of the lace (i.e., the portion that extends from direction 1 to direction 2) pulls the rearward surface of the shoe 1700 in a direction 3 that is forward, which causes the shoe's heel to be pulled forward and against the user's heel. An inward lateral force may also be imposed on the rearward guide 1702 via the tensioned lace, which may cause the shoe's collar to press against the user's ankle. Although only a single side of the shoe is illustrated having the rearward guide member 1702, it should be realized that an opposite side of the shoe 1700 may likewise include a rearward guide member.

Figure 18:
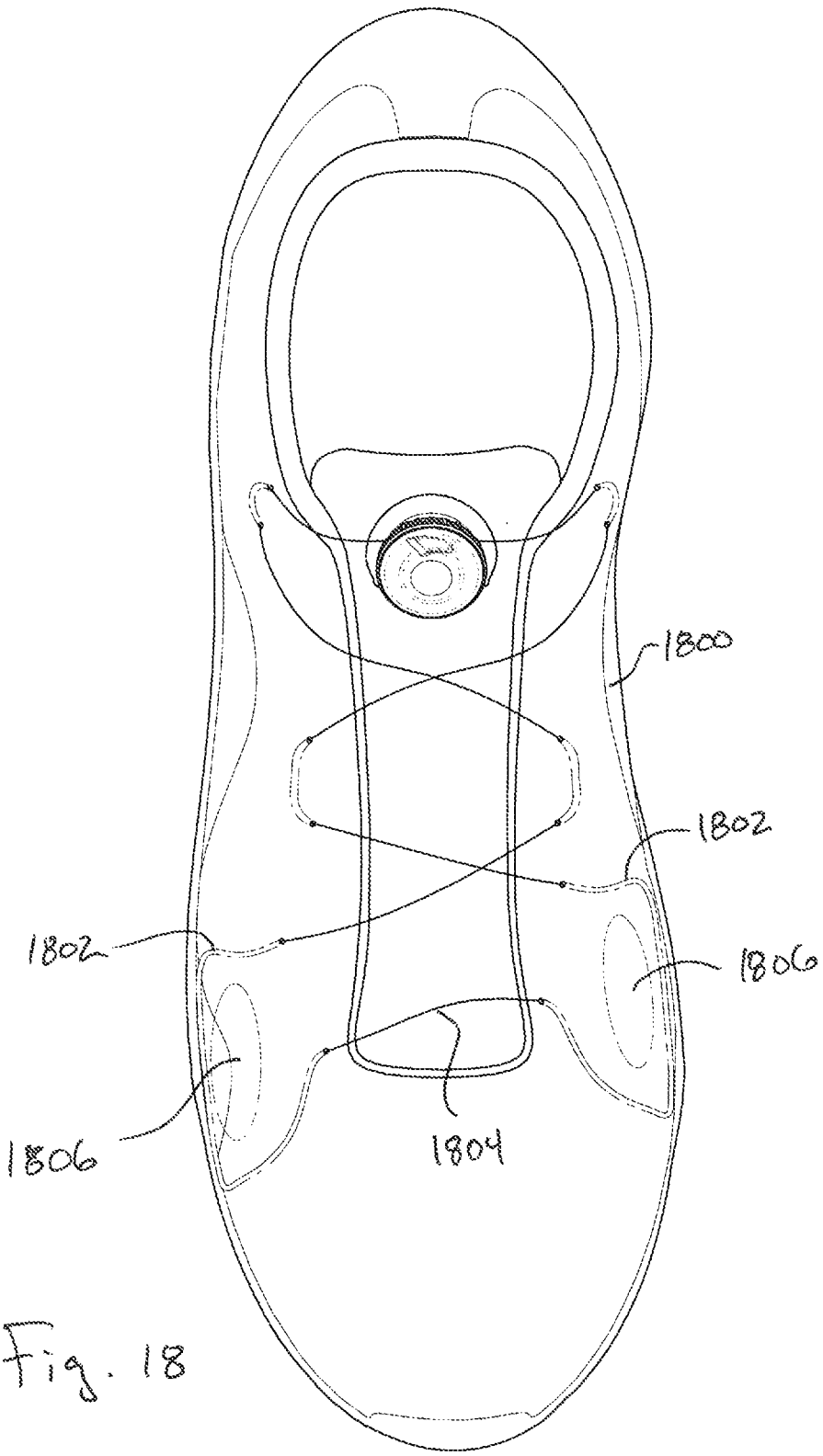
FIG. 18 illustrates a forward guide that is positioned on a shoe to provide comfortable lateral support to the metatarsal bones and phalanges.

Referring now to FIG. 18, illustrated is a forward guide 1802 that is positioned on a shoe 1800 to provide comfortable lateral support to the metatarsal bones and phalanges. The forward guide 1802 is positioned so as to extend around the mediotarsal joint 1806 of the foot, thereby preventing undue and unnecessary pressure from being exerted on the mediotarsal joints 1806 on opposing sides of the foot. Positioning the forward guide 1802 around the mediotarsal joints 1806 allows the metatarsal bones and phalanges to be supported laterally without unnecessary discomfort that may result from pressure being exerted on the mediotarsal joints 1806. The forward guide 1802 may be formed via tubing or channels that are routed around the mediotarsal joints 1806 on opposing sides of the shoe 1800. When tubing is used, the tubing may be disposed under the upper so as to be hidden from view. The forward guides 1802 allow the lace 1804 to be routed forward of the shoe's tongue. Thus, the lace 1804 is able to close and tighten the forward portion of the shoe 1800 about the user's toes.

Figure 19:
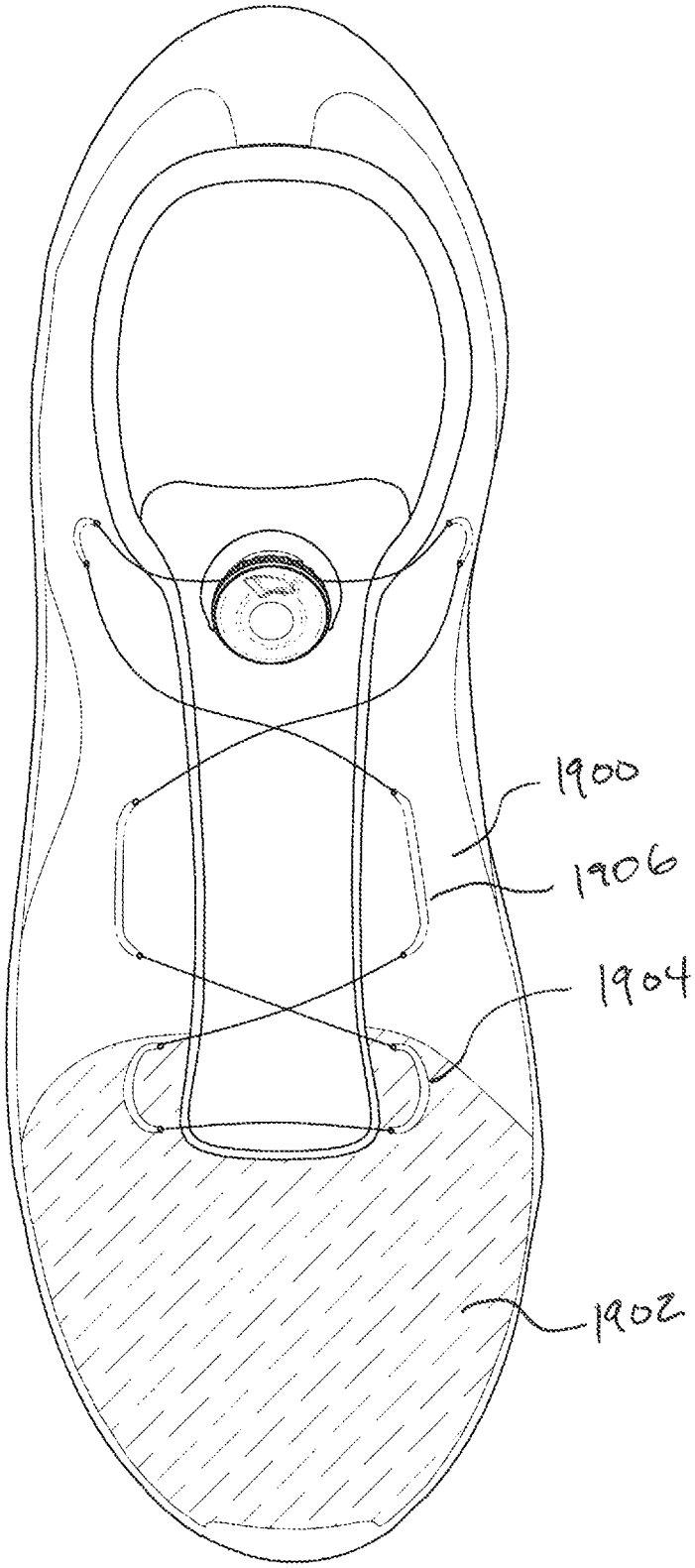
FIG. 19 illustrates an embodiment of a shoe having a toe box made of a relatively lightweight and breathable material and a lace guide positioned within the toe box.

Referring now to FIG. 19, illustrated is an embodiment of a shoe 1900 having a toe box 1902 that is made of a relatively lightweight and breathable material, such as a mesh material. A guide member 1904 is positioned in the lightweight material of the toe box 1902. The guide member 1904 routes or directs a lace across the toe box 1902 of the shoe 1900 and allows the toe box 1902 to be closed and tightened about the user's foot. The lightweight material of the toe box 1902 may not provide enough support for the guide member 1904. In such instances, the guide member 1904 may be anchored to the sole, such as by using a stop component similar to that described in FIGS. 11A-C. The stop component may prevent the lightweight material from bunching up due to the tension forces imparted by the lace. In other embodiments, the lightweight material may be reinforced around the guide member 1904 to provide sufficient structural support as needed. The shoe 1900 includes one or more additional guide members 1906 that are positioned rearward of the guide member 1904 and attached to or formed form a more rigid material.

Figure 20A:
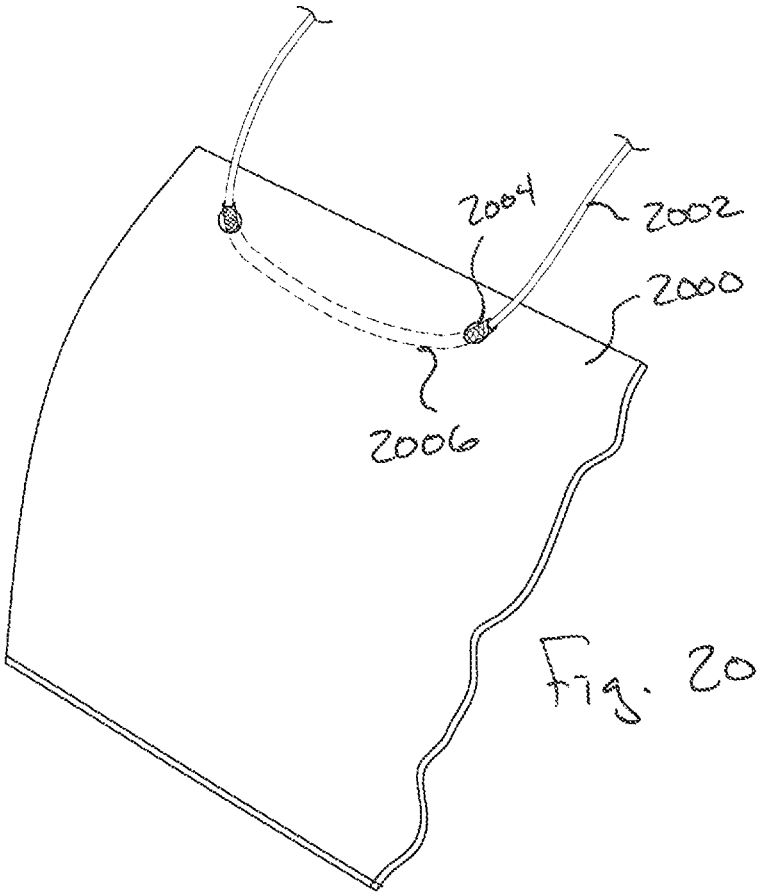
FIGS. 20A-C illustrate an embodiment of a fabric sheath that may be used as a guide member to guide or route a lace about an article.
Figure 20B:
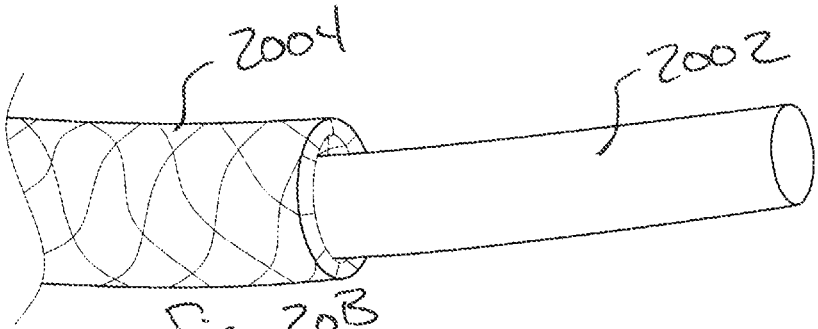
Figure 20C:
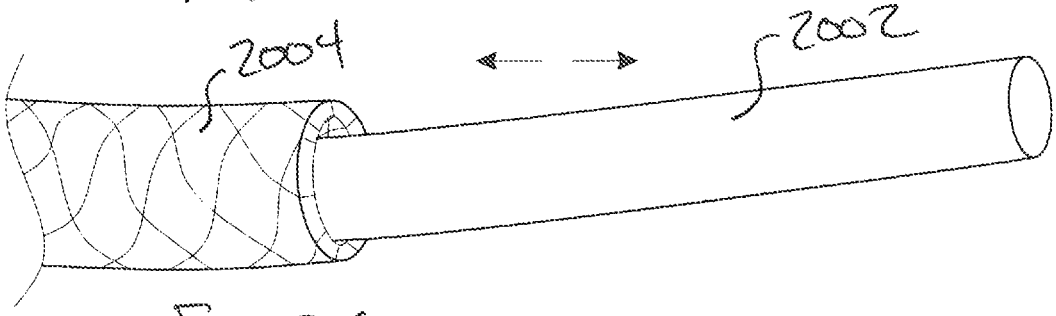

Referring now to FIGS. 20A-C, illustrated is an embodiment of a fabric sheath 2004 that may be used as a guide member to guide or route a lace 2002 about an article 2000, such as a shoe. The fabric sheath 2004 may be made of a low friction material to minimize any frictional forces between the fabric sheath 2004 and the lace 2002. To attach the fabric sheath 2004 to the article 2000, the fabric sheath 2004 may be disposed within a lumen or channel that is formed in the article 2000. In some embodiments, the article 2000 may include a pair of apertures and opposing ends of the fabric sheath 2004 may be inserted through a respective aperture so that the main body of the fabric sheath 2004 extends between the apertures. The use of the fabric sheath 2004 replaces the need for more rigid plastic tubing components to be used. The fabric sheath 2004 also allows the article and sheath to deform when a force is imparted laterally on the shoe.

In some embodiments, the fabric sheath 2004 may be pulled axially or compressed axially to cause the fabric sheath 2004 to constrict about the lace 2002. Constricting the fabric sheath 2004 about the lace 2002 may cause the lace 2002 and the fabric sheath 2004 to frictionally engage, which may prevent sliding movement of the lace 2002 through or within the fabric sheath 2004. Effecting frictional engagement of the fabric sheath 2004 and the lace 2002 in this manner may be employed to provide a zonal fit or tightness of the article. For example, if the fabric sheath 2004 is employed in a shoe, a user may initially tension the lace 2002 with the fabric sheath 2004 and lace 2002 in a non-frictionally engaged state to achieve a desired tightness of the shoe in a zone (i.e., the forefront of the shoe). The user may then pull or compress the fabric sheath 2004 axially in the forefront of the shoe to frictionally engage the fabric sheath 2004 and the lace 2002 and thereby prevent sliding of the lace 2002 through the fabric sheath 2004. The frictional engagement of the fabric sheath 2004 and the lace 2002 in the forefront of the shoe prevents further tightening of the forefront of the shoe. The user may then tension the lace 2002 to achieve a different tightness of the shoe in another region of the shoe (i.e., rearward and/or heel portion of the shoe).

Figure 21:
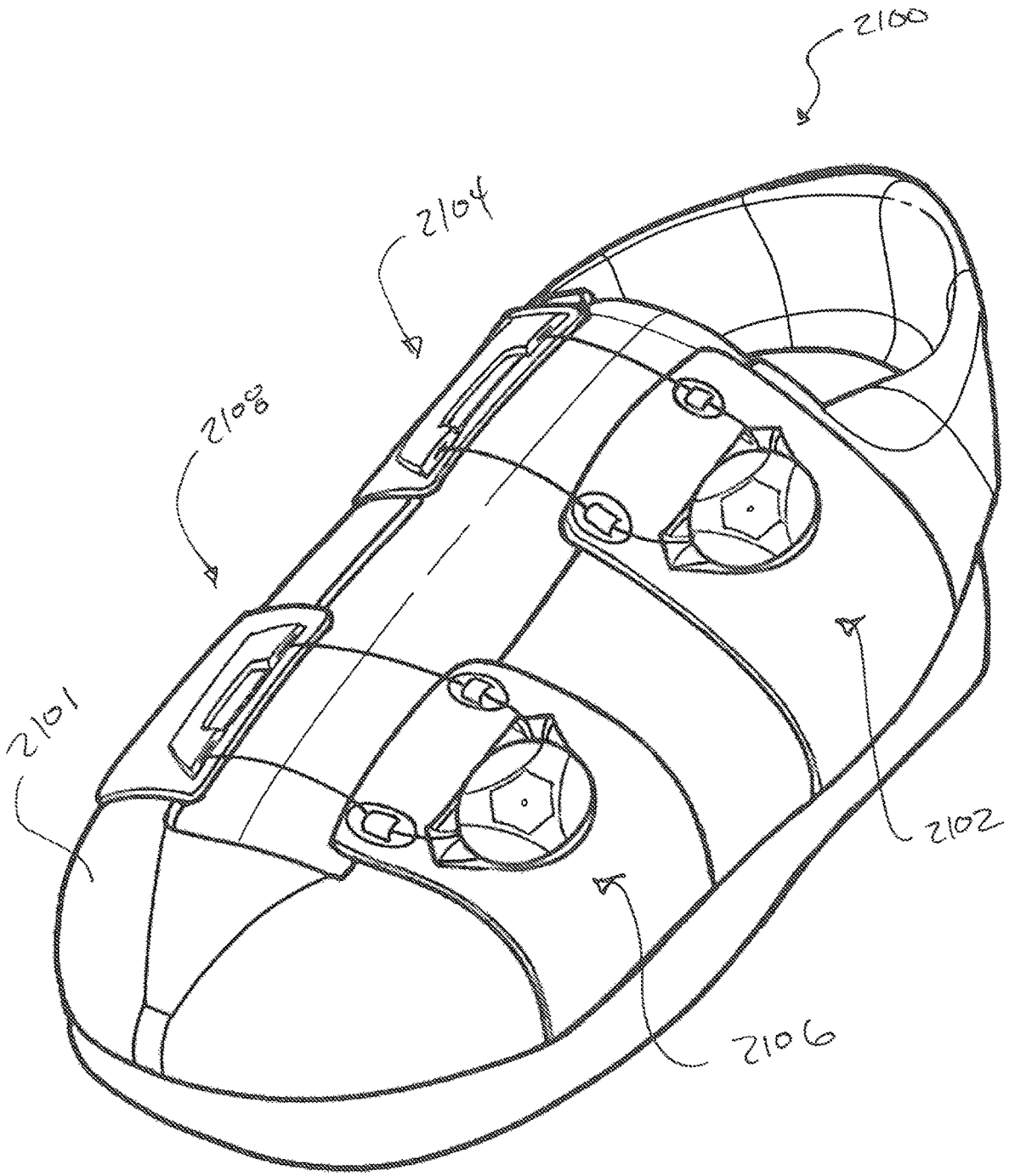
FIG. 21 illustrates an embodiment of a shoe having a first reel assembly that tensions lace within a first zone and a second reel assembly that tensions lace within a second zone of the shoe.

Referring now to FIG. 21, illustrated is an embodiment 2100 of footwear 2101 having a first reel assembly 2102 that is configured to tension a first lace in a first zone 2104 of the footwear 2101 and a second reel assembly 2106 that is configured to tension a second lace in a second zone 2108 of footwear 2101. The first and second reel assemblies, 2102 and 2106, are independently operable so as to vary the tension in the first zone 2104 and second zone 2108. Embodiment 2100 allows a user to easily and quickly adjust the tension within the different zones based on a desired usage and/or desired fit of the footwear 2101. Embodiment 2100 may include more or fewer reel assemblies as desired to provide any number of zonal tensioning options.

Figure 22A:
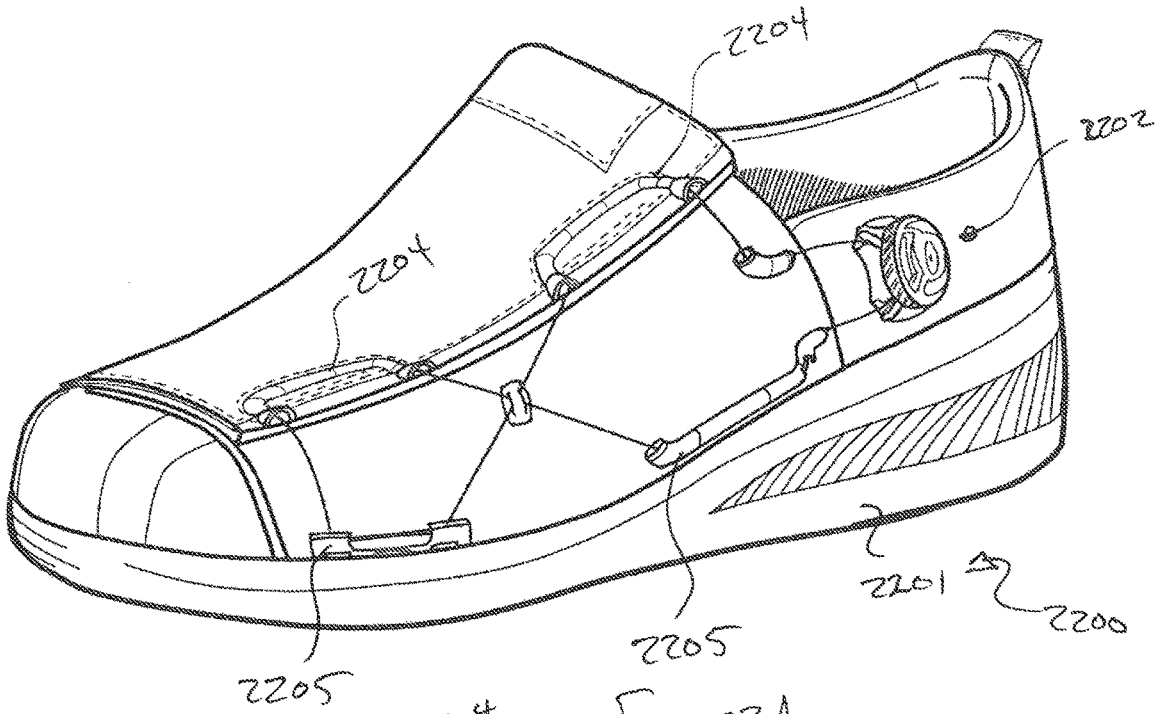
FIGS. 22A & 22B illustrate a shoe having a pair of panels that fold and close about one another and atop a user's foot.
Figure 22B:
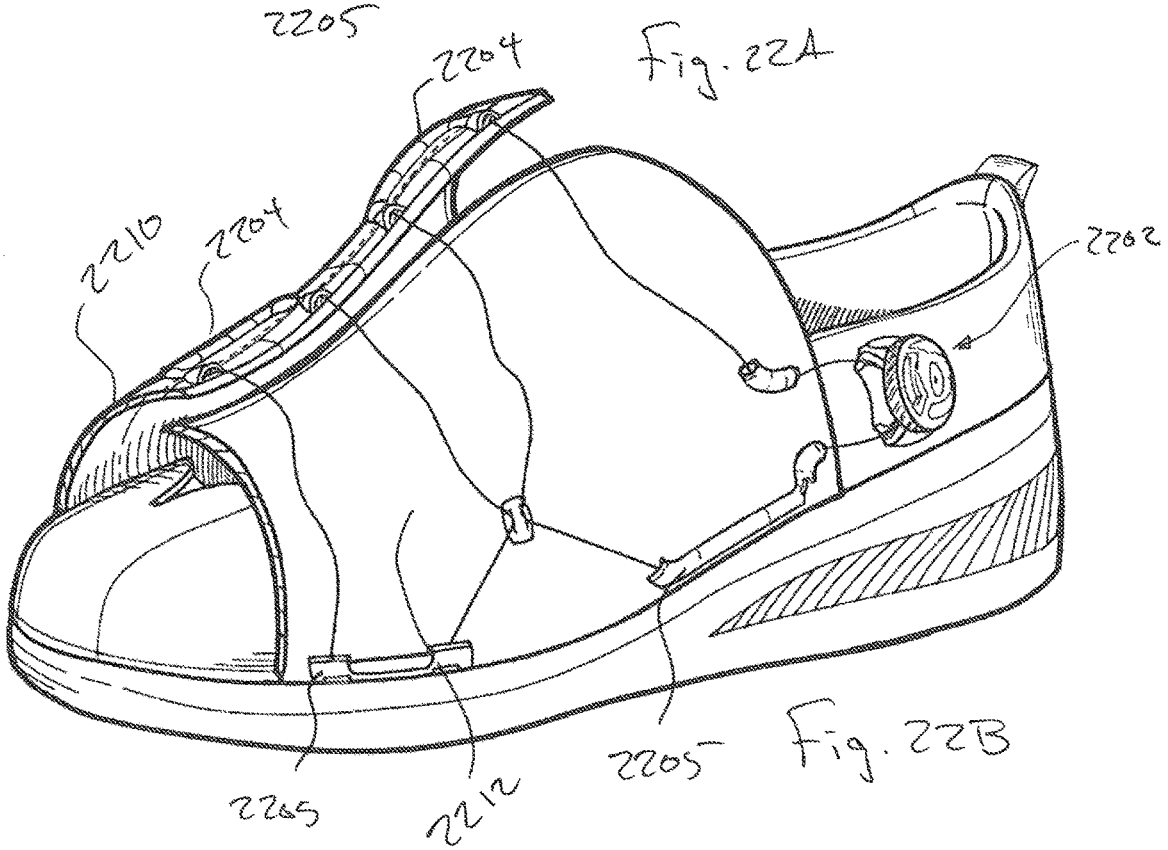

Referring now to FIGS. 22A and 22B, illustrated is a closure device 2200 that is positioned on footwear 2201 and that includes a reel assembly 2202 that tensions a tension member or lace as described herein. The lace may wind through and/or around one or more guides, 2204 and 2205, as also described herein. The reel assembly 2202 is positioned below the shoe's collar so as to be below a user's ankle. the shoe 2200 includes a pair of flaps or panels, 2210 and 2212, that fold over one another and close over the user's foot. A first set of guides 2204 is positioned on one of the panels 2210 and a second set of guides 2205 is positioned on the other panel 2212. The lace extends over and across the panel 2212 that attaches with the second set of guides 2205. As the lace is tensioned, the panels, fold over one another and close over the top of the user's foot as shown in FIG. 22A. One or both of the panels may be spring loaded so as to open upon a user loosening tension on the lace. The shoes of FIGS. 21-22B may be particularly useful for patient or dexterity challenged individuals.

The shoe configurations, lace configurations, reel assembly configurations, and the like of the various embodiments described herein may be employed or used in any of the embodiments described herein. For example, the individual members described in FIGS. 9A-10G may be used in any of the shoe configurations described herein. Thus, it should be realized that the features, aspects, or concepts described herein are not limited to any one particular embodiment and that these aspects, features, or concepts may be incorporated into the claims in any combination or in any manner desired. Likewise, various changes or modifications may be made to the embodiments without departing from the concepts, features, or aspects described herein and thus, are not limited to any particular embodiment described or illustrated. Further, while many of the embodiments have been described for use in running and/or in the context of other athletic activities, any of the embodiments may be used for various other purposes, such as for medical purpose, in general low cut shoes, mid cut shoes, tall shoes, boots, work boot, in various athletic footwear, casual footwear, sporting footwear or articles, and the like.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A shoe comprising:

a sole;

an upper that is attached to the sole and configured to fit around a foot of a wearer, the upper having a medial side and a lateral side that fit around the medial and lateral side of the foot respectively;

an upper strap portion that is attached to the medial side of the shoe and that extends laterally across an upper portion of the shoe toward the lateral side of the shoe;

a heel strap portion that is attached to the medial side of the shoe and that extends at least partially around a heel of the shoe;

a tension member that is guided or directed about a path along the shoe, the path being positioned on the lateral side of the shoe so that the tension member is only positioned along the lateral side of the shoe without being positioned on the medial side of the shoe, the tension member being coupled with a distal end of the upper strap portion and with a distal end of the heel strap portion such that tensioning of the tension member tightens the upper strap portion about the upper portion of the shoe and tightens the heel strap portion about the shoe's heel; and a tightening mechanism that is operably coupled with the tension member to effect tensioning of the tension member upon operation of the tightening mechanism;

wherein opposing ends of the tension member are coupled with the tightening mechanism; and wherein the heel strap portion and the upper strap portion are portions of a continuous and unbroken material.

2. The shoe of claim 1, wherein the tightening mechanism is positioned on the lateral side of the shoe adjacent the path of the tension member.

3. The shoe of claim 2, wherein the tightening mechanism is positioned below a collar portion of the shoe so as to be positioned below an ankle.

4. The shoe of claim 3, wherein a portion of the tension member is routed below the collar portion of the shoe and above the tightening mechanism.

5. The shoe of claim 1, wherein the tension member is guided along the path via a plurality of guides, wherein a first guide is positioned adjacent the sole, a second guide is coupled with the distal end of the upper strap portion, and a third guide is coupled with the distal end of the heel strap portion or panel.

6. The shoe of claim 1, wherein the upper strap portion includes two separate members that are moveable relative to one another.

7. The shoe of claim 6, further comprising a flexible portion that is disposed at least partially between the two separate members of the upper strap portion, wherein the flexible portion separates at least a portion of the two separate members.

8. The shoe of claim 6, wherein a proximal end of the two separate members is attached to the medial side of the shoe adjacent the sole, and wherein a proximal end of the heel strap or panel is attached to the medial side of the shoe.

9. The shoe of claim 1, further comprising a sole strap or panel that is attached to the lateral side of the shoe adjacent the sole, wherein the tension member is coupled with the sole strap or panel such that at least a portion of the tension member is routed atop the upper between the upper strap portion and the sole strap or panel.

10. The shoe of claim 9, wherein the upper strap portion and the sole strap or panel each include a plurality of guides that route or direct the at least a portion of the tension member between the upper strap portion and the sole strap or panel.

11. A shoe comprising:

a sole;

an upper attached to the sole and configured to fit around a foot of a wearer;

an upper strap portion that is attached to a first side of the shoe and that extends laterally across an upper portion of the shoe toward a second side of the shoe;

a heel strap portion that is attached to the first side of the shoe and that extends at least partially around a heel of the shoe;

a sole strap or panel that is attached to the second side of the shoe adjacent the sole;

a tension member that is routed or directed about a path along the second side of the shoe such that the tension member is only positioned along the second side of the shoe without being positioned on the first side of the shoe, the tension member being coupled with the upper strap portion and with the sole strap or panel such that at least a portion of the tension member is routed between the upper strap portion and the sole strap or panel and such that tensioning of the tension member tightens the upper strap portion about the upper portion of the shoe; and a tightening mechanism that is operable with the tension member to tension the tension member upon operation of the tightening mechanism;

wherein opposing ends of the tension member are coupled with the tightening mechanism;

wherein the tightening mechanism is separate from the upper strap portion and the sole strap or panel and the tightening mechanism is coupled directly to the upper; and wherein the heel strap portion and the upper strap portion are portions of a continuous and unbroken material.

12. The shoe of claim 11, wherein the tightening mechanism is positioned below a collar portion of the shoe so as to be positioned below an ankle.

13. The shoe of claim 12, wherein a portion of the tension member is routed below the collar portion of the shoe and above the tightening mechanism.

14. The shoe of claim 11, wherein the tension member is coupled with the heel strap portion such that tensioning of the tension member tightens the heel strap portion about the shoe's heel.

15. The shoe of claim 14, wherein the tension member is guided along the path via a plurality of guides, wherein a first guide is coupled with the upper strap portion, a second guide is coupled with the sole strap or panel, and a third guide is coupled with the heel strap portion.

16. The shoe of claim 11, wherein the upper strap portion includes two separate members that are moveable relative to one another.

17. The shoe of claim 16, further comprising a flexible portion that is disposed at least partially between the two separate members of the upper strap portion, wherein the flexible portion separates at least a portion of the two separate members.

18. The shoe of claim 16, wherein a proximal end of the two separate members is attached to a medial side of the shoe adjacent the sole.

19. The shoe of claim 11, wherein the upper strap portion includes a relatively stiff portion and a flexible portion that separates a proximal portion of the upper strap portion so that the upper strap portion is moveable and conformable to a shape of the foot.

20. The shoe of claim 11, wherein the upper strap portion and the sole strap or panel each include a plurality of guides that route or direct the at least a portion of the tension member between the upper strap portion and the sole strap or panel.

21. The shoe of claim 11, wherein the tightening mechanism is positioned on a lateral side of the shoe adjacent the path of the tension member.

22. The shoe of claim 1, wherein the heel strap is secured about the heel via one or more components positioned on the heel.

* * * * *